US007798249B2

(12) United States Patent
Tibbitts

(10) Patent No.: US 7,798,249 B2
(45) Date of Patent: Sep. 21, 2010

(54) IMPACT EXCAVATION SYSTEM AND METHOD WITH SUSPENSION FLOW CONTROL

(75) Inventor: Gordon Allen Tibbitts, Murray, UT (US)

(73) Assignee: PDTI Holdings, LLC, Houston, TX (US)

( * ) Notice: Subject to any disclaimer, the term of this patent is extended or adjusted under 35 U.S.C. 154(b) by 532 days.

(21) Appl. No.: 11/344,805

(22) Filed: Feb. 1, 2006

(65) Prior Publication Data

US 2008/0017417 A1 Jan. 24, 2008

Related U.S. Application Data

(63) Continuation-in-part of application No. 11/204,436, filed on Aug. 16, 2005, now Pat. No. 7,343,987, and a continuation-in-part of application No. 10/897,196, filed on Jul. 22, 2004, now Pat. No. 7,503,407, and a continuation-in-part of application No. 10/825,338, filed on Apr. 15, 2004, now Pat. No. 7,258,176.

(60) Provisional application No. 60/463,903, filed on Apr. 16, 2003.

(51) Int. Cl.
*E21B 7/18* (2006.01)

(52) U.S. Cl. ..... 175/67; 175/54; 175/424

(58) Field of Classification Search ..... 175/67, 175/54, 424

See application file for complete search history.

(56) References Cited

U.S. PATENT DOCUMENTS 1,459,147 A 6/1923 Dings
2,626,779 A 1/1953 Armentrout
2,724,574 A 11/1955 Ledgerwood, Jr.
2,727,727 A 12/1955 Williams
2,728,557 A * 12/1955 McNatt ..... 175/27
2,761,651 A 9/1956 Ledgerwood, Jr.
2,771,141 A 11/1956 Lewis
2,779,571 A 1/1957 Ortloff (Continued)

FOREIGN PATENT DOCUMENTS

CA 2522568 A1 11/2004

(Continued)

OTHER PUBLICATIONS

Anderson, Arthur, "Global E&P Trends," Jul. 1999.
Cohen et al., "High-Pressure Jet Kerf Drilling Shows Significant Potential to Increase ROP," SPE 96557, Oct. 2005, 1-8.
*Curlett Family Limited Partnership, Ltd.*, Plaintiff V. *Particle Drilling Technlogies, Inc.*, a Delaware Corporation; and *Particle Drilling Technologies, Inc.*, a Nevada Corporatio Defendant; Civil Action No. 4:06-CV-01012; Affidavit of Harry (Hal) B. Curlett, May 3, 2006.
Deep Drilling Basic Research Final Report, Jun. 1990.

(Continued)

*Primary Examiner*—William P Neuder
*Assistant Examiner*—Nicole A Coy
(74) *Attorney, Agent, or Firm*—Arnold & Knobloch, L.L.P.

(57) ABSTRACT

A system and method for excavating a wellbore through a subterranean formation that includes a drill string having an inner passage for flowing a suspension of fluid and impactors. The drill string includes a flow control device to block flow in the drill string passage or in the annulus formed between the drill string and the wellbore inner wall from lowing into the bit when flow is reduced or stopped. The flow can take place due to fluid density differences resulting from impactors being in suspension in the fluid. The flow control device includes a selectively openable and closable valve. Valve embodiments include valves having flapper elements, a plurality of cables suspended in an annular configuration, and whisker elements.

5 Claims, 24 Drawing Sheets

U.S. PATENT DOCUMENTS

| | | | |
|---|---|---|---|
| 2,807,442 | A | 9/1957 | Ledgerwood, Jr. |
| 2,809,013 | A | 10/1957 | Ledgerwood, Jr. et al. |
| 2,815,931 | A | 12/1957 | Williams |
| 2,841,365 | A | 7/1958 | Ramsey et al. |
| 2,868,509 | A | 1/1959 | Williams |
| 2,954,122 | A | 9/1960 | Colburn |
| 3,001,652 | A | 9/1961 | Schroeder et al. |
| 3,055,442 | A | 9/1962 | Prince |
| 3,084,752 | A | 4/1963 | Tirapolsky |
| 3,093,420 | A | 6/1963 | Levene et al. |
| 3,112,800 | A | 12/1963 | Bobo |
| 3,123,159 | A | 3/1964 | Buck |
| 3,132,852 | A | 5/1964 | Dolbear |
| 3,261,463 | A | 7/1966 | Eveson et al. |
| 3,322,214 | A | 5/1967 | Buck |
| 3,374,341 | A | 3/1968 | Klotz |
| 3,380,475 | A | 4/1968 | Armstrong |
| 3,385,386 | A | 5/1968 | Goodwin et al. |
| 3,389,759 | A | 6/1968 | Mori et al. |
| 3,416,614 | A | 12/1968 | Goodwin et al. |
| 3,424,255 | A | 1/1969 | Mori et al. |
| 3,469,642 | A | 9/1969 | Goodwin et al. |
| 3,542,142 | A | 11/1970 | Hasiba et al. |
| 3,548,959 | A | 12/1970 | Hasiba |
| 3,576,221 | A | 4/1971 | Hasiba |
| 3,645,346 | A | 2/1972 | Miller et al. |
| 3,667,557 | A | 6/1972 | Todd et al. |
| 3,684,090 | A | 8/1972 | Kilbride |
| 3,688,852 | A | 9/1972 | Gaylord et al. |
| 3,688,859 | A | 9/1972 | Maurer |
| 3,704,966 | A | 12/1972 | Beck, Jr. |
| 3,713,499 | A | 1/1973 | Arscott et al. |
| 3,831,753 | A | 8/1974 | Gaylord et al. |
| 3,838,742 | A | 10/1974 | Juvkam-Wold |
| 3,852,200 | A | 12/1974 | Meyer |
| 3,865,202 | A | 2/1975 | Takahashi et al. |
| 3,924,698 | A | 12/1975 | Juvkam-Wold |
| 4,042,048 | A | 8/1977 | Schwabe |
| 4,067,617 | A | 1/1978 | Bunnelle |
| 4,141,592 | A | 2/1979 | Lavon |
| 4,260,477 | A | 4/1981 | Corrans |
| 4,266,621 | A | 5/1981 | Brock |
| 4,269,279 | A | 5/1981 | House |
| 4,304,609 | A | 12/1981 | Morris |
| 4,361,193 | A | 11/1982 | Gravley |
| 4,391,339 | A | 7/1983 | Johnson, Jr. et al. |
| 4,420,390 | A | 12/1983 | Carr |
| 4,444,277 | A | 4/1984 | Lewis |
| 4,476,027 | A | 10/1984 | Fox |
| 4,490,078 | A | 12/1984 | Armstrong |
| 4,492,276 | A | 1/1985 | Kamp |
| 4,497,598 | A | 2/1985 | Blanton |
| 4,534,427 | A | 8/1985 | Wang et al. |
| 4,624,327 | A | 11/1986 | Reichman |
| 4,627,502 | A | 12/1986 | Dismukes |
| 4,681,264 | A | 7/1987 | Johnson |
| 4,699,548 | A | 10/1987 | Bergstrom |
| 4,768,709 | A | 9/1988 | Yie |
| 4,809,791 | A | 3/1989 | Hayatdavoudi |
| 4,825,963 | A | 5/1989 | Ruhle |
| 4,852,668 | A | 8/1989 | Dickinson, III et al. |
| 5,090,498 | A | 2/1992 | Hamill |
| 5,199,512 | A | 4/1993 | Curlett |
| 5,291,957 | A | 3/1994 | Curlett |
| 5,355,967 | A | 10/1994 | Mueller et al. |
| 5,421,420 | A | 6/1995 | Malone et al. |
| 5,542,486 | A | 8/1996 | Curlett |
| 5,718,298 | A | 2/1998 | Rusnak |
| 5,862,871 | A | 1/1999 | Curlett |
| 5,881,830 | A | 3/1999 | Cooley |
| 5,897,062 | A | 4/1999 | Enomoto et al. |
| 5,944,123 | A | 8/1999 | Johnson |
| 5,944,195 | A | 8/1999 | Huang et al. |
| 6,003,623 | A | 12/1999 | Mies |
| 6,142,248 | A | 11/2000 | Thigpen et al. |
| 6,152,356 | A | 11/2000 | Minden |
| 6,264,842 | B1 | 7/2001 | Boehm |
| 6,530,437 | B2 | 1/2002 | Maurer et al. |
| 6,345,672 | B1 | 2/2002 | Dietzen |
| 6,347,675 | B1 | 2/2002 | Kolle |
| 6,386,300 | B1 | 5/2002 | Curlett et al. |
| 6,474,418 | B2 | 11/2002 | Miramon |
| 6,506,310 | B2 | 1/2003 | Kulbeth |
| 6,533,946 | B2 | 3/2003 | Pullman |
| 6,571,700 | B2 | 6/2003 | Nakamura et al. |
| 6,581,700 | B2 | 6/2003 | Curlett et al. |
| 6,601,650 | B2 | 8/2003 | Sundararajan |
| 6,651,822 | B2 | 11/2003 | Alanis |
| 6,904,982 | B2 | 6/2005 | Judge et al. |
| 6,920,945 | B1 | 7/2005 | Belew et al. |
| 7,090,017 | B2 | 8/2006 | Justus et al. |
| 7,172,038 | B2 | 2/2007 | Terry et al. |
| 7,258,176 | B2 | 8/2007 | Tibbitts et al. |
| 7,343,987 | B2 | 3/2008 | Tibbitts |
| 7,383,896 | B2 | 6/2008 | Tibbitts |
| 7,398,838 | B2 | 7/2008 | Harder et al. |
| 7,398,839 | B2 | 7/2008 | Harder |
| 7,503,407 | B2 | 3/2009 | Tibbitts |
| 2002/0011338 | A1 | 1/2002 | Maurer et al. |
| 2002/0134550 | A1 | 9/2002 | Leeson et al. |
| 2006/0011386 | A1 | 1/2006 | Tibbitts |
| 2006/0016622 | A1 | 1/2006 | Tibbitts |
| 2006/0016624 | A1 | 1/2006 | Tibbitts |
| 2006/0021798 | A1 | 2/2006 | Tibbitts |
| 2006/0027398 | A1 | 2/2006 | Tibbitts et al. |
| 2006/0124304 | A1 | 6/2006 | Bloess et al. |
| 2006/0191717 | A1 | 8/2006 | Harder et al. |
| 2006/0191718 | A1 | 8/2006 | Harder et al. |
| 2006/0818035 | | 8/2006 | Harder |
| 2008/0017417 | A1 | 1/2008 | Tibbits |
| 2008/0156545 | A1 | 7/2008 | Tibbitts |
| 2008/0196944 | A1 | 8/2008 | Tibbitts |
| 2008/0210472 | A1 | 9/2008 | Tibbitts |
| 2008/0230275 | A1 | 9/2008 | Harder |
| 2009/0038856 | A1 | 2/2009 | Vuyk |
| 2009/0090557 | A1 | 4/2009 | Vuyk, Jr. |
| 2009/0126994 | A1 | 5/2009 | Tibbitts |
| 2009/0200080 | A1 | 8/2009 | Tibbitts |
| 2009/0200084 | A1 | 8/2009 | Vuyk |
| 2009/0205871 | A1 | 8/2009 | Tibbitts |
| 2009/0218098 | A1 | 9/2009 | Tibbitts |
| 2009/0223718 | A1 | 9/2009 | Tibbitts |

FOREIGN PATENT DOCUMENTS

| | | | |
|---|---|---|---|
| CA | 2588170 | A1 | 5/2007 |
| EP | 0192016 | A1 | 8/1986 |
| GB | 2385346 | A | 8/2003 |
| GB | 2385346 | B | 9/2004 |
| IQ | 20055376 | | 11/2005 |
| WO | 200225053 | A1 | 3/2002 |
| WO | WO 02/25053 | A1 | 3/2002 |
| WO | 0234653 | A | 5/2002 |
| WO | 0292956 | A | 11/2002 |
| WO | WO 2004/094734 | A2 | 11/2004 |
| WO | WO 2004/106693 | | 12/2004 |
| WO | 200601997 | A3 | 2/2006 |
| WO | 2009009792 | | 1/2009 |
| WO | 2009049076 | A1 | 4/2009 |
| WO | 2009065107 | A1 | 5/2009 |

WO 2009099945 A2 8/2009

OTHER PUBLICATIONS

Eckel et al., "Development and Testing of Jet Pump Pellet Impact Drill Bits," Petroleum Transactions, Aime, 1956, 1-10, vol. 207.
Fair, John, "Development of High-Pressure Abrasive-Jet Drilling," Journal of Petroleum Technology, Aug. 1981, 1379-1388.
Galecki et al., "Steel Shot Entrained Ultra High Pressure Waterjet For Cutting and Drilling in Hard Rocks," 371-388.
Geddes et al., "Leveraging a New Energy Source to Enhance Heavy-Oil and Oil-Sands Production," Society of Petroleum Engineers, SPE/PS-CIM/CHOA 97781, 2005.
Killalea, Mike, "High Pressure Drilling System Triples ROPS, Stymies Bit Wear," Drilling, Mar./Apr. 1989, 10-12.
Kolle et al., "Laboratory and Field Testing of an Ultra-High-Pressure, Jet-Assisted Drilling System," SPE/IADC 22000, 1991, 847-856.
Ledgerwood, L., "Efforts to Devlop Improved Oilwell Drilling Methods," Petroleum Transactions, Aime, 1960, 61-74, vol. 219.
Maurer, William, "Advanced Drilling Techniques," Chapter 5, 19-27, Petroleum Publishing Co., Tulsa, OK.
Maurer, William, "Impact Crater Formation in Rock," Journal of Applied Physics, Jul. 1960, 1247-1252, vol. 31, No. 7.
Peterson et al., "A New Look at Bit-Flushing."
Review of Mechanical Bit/Rock Interactions, vol. 3, 3-1-3-68.
Ripkin et al., "A Study of the Fragmentation of Rock by Impingement with Water and Solid Impactors," University of Minnesota St. Anthony Falls Hydraulic Laboratory, Feb. 1972.
Security DBS, 1995.
Singh, Madan, "Rock Breakage By Pellet Impact," IIT Research Institute, Dec. 24, 1969.
Summers et al., "A Further Investigation of DIAjet Cutting," Jet Cutting Technology-Proceedings of the 10th International Conference, 1991, pp. 181-192; Elsevier Science Publishers Ltd, USA.
Summers, David, "Waterjetting Technology," Abrasive Waterjet Drilling, 557-598.
Veenhuizen, et al., "Ultra-High Pressure Jet Assist of Mechanical Drilling," SPE/IADC 37579, 79-90, 1997.
Co-pending U.S. Appl. No. 11/204,981, filed Aug. 16, 2005, Titled "Injector Systems".
Co-pending U.S. Appl. No. 11/205,006, filed Aug. 16, 2005, Titled "Secondary Types of Educators".
Co-pending U.S. Appl. No. 11/204,442, filed Aug. 16, 2005, Titled "Impact Excavation System and Method with Particle Trap".
Co-pending U.S. Appl. No. 10/558,181, filed Nov. 22, 2005, Titled "System for Cutting Earthen Formations".
International Search Report PCT/US04/11578; Dated Dec. 28, 2004.
International Preliminary Report of Patentability PCT/US04/11578; Dated Oct. 21, 2005.
Written Opinion PCT/US04/11578; Dated Dec. 28, 2004.
www.particledrilling.com, May 4, 2006.
Summers, David A., "Waterjet Drilling Systems," from Waterjetting Technology, pp. 557-598, published by E&FN Spon, London, UK, First Edition 1995 (ISBN 0 419 19660 9).
Maurer et al., "Deep Drilling Basic Research vol. 1—Summary Report," Gas Research Institute, GRI 90/0265.1, Jun. 1990.
Co-pending U.S. Appl. No. 10/825,338, filed Apr. 15, 2004, Titled "Drill Bit".
Co-pending U.S. Appl. No. 10/897,196, filed Jul. 22, 2004, Titled "Impact Excavation System and Method".
Co-pending U.S. Appl. No. 11/204,436, filed Aug. 16, 2005, Titled "Internal Subs with Flow Control of Shot".
Co-pending U.S. Appl. No. 11/204,722, filed Aug. 16, 2005, Titled "Shot Trap".
Co-pending U.S. Appl. No. 11/204,862, filed Aug. 16, 2005, Titled "PID Nozzles".
Examination Report dated May 8, 2007 on GCC Patent No. GCC/P/2004/3505.
International Search Report PCT/US05/25092; Dated Mar. 6, 2006.
Written Opinion PCT/US05/25092; Dated Mar. 6, 2006.
Examination Report dated Mar. 26, 2009 on EPO Application No. 04759869.3, 5 pages.
Behavior of Suspensions and Emulsion in Drilling Fluids, Nordic Rheology Society,Jun. 14-15, 2007.
Colby, R.N., Viscoelasticity of Structured Fluids, Corporate Research Laboratories, Eastman Kodak Company, Rochester, New York.
Rheo-Plex Product Information Sheet, Scomi Oiltools, 2 pages.
Gelplex Product Information Sheet, Miswaco, 2 pages.
Drilplex Product Information Sheet, Miswaco, 2 pages.
Drilplex System Successfully Mills Casing Windows Offshore Egypt Performance Report. Miswaco, 2 pages.
Drilplex The Versatile Water-Base System With Exceptional Rheological Properties Designed To Lower Costs In A Wide Range of Wells Product Information Sheet, Miswaco, 6 pages.
Examination Report dated Sep. 7, 2006 on EPO Application No. 04759869.3, 3 pages.
Response to Examination Report dated Mar. 14, 2007 on EPO Application No. 04759869.3, 45 pages.
Result of consultation by telephone with applicant dated Jul. 4, 2007 on EPO Application No. 04759869.3, 3 pages.
Response to Examination Report dated Dec. 19, 2007 on EPO Application No. 04759869.3, 11 pages.
Examination Report dated Apr. 9, 2008 on EPO Application No. 04759869.3, 5 pages.
Response to Examination Report dated Jan. 30, 2009 on EPO Application No. 04759869.3, 6 pages.
Response to Examination Report dated Oct. 2, 2009 on EPO Application No. 04759869.3, 9 pages.
Summons to Attend Oral Proceedings and Examination Report dated Dec. 7, 2009 on EPO Application No. 04759869.3, 3 pages.
International Preliminary Report on Patentability dated Nov. 19, 2009 on PCT/US08/05955, 4 pages.
U.S. Appl. No. 12/363,022, filed Jan. 30, 2009, Tibbitts, co-pending application.
U.S. Appl. No. 12/271,514, filed Nov. 14, 2008, Tibbitts, co-pending application.
U.S. Appl. No. 12/248,649, filed Jun. 9, 2008, Vuyk, Jr., co-pending application.
U.S. Appl. No. 10/558,181, filed Nov. 22, 2005, Tibbitts, co-pending application.
U.S. Appl. No. 12/363,119, filed Jan. 30, 2009, Tibbitts, co-pending application.
U.S. Appl. No. 12/120,763, filed May 15, 2008, Tibbitts, co-pending application.
U.S. Appl. No. 11/204,862, filed Aug. 16, 2005, Tibbitts, co-pending application.
U.S. Appl. No. 11/205,006, filed Aug. 16, 2005, Harder, co-pending application.
U.S. Appl. No. 11/773,355, filed Jul. 3, 2007, Vuyk.
U.S. Appl. No. 11/801,268, filed May 9, 2007, Tibbitts.
U.S. Appl. No. 12/033,829, filed Feb. 19, 2008, Tibbitts.
U.S. Appl. No. 12/172,760, filed Jul. 14, 2008, Vuyk, Jr.
U.S. Appl. No. 12/388,289, filed Feb. 18, 2009, Tibbitts.
U.S. Appl. No. 11/344,805, filed Feb. 1, 2009, Tibbitts.
International Preliminary Report on Patentability PCT/US08/79391, dated Apr. 22, 2010, 8 pages.
File history of European Patent Application No. 04759869.3.
File history of European Patent Application No. 5771403.2.
File history of GCC Patent Application No. 2005/5376.
File history of Iraq Patent Application No. 98/2005.
File history of Norwegian Patent Application No. 20070997.
File history of Venezuelan Patent Application No. 1484-05.
File history of Canadian Patent Application No. 2,588,170.
File history of Canadian Patent Application No. 2,522,568.
File history of Iraq Patent Application No. 34/2004.
File history of Norwegian Patent Application No. 20055409.
File history of GCC Patent Application No. 2004/3659.
International Preliminary Report on Patentability dated Nov. 19, 2009 on PCT/US08/05955, 5 pages.
International Preliminary Report on Patentability dated Jan. 12, 2010 on PCT/US08/69972, 5 pages.

* cited by examiner

IMPACT EXCAVATION SYSTEM AND METHOD WITH SUSPENSION FLOW CONTROL

CROSS-REFERENCE TO RELATED APPLICATIONS

This application is a continuation-in-part of pending U.S. patent application Ser. No. 11/204,436, filed on Aug. 16, 2005, which is a continuation-in-part of pending U.S. patent application Ser. No. 10/897,196, filed on Jul. 22, 2004, which is a continuation-in-part of pending U.S. patent application Ser. No. 10/825,338, filed on Apr. 15, 2004, which claims the benefit of 35 U.S.C. 111(b) provisional application Ser. No. 60/463,903, filed on Apr. 16, 2003, the disclosures of which are incorporated herein by reference.

This application is related to the following co-pending applications: U.S. patent application Ser. No. 11/204,981, filed on Aug. 16, 2005; U.S. patent application Ser. No. 11/204,862, filed on Aug. 16, 2005; U.S. patent application Ser. No. 11/205,006, filed on Aug. 16, 2005; U.S. patent application Ser. No. 11/204,772, filed on Aug. 16, 2005; U.S. patent application Ser. No. 11/204,442, filed on Aug. 16, 2005; and U.S. patent application Ser. No. 11/204,436, filed on Aug. 16, 2005, the disclosures of which are incorporated herein by reference and each of which is a continuation-in-part of U.S. patent application Ser. No. 10/897,196, filed on Jul. 22, 2004, which is a continuation-in-part of pending U.S. patent application Ser. No. 10/825,338, filed on Apr. 15, 2004, which claims the benefit of 35 U.S.C. 111(b) provisional application Ser. No. 60/463,903, filed on Apr. 16, 2003, the disclosures of which are incorporated herein by reference.

BACKGROUND

This disclosure relates to a system and method for excavating a formation, such as to form a wellbore for the purpose of oil and gas recovery, to construct a tunnel, or to form other excavations in which the formation is cut, milled, pulverized, scraped, sheared, indented, and/or fractured, hereinafter referred to collectively as cutting.

DETAILED DESCRIPTION OF THE ILLUSTRATIVE EMBODIMENTS

Figure 1:
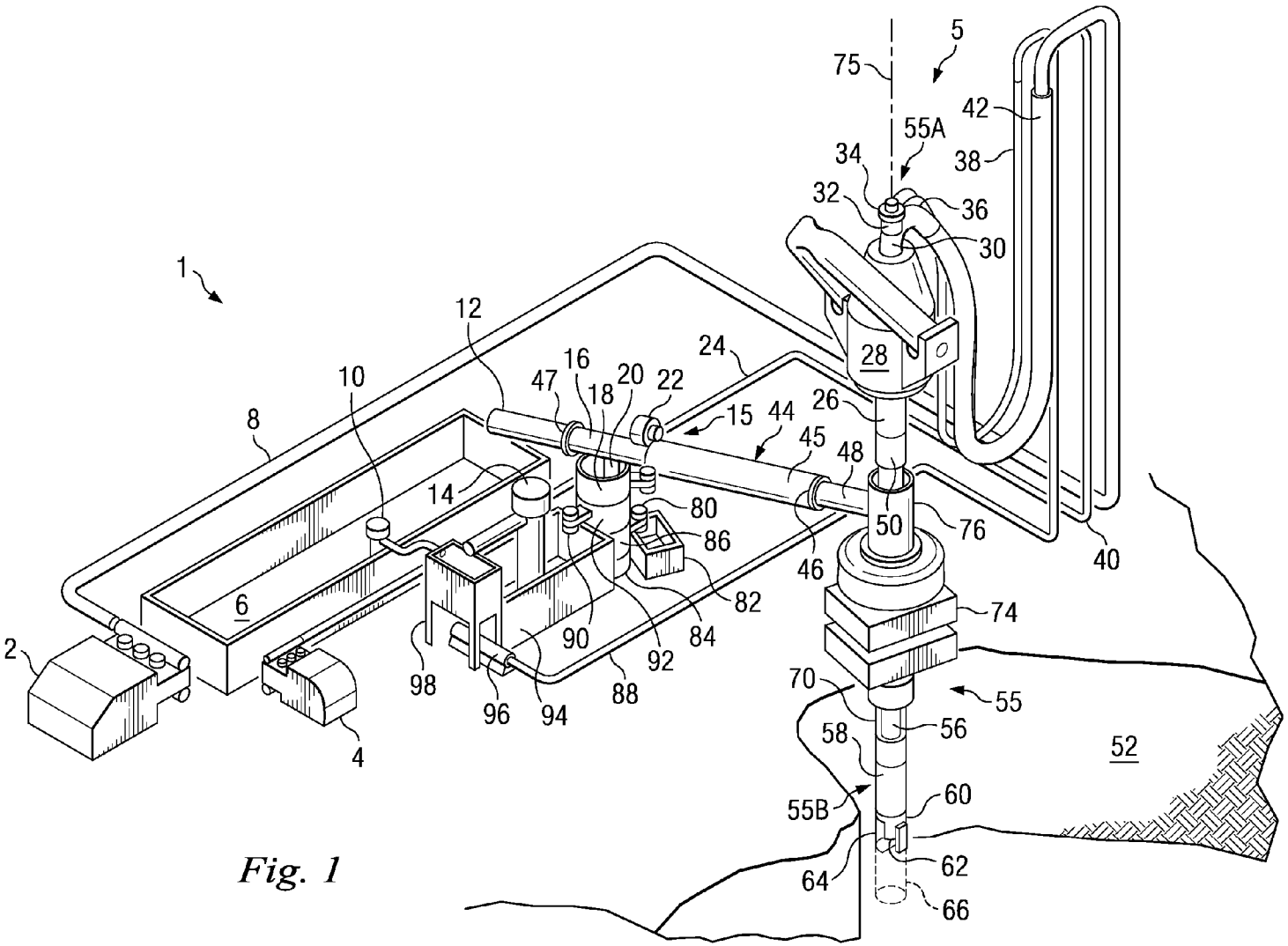
FIG. 1 is an isometric view of an excavation system according to an embodiment.

In the drawings and description that follows, like parts are marked throughout the specification and drawings with the same reference numerals, respectively. The drawings are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

Figure 2:
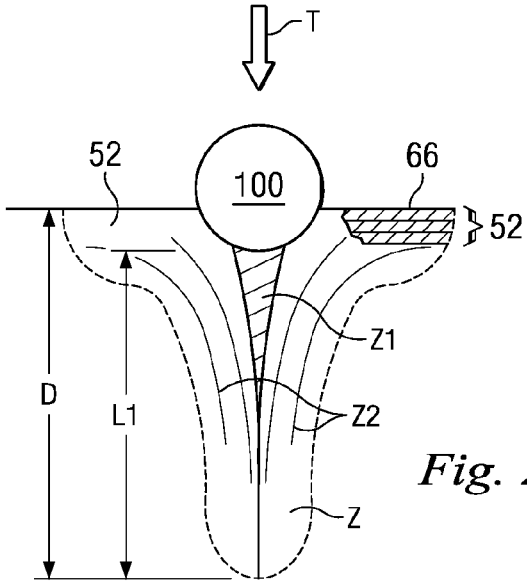
FIG. 2 illustrates an impactor impacted with a formation.

FIGS. 1 and 2 illustrate an embodiment of an excavation system 1 comprising the use of solid material particles, or impactors, 100 to engage and excavate a subterranean formation 52 to create a wellbore 70. The excavation system 1 may comprise a pipe string 55 comprised of collars 58, pipe 56, and a kelly 50. An upper end of the kelly 50 may interconnect with a lower end of a swivel quill 26. An upper end of the swivel quill 26 may be rotatably interconnected with a swivel 28. The swivel 28 may include a top drive assembly (not shown) to rotate the pipe string 55. Alternatively, the excavation system 1 may further comprise a body member such as, for example, a drill bit 60 to cut the formation 52 in cooperation with the solid material impactors 100. The drill bit 60 may be attached to the lower end 55B of the pipe string 55 and may engage a bottom surface 66 of the wellbore 70. The drill bit 60 may be a roller cone bit, a fixed cutter bit, an impact bit, a spade bit, a mill, an impregnated bit, a natural diamond bit, or other suitable implement for cutting rock or earthen formation. Referring to FIG. 1, the pipe string 55 may include a feed, or upper, end 55A located substantially near the excavation rig 5 and a lower end 55B including a nozzle 64 supported thereon. The lower end 55B of the string 55 may include the drill bit 60 supported thereon. The excavation system 1 is not limited to excavating a wellbore 70. The excavation system and method may also be applicable to excavating a tunnel, a pipe chase, a mining operation, or other excavation operation wherein earthen material or formation may be removed.

To excavate the wellbore 70, the swivel 28, the swivel quill 26, the kelly 50, the pipe string 55, and a portion of the drill bit 60, if used, may each include an interior passage that allows circulation fluid to circulate through each of the aforementioned components. The circulation fluid may be withdrawn from a tank 6, pumped by a pump 2, through a through medium pressure capacity line 8, through a medium pressure capacity flexible hose 42, through a gooseneck 36, through the swivel 28, through the swivel quill 26, through the kelly 50, through the pipe string 55, and through the bit 60.

The excavation system 1 further comprises at least one nozzle 64 on the lower 55B of the pipe string 55 for accelerating at least one solid material impactor 100 as they exit the pipe string 100. The nozzle 64 is designed to accommodate the impactors 100, such as an especially hardened nozzle, a shaped nozzle, or an "impactor" nozzle, which may be particularly adapted to a particular application. The nozzle 64 may be a type that is known and commonly available. The nozzle 64 may further be selected to accommodate the impactors 100 in a selected size range or of a selected material composition. Nozzle size, type, material, and quantity may be a function of the formation being cut, fluid properties, impactor properties, and/or desired hydraulic energy expenditure at the nozzle 64. If a drill bit 60 is used, the nozzle or nozzles 64 may be located in the drill bit 60.

The nozzle 64 may alternatively be a conventional dual-discharge nozzle. Such dual discharge nozzles may generate: (1) a radially outer circulation fluid jet substantially encircling a jet axis, and/or (2) an axial circulation fluid jet substantially aligned with and coaxial with the jet axis, with the dual discharge nozzle directing a majority by weight of the plurality of solid material impactors into the axial circulation fluid jet. A dual discharge nozzle 64 may separate a first portion of the circulation fluid flowing through the nozzle 64 into a first circulation fluid stream having a first circulation fluid exit nozzle velocity, and a second portion of the circulation fluid flowing through the nozzle 64 into a second circulation fluid stream having a second circulation fluid exit nozzle velocity lower than the first circulation fluid exit nozzle velocity. The plurality of solid material impactors 100 may be directed into the first circulation fluid stream such that a velocity of the plurality of solid material impactors 100 while exiting the nozzle 64 is substantially greater than a velocity of the circulation fluid while passing through a nominal diameter flow path in the lower end 55B of the pipe string 55, to accelerate the solid material impactors 100.

Each of the individual impactors 100 is structurally independent from the other impactors. For brevity, the plurality of solid material impactors 100 may be interchangeably referred to as simply the impactors 100. The plurality of solid material impactors 100 may be substantially rounded and have either a substantially non-uniform outer diameter or a substantially uniform outer diameter. The solid material impactors 100 may be substantially spherically shaped, non-hollow, formed of rigid metallic material, and having high compressive strength and crush resistance, such as steel shot, ceramics, depleted uranium, and multiple component materials. Although the solid material impactors 100 may be substantially a non-hollow sphere, alternative embodiments may provide for other types of solid material impactors, which may include impactors 100 with a hollow interior. The impactors may be substantially rigid and may possess relatively high compressive strength and resistance to crushing or deformation as compared to physical properties or rock properties of a particular formation or group of formations being penetrated by the wellbore 70.

The impactors may be of a substantially uniform mass, grading, or size. The solid material impactors 100 may have any suitable density for use in the excavation system 1. For example, the solid material impactors 100 may have an average density of at least 470 pounds per cubic foot.

Alternatively, the solid material impactors 100 may include other metallic materials, including tungsten carbide, copper, iron, or various combinations or alloys of these and other metallic compounds. The impactors 100 may also be composed of non-metallic materials, such as ceramics, or other man-made or substantially naturally occurring non-metallic materials. Also, the impactors 100 may be crystalline shaped, angular shaped, sub-angular shaped, selectively shaped, such as like a torpedo, dart, rectangular, or otherwise generally non-spherically shaped.

The impactors 100 may be selectively introduced into a fluid circulation system, such as illustrated in FIG. 1, near an excavation rig 5, circulated with the circulation fluid (or "mud"), and accelerated through at least one nozzle 64. "At the excavation rig" or "near an excavation rig" may also include substantially remote separation, such as a separation process that may be at least partially carried out on the sea floor.

Introducing the impactors 100 into the circulation fluid may be accomplished by any of several known techniques. For example, the impactors 100 may be provided in an impactor storage tank 94 near the rig 5 or in a storage bin 82. A screw elevator 14 may then transfer a portion of the impactors at a selected rate from the storage tank 94, into a slurrification tank 98. A pump 10, such as a progressive cavity pump may transfer a selected portion of the circulation fluid from a mud tank 6, into the slurrification tank 98 to be mixed with the impactors 100 in the tank 98 to form an impactor concentrated slurry. An impactor introducer 96 may be included to pump or introduce a plurality of solid material impactors 100 into the circulation fluid before circulating a plurality of impactors 100 and the circulation fluid to the nozzle 64. The impactor introducer 96 may be a progressive cavity pump capable of pumping the impactor concentrated slurry at a selected rate and pressure through a slurry line 88, through a slurry hose 38, through an impactor slurry injector head 34, and through an injector port 30 located on the gooseneck 36, which may be located atop the swivel 28. The swivel 36, including the through bore for conducting circulation fluid therein, may be substantially supported on the feed, or upper, end of the pipe string 55 for conducting circulation fluid from the gooseneck 36 into the latter end 55*a*. The upper end 55A of the pipe string 55 may also include the kelly 50 to connect the pipe 56 with the swivel quill 26 and/or the swivel 28. The circulation fluid may also be provided with Theological properties sufficient to adequately transport and/or suspend the plurality of solid material impactors 100 within the circulation fluid.

The solid material impactors 100 may also be introduced into the circulation fluid by withdrawing the plurality of solid material impactors 100 from a low pressure impactor source 98 into a high velocity stream of circulation fluid, such as by venturi effect. For example, when introducing impactors 100 into the circulation fluid, the rate of circulation fluid pumped by the mud pump 2 may be reduced to a rate lower than the mud pump 2 is capable of efficiently pumping. In such event, a lower volume mud pump 4 may pump the circulation fluid through a medium pressure capacity line 24 and through the medium pressure capacity flexible hose 40.

The circulation fluid may be circulated from the fluid pump 2 and/or 4, such as a positive displacement type fluid pump, through one or more fluid conduits 8, 24, 40, 42, into the pipe string 55. The circulation fluid may then be circulated through the pipe string 55 and through the nozzle 64. The circulation fluid may be pumped at a selected circulation rate and/or a selected pump pressure to achieve a desired impactor and/or fluid energy at the nozzle 64.

The pump 4 may also serve as a supply pump to drive the introduction of the impactors 100 entrained within an impactor slurry, into the high pressure circulation fluid stream pumped by mud pumps 2 and 4. Pump 4 may pump a percentage of the total rate of fluid being pumped by both pumps 2 and 4, such that the circulation fluid pumped by pump 4 may create a venturi effect and/or vortex within the injector head 34 that inducts the impactor slurry being conducted through the line 42, through the injector head 34, and then into the high pressure circulation fluid stream.

From the swivel 28, the slurry of circulation fluid and impactors may circulate through the interior passage in the pipe string 55 and through the nozzle 64. As described above, the nozzle 64 may alternatively be at least partially located in the drill bit 60. Each nozzle 64 may include a reduced inner diameter as compared to an inner diameter of the interior passage in the pipe string 55 immediately above the nozzle 64. Thereby, each nozzle 64 may accelerate the velocity of the slurry as the slurry passes through the nozzle 64. The nozzle 64 may also direct the slurry into engagement with a selected portion of the bottom surface 66 of wellbore 70. The nozzle 64 may also be rotated relative to the formation 52 depending on the excavation parameters. To rotate the nozzle 64, the entire pipe string 55 may be rotated or only the nozzle 64 on the end of the pipe string 55 may be rotated while the pipe string 55 is not rotated. Rotating the nozzle 64 may also include oscillating the nozzle 64 rotationally back and forth as well as vertically, and may further include rotating the nozzle 64 in discrete increments. The nozzle 64 may also be maintained rotationally substantially stationary.

The circulation fluid may be substantially continuously circulated during excavation operations to circulate at least some of the plurality of solid material impactors 100 and the formation cuttings away from the nozzle 64. The impactors 100 and fluid circulated away from the nozzle 64 may be circulated substantially back to the excavation rig 5, or circulated to a substantially intermediate position between the excavation rig 5 and the nozzle 64.

If the drill bit 60 is used, the drill bit 60 may be rotated relative to the formation 52 and engaged therewith by an axial force (WOB) acting at least partially along the wellbore axis 75 near the drill bit 60. The bit 60 may also comprise a plurality of bit cones 62, which also may rotate relative to the bit 60 to cause bit teeth secured to a respective cone to engage the formation 52, which may generate formation cuttings substantially by crushing, cutting, or pulverizing a portion of the formation 52. The bit 60 may also be comprised of a fixed cutting structure that may be substantially continuously engaged with the formation 52 and create cuttings primarily by shearing and/or axial force concentration to fail the formation, or create cuttings from the formation 52. To rotate the bit 60, the entire pipe string 55 may be rotated or only the bit 60 on the end of the pipe string 55 may be rotated while the pipe string 55 is not rotated. Rotating the drill bit 60 may also include oscillating the drill bit 60 rotationally back and forth as well as vertically, and may further include rotating the drill bit 60 in discrete increments.

Also alternatively, the excavation system 1 may comprise a pump, such as a centrifugal pump, having a resilient lining that is compatible for pumping a solid-material laden slurry. The pump may pressurize the slurry to a pressure greater than the selected mud pump pressure to pump the plurality of solid material impactors 100 into the circulation fluid. The impactors 100 may be introduced through an impactor injection port, such as port 30. Other alternative embodiments for the system 1 may include an impactor injector for introducing the plurality of solid material impactors 100 into the circulation fluid.

As the slurry is pumped through the pipe string 55 and out the nozzles 64, the impactors 100 may engage the formation with sufficient energy to enhance the rate of formation removal or penetration (ROP). The removed portions of the formation may be circulated from within the wellbore 70 near the nozzle 64, and carried suspended in the fluid with at least a portion of the impactors 100, through a wellbore annulus between the OD of the pipe string 55 and the ID of the wellbore 70.

At the excavation rig 5, the returning slurry of circulation fluid, formation fluids (if any), cuttings, and impactors 100 may be diverted at a nipple 76, which may be positioned on a BOP stack 74. The returning slurry may flow from the nipple 76, into a return flow line 15, which maybe comprised of tubes 48, 45, 16, 12 and flanges 46, 47. The return line 15 may include an impactor reclamation tube assembly 44, as illustrated in FIG. 1, which may preliminarily separate a majority of the returning impactors 100 from the remaining components of the returning slurry to salvage the circulation fluid for recirculation into the present wellbore 70 or another wellbore. At least a portion of the impactors 100 may be separated from a portion of the cuttings by a series of screening devices, such as the vibrating classifiers 84, to salvage a reusable portion of the impactors 100 for reuse to re-engage the formation 52. A majority of the cuttings and a majority of non-reusable impactors 100 may also be discarded.

The reclamation tube assembly 44 may operate by rotating tube 45 relative to tube 16. An electric motor assembly 22 may rotate tube 44. The reclamation tube assembly 44 comprises an enlarged tubular 45 section to reduce the return flow slurry velocity and allow the slurry to drop below a terminal velocity of the impactors 100, such that the impactors 100 can no longer be suspended in the circulation fluid and may gravitate to a bottom portion of the tube 45. This separation function may be enhanced by placement of magnets near and along a lower side of the tube 45. The impactors 100 and some of the larger or heavier cuttings may be discharged through discharge port 20. The separated and discharged impactors 100 and solids discharged through discharge port 20 may be gravitationally diverted into a vibrating classifier 84 or may be pumped into the classifier 84. A pump (not shown) capable of handling impactors and solids, such as a progressive cavity pump may be situated in communication with the flow line discharge port 20 to conduct the separated impactors 100 selectively into the vibrating separator 84 or elsewhere in the circulation fluid circulation system.

The vibrating classifier 84 may comprise a three-screen section classifier of which screen section 18 may remove the coarsest grade material. The removed coarsest grade material may be selectively directed by outlet 78 to one of storage bin 82 or pumped back into the flow line 15 downstream of discharge port 20. A second screen section 92 may remove a re-usable grade of impactors 100, which in turn may be directed by outlet 90 to the impactor storage tank 94. A third screen section 86 may remove the finest grade material from the circulation fluid. The removed finest grade material may be selectively directed by outlet 80 to storage bin 82, or pumped back into the flow line 15 at a point downstream of discharge port 20. Circulation fluid collected in a lower portion of the classified 84 may be returned to a mud tank 6 for re-use.

The circulation fluid may be recovered for recirculation in a wellbore or the circulation fluid may be a fluid that is substantially not recovered. The circulation fluid may be a liquid, gas, foam, mist, or other substantially continuous or multiphase fluid. For recovery, the circulation fluid and other components entrained within the circulation fluid may be directed across a shale shaker (not shown) or into a mud tank 6, whereby the circulation fluid may be further processed for re-circulation into a wellbore.

The excavation system 1 creates a mass-velocity relationship in a plurality of the solid material impactors 100, such that an impactor 100 may have sufficient energy to structurally alter the formation 52 in a zone of a point of impact. The mass-velocity relationship may be satisfied as sufficient when a substantial portion by weight of the solid material impactors 100 may by virtue of their mass and velocity at the exit of the nozzle 64, create a structural alteration as claimed or disclosed herein. Impactor velocity to achieve a desired effect upon a given formation may vary as a function of formation compressive strength, hardness, or other rock properties, and as a function of impactor size and circulation fluid rheological properties. A substantial portion means at least five percent by weight of the plurality of solid material impactors that are introduced into the circulation fluid.

The impactors 100 for a given velocity and mass of a substantial portion by weight of the impactors 100 are subject to the following mass-velocity relationship. The resulting kinetic energy of at least one impactor 100 exiting a nozzle 64 is at least 0.075 Ft.Lbs or has a minimum momentum of 0.0003 Lbf.Sec.

Kinetic energy is quantified by the relationship of an object's mass and its velocity. The quantity of kinetic energy associated with an object is calculated by multiplying its mass times its velocity squared. To reach a minimum value of kinetic energy in the mass-velocity relationship as defined, small particles such as those found in abrasives and grits, must have a significantly high velocity due to the small mass of the particle. A large particle, however, needs only moderate velocity to reach an equivalent kinetic energy of the small particle because its mass may be several orders of magnitude larger.

The velocity of a substantial portion by weight of the plurality of solid material impactors 100 immediately exiting a nozzle 64 may be as slow as 100 feet per second and as fast as 1000 feet per second, immediately upon exiting the nozzle 64.

The velocity of a majority by weight of the impactors 100 may be substantially the same, or only slightly reduced, at the point of impact of an impactor 100 at the formation surface 66 as compared to when leaving the nozzle 64. Thus, it may be appreciated by those skilled in the art that due to the close proximity of a nozzle 64 to the formation being impacted, the velocity of a majority of impactors 100 exiting a nozzle 64 may be substantially the same as a velocity of an impactor 100 at a point of impact with the formation 52. Therefore, in many practical applications, the above velocity values may be determined or measured at substantially any point along the path between near an exit end of a nozzle 64 and the point of impact, without material deviation from the scope of this disclosure.

In addition to the impactors 100 satisfying the mass-velocity relationship described above, a substantial portion by weight of the solid material impactors 100 have an average mean diameter of between approximately 0.050 to 0.500 of an inch.

To excavate a formation 52, the excavation implement, such as a drill bit 60 or impactor 100, must overcome minimum, in-situ stress levels or toughness of the formation 52. These minimum stress levels are known to typically range from a few thousand pounds per square inch, to in excess of 65,000 pounds per square inch. To fracture, cut, or plastically deform a portion of formation 52, force exerted on that portion of the formation 52 typically should exceed the minimum, in-situ stress threshold of the formation 52. When an impactor 100 first initiates contact with a formation, the unit stress exerted upon the initial contact point may be much higher than 10,000 pounds per square inch, and may be well in excess of one million pounds per square inch. The stress applied to the formation 52 during contact is governed by the force the impactor 100 contacts the formation with and the area of contact of the impactor with the formation. The stress is the force divided by the area of contact. The force is governed by Impulse Momentum theory whereby the time at which the contact occurs determines the magnitude of the force applied to the area of contact. In cases where the particle is contacting a relatively hard surface at an elevated velocity, the force of the particle when in contact with the surface is not constant, but is better described as a spike. However, the force need not be limited to any specific amplitude or duration. The magnitude of the spike load can be very large and occur in just a small fraction of the total impact time. If the area of contact is small the unit stress can reach values many times in excess of the in situ failure stress of the rock, thus guaranteeing fracture initiation and propagation and structurally altering the formation 52.

A substantial portion by weight of the solid material impactors 100 may apply at least 5000 pounds per square inch of unit stress to a formation 52 to create the structurally altered zone Z in the formation. The structurally altered zone Z is not limited to any specific shape or size, including depth or width. Further, a substantial portion by weight of the impactors 100 may apply in excess of 20,000 pounds per square inch of unit stress to the formation 52 to create the structurally altered zone Z in the formation. The mass-velocity relationship of a substantial portion by weight of the plurality of solid material impactors 100 may also provide at least 30,000 pounds per square inch of unit stress.

A substantial portion by weight of the solid material impactors 100 may have any appropriate velocity to satisfy the mass-velocity relationship. For example, a substantial portion by weight of the solid material impactors may have a velocity of at least 100 feet per second when exiting the nozzle 64. A substantial portion by weight of the solid material impactors 100 may also have a velocity of at least 100 feet per second and as great as 1200 feet per second when exiting the nozzle 64. A substantial portion by weight of the solid material impactors 100 may also have a velocity of at least 100 feet per second and as great as 750 feet per second when exiting the nozzle 64. A substantial portion by weight of the solid material impactors 100 may also have a velocity of at least 350 feet per second and as great as 500 feet per second when exiting the nozzle 64.

Impactors 100 may be selected based upon physical factors such as size, projected velocity, impactor strength, formation 52 properties and desired impactor concentration in the circulation fluid. Such factors may also include; (a) an expenditure of a selected range of hydraulic horsepower across the one or more nozzles, (b) a selected range of circulation fluid velocities exiting the one or more nozzles or impacting the formation, and (c) a selected range of solid material impactor velocities exiting the one or more nozzles or impacting the formation, (d) one or more rock properties of the formation being excavated, or (e), any combination thereof.

If an impactor 100 is of a specific shape such as that of a dart, a tapered conic, a rhombic, an octahedral, or similar oblong shape, a reduced impact area to impactor mass ratio may be achieved. The shape of a substantial portion by weight of the impactors 100 may be altered, so long as the mass-velocity relationship remains sufficient to create a claimed structural alteration in the formation and an impactor 100 does not have any one length or diameter dimension greater than approximately 0.100 inches. Thereby, a velocity required to achieve a specific structural alteration may be reduced as compared to achieving a similar structural alteration by impactor shapes having a higher impact area to mass ratio. Shaped impactors 100 may be formed to substantially align themselves along a flow path, which may reduce variations in the angle of incidence between the impactor 100 and the formation 52. Such impactor shapes may also reduce impactor contact with the flow structures such those in the pipe string 55 and the excavation rig 5 and may thereby minimize abrasive erosion of flow conduits.

Referring to FIGS. 1-4, a substantial portion by weight of the impactors 100 may engage the formation 52 with sufficient energy to enhance creation of a wellbore 70 through the formation 52 by any or a combination of different impact mechanisms. First, an impactor 100 may directly remove a larger portion of the formation 52 than may be removed by abrasive-type particles. In another mechanism, an impactor 100 may penetrate into the formation 52 without removing formation material from the formation 52. A plurality of such formation penetrations, such as near and along an outer perimeter of the wellbore 70 may relieve a portion of the stresses on a portion of formation being excavated, which may thereby enhance the excavation action of other impactors 100 or the drill bit 60. Third, an impactor 100 may alter one or more physical properties of the formation 52. Such physical alterations may include creation of micro-fractures and increased brittleness in a portion of the formation 52, which may thereby enhance effectiveness the impactors 100 in excavating the formation 52. The constant scouring of the bottom of the borehole also prevents the build up of dynamic filter-cake, which can significantly increase the apparent toughness of the formation 52.

FIG. 2 illustrates an impactor 100 that has been impaled into a formation 52, such as a lower surface 66 in a wellbore 70. For illustration purposes, the surface 66 is illustrated as substantially planar and transverse to the direction of impactor travel 100*a*. The impactors 100 circulated through a nozzle 64 may engage the formation 52 with sufficient energy to effect one or more properties of the formation 52.

A portion of the formation 52 ahead of the impactor 100 substantially in the direction of impactor travel T may be altered such as by micro-fracturing and/or thermal alteration due to the impact energy. In such occurrence, the structurally altered zone Z may include an altered zone depth D. An example of a structurally altered zone Z is a compressive zone Z1, which may be a zone in the formation 52 compressed by the impactor 100. The compressive zone Z1 may have a length L1, but is not limited to any specific shape or size. The compressive zone Z1 may be thermally altered due to impact energy.

An additional example of a structurally altered zone 102 near a point of impaction may be a zone of micro-fractures Z2. The structurally altered zone Z may be broken or otherwise altered due to the impactor 100 and/or a drill bit 60, such as by crushing, fracturing, or micro-fracturing.

FIG. 2 also illustrates an impactor 100 implanted into a formation 52 and having created an excavation E wherein material has been ejected from or crushed beneath the impactor 100. Thereby the excavation E may be created, which as illustrated in FIG. 3 may generally conform to the shape of the impactor 100.

Figure 3:
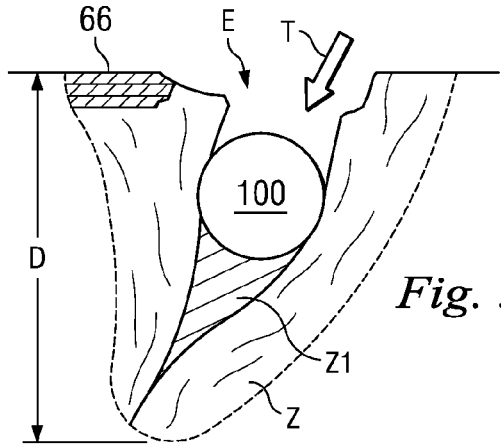
FIG. 3 illustrates an impactor embedded into the formation at an angle to a normalized surface plane of the target formation.
Figure 4:
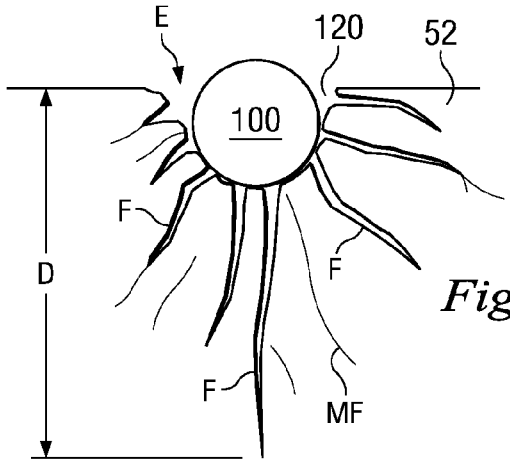
FIG. 4 illustrates an impactor impacting a formation with a plurality of fractures induced by the impact.

FIGS. 3 and 4 illustrate excavations E where the size of the excavation may be larger than the size of the impactor 100. In FIG. 2, the impactor 100 is shown as impacted into the formation 52 yielding an excavation depth D.

An additional theory for impaction mechanics in cutting a formation 52 may postulate that certain formations 52 may be highly fractured or broken up by impactor energy. FIG. 4 illustrates an interaction between an impactor 100 and a formation 52. A plurality of fractures F and micro-fractures MF may be created in the formation 52 by impact energy.

An impactor 100 may penetrate a small distance into the formation 52 and cause the displaced or structurally altered formation 52 to "splay out" or be reduced to small enough particles for the particles to be removed or washed away by hydraulic action. Hydraulic particle removal may depend at least partially upon available hydraulic horsepower and at least partially upon particle wet-ability and viscosity. Such formation deformation may be a basis for fatigue failure of a portion of the formation by "impactor contact," as the plurality of solid material impactors 100 may displace formation material back and forth.

Each nozzle 64 may be selected to provide a desired circulation fluid circulation rate, hydraulic horsepower substantially at the nozzle 64, and/or impactor energy or velocity when exiting the nozzle 64. Each nozzle 64 may be selected as a function of at least one of (a) an expenditure of a selected range of hydraulic horsepower across the one or more nozzles 64, (b) a selected range of circulation fluid velocities exiting the one or more nozzles 64, and (c) a selected range of solid material impactor 100 velocities exiting the one or more nozzles 64.

To optimize ROP, it may be desirable to determine, such as by monitoring, observing, calculating, knowing, or assuming one or more excavation parameters such that adjustments may be made in one or more controllable variables as a function of the determined or monitored excavation parameter. The one or more excavation parameters may be selected from a group comprising: (a) a rate of penetration into the formation 52, (b) a depth of penetration into the formation 52, (c) a formation excavation factor, and (d) the number of solid material impactors 100 introduced into the circulation fluid per unit of time. Monitoring or observing may include monitoring or observing one or more excavation parameters of a group of excavation parameters comprising: (a) rate of nozzle rotation, (b) rate of penetration into the formation 52, (c) depth of penetration into the formation 52, (d) formation excavation factor, (e) axial force applied to the drill bit 60, (f) rotational force applied to the bit 60, (g) the selected circulation rate, (h) the selected pump pressure, and/or (i) wellbore fluid dynamics, including pore pressure.

One or more controllable variables or parameters may be altered, including at least one of (a) rate of impactor 100 introduction into the circulation fluid, (b) impactor 100 size, (c) impactor 100 velocity, (d) drill bit nozzle 64 selection, (e) the selected circulation rate of the circulation fluid, (f) the selected pump pressure, and (g) any of the monitored excavation parameters.

To alter the rate of impactors 100 engaging the formation 52, the rate of impactor 100 introduction into the circulation fluid may be altered. The circulation fluid circulation rate may also be altered independent from the rate of impactor 100 introduction. Thereby, the concentration of impactors 100 in the circulation fluid may be adjusted separate from the fluid circulation rate. Introducing a plurality of solid material impactors 100 into the circulation fluid may be a function of impactor 100 size, circulation fluid rate, nozzle rotational speed, wellbore 70 size, and a selected impactor 100 engagement rate with the formation 52. The impactors 100 may also be introduced into the circulation fluid intermittently during the excavation operation. The rate of impactor 100 introduction relative to the rate of circulation fluid circulation may also be adjusted or interrupted as desired.

The plurality of solid material impactors 100 may be introduced into the circulation fluid at a selected introduction rate and/or concentration to circulate the plurality of solid material impactors 100 with the circulation fluid through the nozzle 64. The selected circulation rate and/or pump pressure, and nozzle selection may be sufficient to expend a desired portion of energy or hydraulic horsepower in each of the circulation fluid and the impactors 100.

An example of an operative excavation system 1 may comprise a bit 60 with an 8½ inch bit diameter. The solid material impactors 100 may be introduced into the circulation fluid at a rate of 12 gallons per minute. The circulation fluid containing the solid material impactors may be circulated through the bit 60 at a rate of 462 gallons per minute. A substantial portion by weight of the solid material impactors may have an average mean diameter of 0.100". The following parameters will result in approximately a 27 feet per hour penetration rate into Sierra White Granite. In this example, the excavation system may produce 1413 solid material impactors 100 per cubic inch with approximately 3.9 million impacts per minute against the formation 52. On average, 0.00007822 cubic inches of the formation 52 are removed per impactor 100 impact. The resulting exit velocity of a substantial portion of the impactors 100 from each of the nozzles 64 would average 495.5 feet per second. The kinetic energy of a substantial portion by weight of the solid material impacts 100 would be approximately 1.14 Ft Lbs., thus satisfying the mass-velocity relationship described above.

Another example of an operative excavation system 1 may comprise a bit 60 with an 8½" bit diameter. The solid material impactors 100 may be introduced into the circulation fluid at a rate of 12 gallons per minute. The circulation fluid containing the solid material impactors may be circulated through the nozzle 64 at a rate of 462 gallons per minute. A substantial portion by weight of the solid material impactors may have an average mean diameter of 0.075". The following parameters will result in approximately a 35 feet per hour penetration rate into Sierra White Granite. In this example, the excavation system 1 may produce 3350 solid material impactors 100 per cubic inch with approximately 9.3 million impacts per minute against the formation 52. On average, 0.0000428 cubic inches of the formation 52 are removed per impactor 100 impact. The resulting exit velocity of a substantial portion of the impactors 100 from each of the nozzles 64 would average 495.5 feet per second. The kinetic energy of a substantial portion by weight of the solid material impacts 100 would be approximately 0.240 Ft Lbs., thus satisfying the mass-velocity relationship described above.

In addition to impacting the formation with the impactors 100, the bit 60 may be rotated while circulating the circulation fluid and engaging the plurality of solid material impactors 100 substantially continuously or selectively intermittently. The nozzle 64 may also be oriented to cause the solid material impactors 100 to engage the formation 52 with a radially outer portion of the bottom hole surface 66. Thereby, as the drill bit 60 is rotated, the impactors 100, in the bottom hole surface 66 ahead of the bit 60, may create one or more circumferential kerfs. The drill bit 60 may thereby generate formation cuttings more efficiently due to reduced stress in the surface 66 being excavated, due to the one or more substantially circumferential kerfs in the surface 66.

The excavation system 1 may also include inputting pulses of energy in the fluid system sufficient to impart a portion of the input energy in an impactor 100. The impactor 100 may thereby engage the formation 52 with sufficient energy to achieve a structurally altered zone Z. Pulsing of the pressure of the circulation fluid in the pipe string 55, near the nozzle 64 also may enhance the ability of the circulation fluid to generate cuttings subsequent to impactor 100 engagement with the formation 52.

Each combination of formation type, bore hole size, bore hole depth, available weight on bit, bit rotational speed, pump rate, hydrostatic balance, circulation fluid rheology, bit type, and tooth/cutter dimensions may create many combinations of optimum impactor presence or concentration, and impactor energy requirements. The methods and systems of this disclosure facilitate adjusting impactor size, mass, introduction rate, circulation fluid rate and/or pump pressure, and other adjustable or controllable variables to determine and maintain an optimum combination of variables. The methods and systems of this disclosure also may be coupled with select bit nozzles, downhole tools, and fluid circulating and processing equipment to effect many variations in which to optimize rate of penetration.

Figure 5:
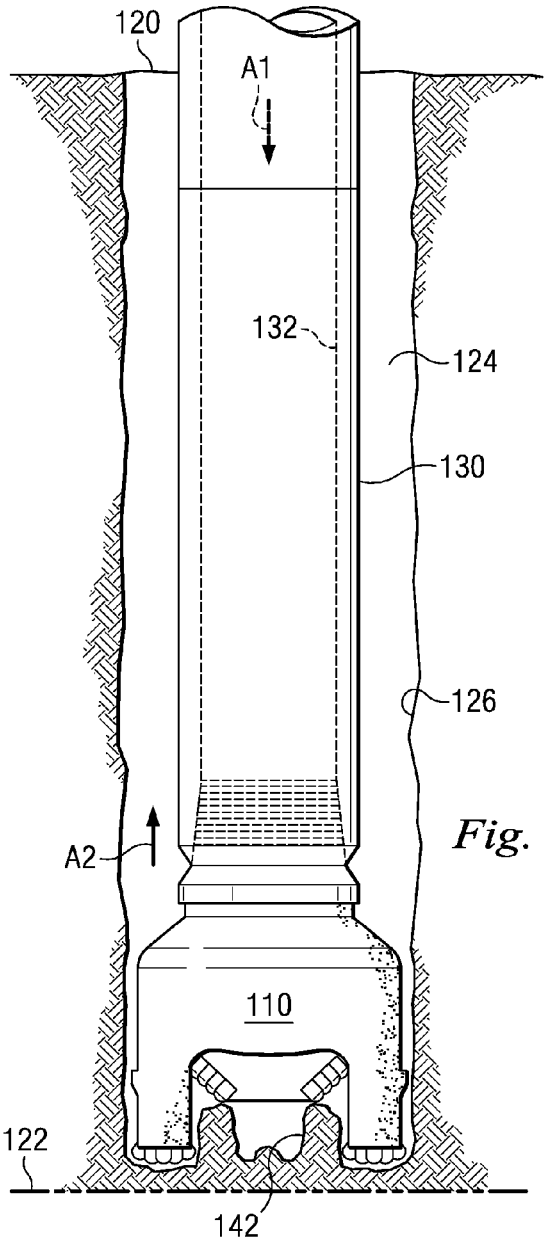
FIG. 5 is an elevational view of a drilling system utilizing a first embodiment of a drill bit.

FIG. 5 shows an alternate embodiment of the drill bit 60 (FIG. 1) and is referred to, in general, by the reference numeral 110 and which is located at the bottom of a well bore 120 and attached to a drill string 130. The drill bit 110 acts upon a bottom surface 122 of the well bore 120. The drill string 130 has a central passage 132 that supplies drilling fluids to the drill bit 110 as shown by the arrow A1. The drill bit 110 uses the drilling fluids and solid material impactors 100 when acting upon the bottom surface 122 of the well bore 120. The drilling fluids then exit the well bore 120 through a well bore annulus 124 between the drill string 130 and the inner wall 126 of the well bore 120. Particles of the bottom surface 122 removed by the drill bit 110 exit the well bore 120 with the drilling fluid through the well bore annulus 124 as shown by the arrow A2. The drill bit 110 creates a rock ring 142 at the bottom surface 122 of the well bore 120.

Figure 6:
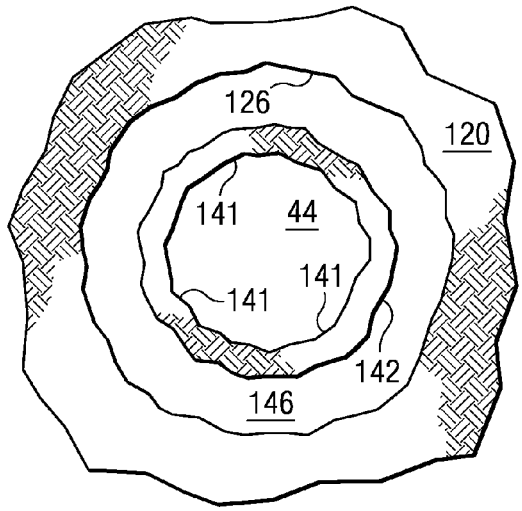
FIG. 6 is a top plan view of the bottom surface of a well bore formed by the drill bit of FIG. 5.

Referring now to FIG. 6, a top view of the rock ring 124 formed by the drill bit 110 is illustrated. An excavated interior cavity 144 is worn away by an interior portion of the drill bit 110 and the exterior cavity 146 and inner wall 126 of the well bore 120 are worn away by an exterior portion of the drill bit 110. The rock ring 142 possesses hoop strength, which holds the rock ring 142 together and resists breakage. The hoop strength of the rock ring 142 is typically much less than the strength of the bottom surface 122 or the inner wall 126 of the well bore 120, thereby making the drilling of the bottom surface 122 less demanding on the drill bit 110. By applying a compressive load and a side load, shown with arrows 141, on the rock ring 142, the drill bit 110 causes the rock ring 142 to fracture. The drilling fluid 140 then washes the residual pieces of the rock ring 142 back up to the surface through the well bore annulus 124.

The mechanical cutters, utilized on many of the surfaces of the drill bit 110, may be any type of protrusion or surface used to abrade the rock formation by contact of the mechanical cutters with the rock formation. The mechanical cutters may be Polycrystalline Diamond Coated (PDC), or any other suitable type mechanical cutter such as tungsten carbide cutters. The mechanical cutters may be formed in a variety of shapes, for example, hemispherically shaped, cone shaped, etc. Several sizes of mechanical cutters are also available, depending on the size of drill bit used and the hardness of the rock formation being cut.

Figure 7:
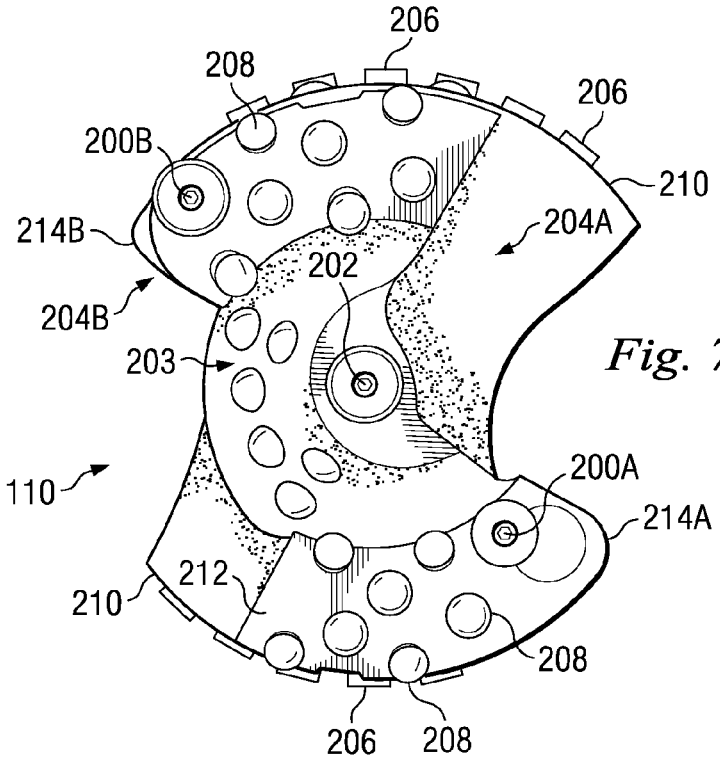
FIG. 7 is an end elevational view of the drill bit of FIG. 5.

Referring now to FIG. 7, an end elevational view of the drill bit 110 of FIG. 5 is illustrated. The drill bit 110 comprises two side nozzles 200A, 200B and a center nozzle 202. The side and center nozzles 200A, 200B, 202 discharge drilling fluid and solid material impactors (not shown) into the rock formation or other surface being excavated. The solid material impactors may comprise steel shot ranging in diameter from about 0.010 to about 0.500 of an inch. However, various diameters and materials such as ceramics, etc. may be utilized in combination with the drill bit 120. The solid material impactors contact the bottom surface 122 of the well bore 120 and are circulated through the annulus 124 to the surface. The solid material impactors may also make up any suitable percentage of the drilling fluid for drilling through a particular formation.

Still referring to FIG. 7 the center nozzle 202 is located in a center portion 203 of the drill bit 110. The center nozzle 202 may be angled to the longitudinal axis of the drill bit 110 to create an excavated interior cavity 244 and also cause the rebounding solid material impactors to flow into the major junk slot, or passage, 204A. The side nozzle 200A located on a side arm 214A of the drill bit 110 may also be oriented to allow the solid material impactors to contact the bottom surface 122 of the well bore 120 and then rebound into the major junk slot, or passage, 204A. The second side nozzle 200B is located on a second side arm 214B. The second side nozzle 200B may be oriented to allow the solid material impactors to contact the bottom surface 122 of the well bore 120 and then rebound into a minor junk slot, or passage, 204B. The orientation of the side nozzles 200A, 200B may be used to facilitate the drilling of the large exterior cavity 46. The side nozzles 200A, 200B may be oriented to cut different portions of the bottom surface 122. For example, the side nozzle 200B may be angled to cut the outer portion of the excavated exterior cavity 146 and the side nozzle 200A may be angled to cut the inner portion of the excavated exterior cavity 146. The major and minor junk slots, or passages, 204A, 204B allow the solid material impactors, cuttings, and drilling fluid 240 to flow up through the well bore annulus 124 back to the surface. The major and minor junk slots, or passages, 204A, 204B are oriented to allow the solid material impactors and cuttings to freely flow from the bottom surface 122 to the annulus 124.

As described earlier, the drill bit 110 may also comprise mechanical cutters and gauge cutters. Various mechanical cutters are shown along the surface of the drill bit 110. Hemispherical PDC cutters are interspersed along the bottom face and the side walls of the drill bit 110. These hemispherical cutters along the bottom face break down the large portions of the rock ring 142 and also abrade the bottom surface 122 of the well bore 120. Another type of mechanical cutter along the side arms 214A, 214B are gauge cutters 230. The gauge cutters 230 form the final diameter of the well bore 120. The gauge cutters 230 trim a small portion of the well bore 120 not removed by other means. Gauge bearing surfaces 206 are interspersed throughout the side walls of the drill bit 110. The gauge bearing surfaces 206 ride in the well bore 120 already trimmed by the gauge cutters 230. The gauge bearing surfaces 206 may also stabilize the drill bit 110 within the well bore 120 and aid in preventing vibration.

Still referring to FIG. 7 the center portion 203 comprises a breaker surface, located near the center nozzle 202, comprising mechanical cutters 208 for loading the rock ring 142. The mechanical cutters 208 abrade and deliver load to the lower stress rock ring 142. The mechanical cutters 208 may comprise PDC cutters, or any other suitable mechanical cutters. The breaker surface is a conical surface that creates the compressive and side loads for fracturing the rock ring 142. The breaker surface and the mechanical cutters 208 apply force against the inner boundary of the rock ring 142 and fracture the rock ring 142. Once fractured, the pieces of the rock ring 142 are circulated to the surface through the major and minor junk slots, or passages, 204A, 204B.

Figure 8:
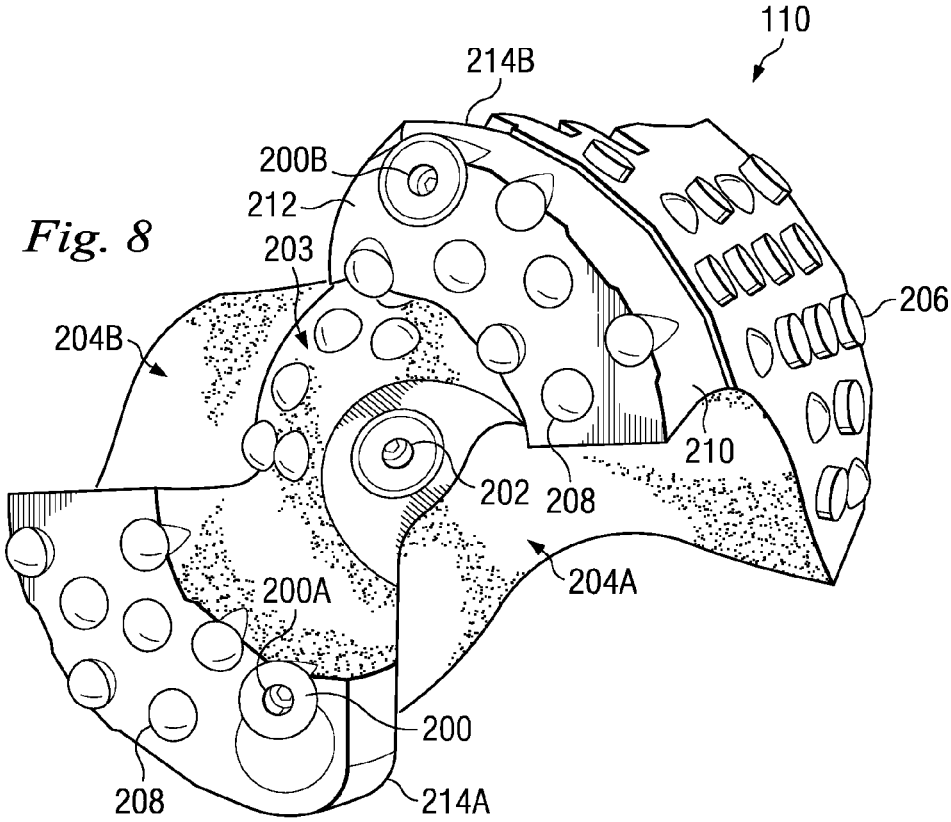
FIG. 8 is an enlarged end elevational view of the drill bit of FIG. 5.

Referring now to FIG. 8, an enlarged end elevational view of the drill bit 110 is shown. As shown more clearly in FIG. 8, the gauge bearing surfaces 206 and mechanical cutters 208 are interspersed on the outer side walls of the drill bit 110. The mechanical cutters 208 along the side walls may also aid in the process of creating drill bit 110 stability and also may perform the function of the gauge bearing surfaces 206 if they fail. The mechanical cutters 208 are oriented in various directions to reduce the wear of the gauge bearing surface 206 and also maintain the correct well bore 120 diameter. As noted with the mechanical cutters 208 of the breaker surface, the solid material impactors fracture the bottom surface 122 of the well bore 120 and, as such, the mechanical cutters 208 remove remaining ridges of rock and assist in the cutting of the bottom hole. However, the drill bit 110 need not necessarily comprise the mechanical cutters 208 on the side wall of the drill bit 110.

Figure 9:
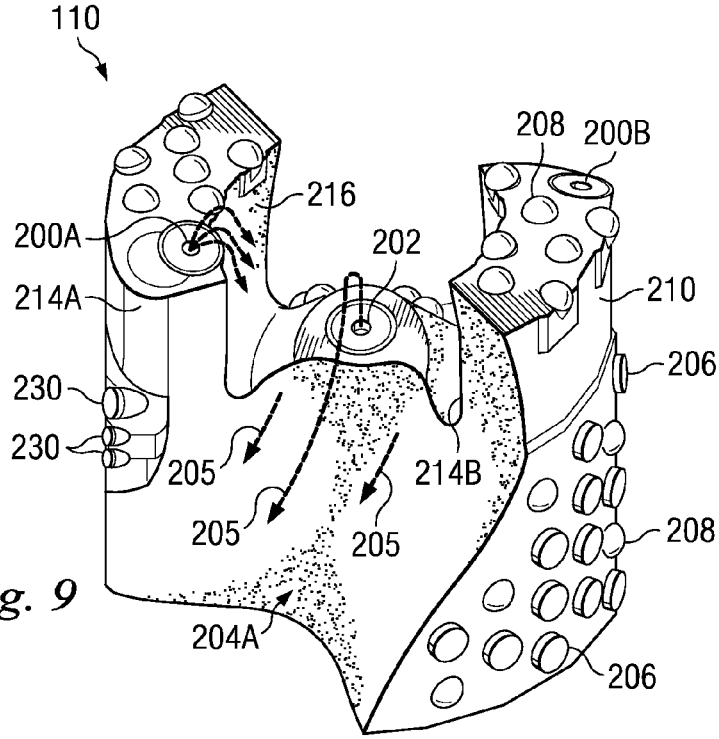
FIG. 9 is a perspective view of the drill bit of FIG. 5.

Referring now to FIG. 9, a side elevational view of the drill bit 110 is illustrated. FIG. 9 shows the gauge cutters 230 included along the side arms 214A, 214B of the drill bit 110. The gauge cutters 230 are oriented so that a cutting face of the gauge cutter 230 contacts the inner wall 126 of the well bore 120. The gauge cutters 230 may contact the inner wall 126 of the well bore at any suitable backrake, for example a backrake of 15° to 45°. Typically, the outer edge of the cutting face scrapes along the inner wall 126 to refine the diameter of the well bore 120.

Still referring to FIG. 9 one side nozzle 200A is disposed on an interior portion of the side arm 214A and the second side nozzle 200B is disposed on an exterior portion of the opposite side arm 214B. Although the side nozzles 200A, 200B are shown located on separate side arms 214A, 214B of the drill bit 110, the side nozzles 200A, 200B may also be disposed on the same side arm 214A or 214B. Also, there may only be one side nozzle, 200A or 200B. Also, there may only be one side arm, 214A or 214B.

Each side arm 214A, 214B fits in the excavated exterior cavity 146 formed by the side nozzles 200A, 200B and the mechanical cutters 208 on the face 212 of each side arm 214A, 214B. The solid material impactors from one side nozzle 200A rebound from the rock formation and combine with the drilling fluid and cuttings flow to the major junk slot 204A and up to the annulus 124. The flow of the solid material impactors, shown by arrows 205, from the center nozzle 202 also rebound from the rock formation up through the major junk slot 204A.

Figure 10:
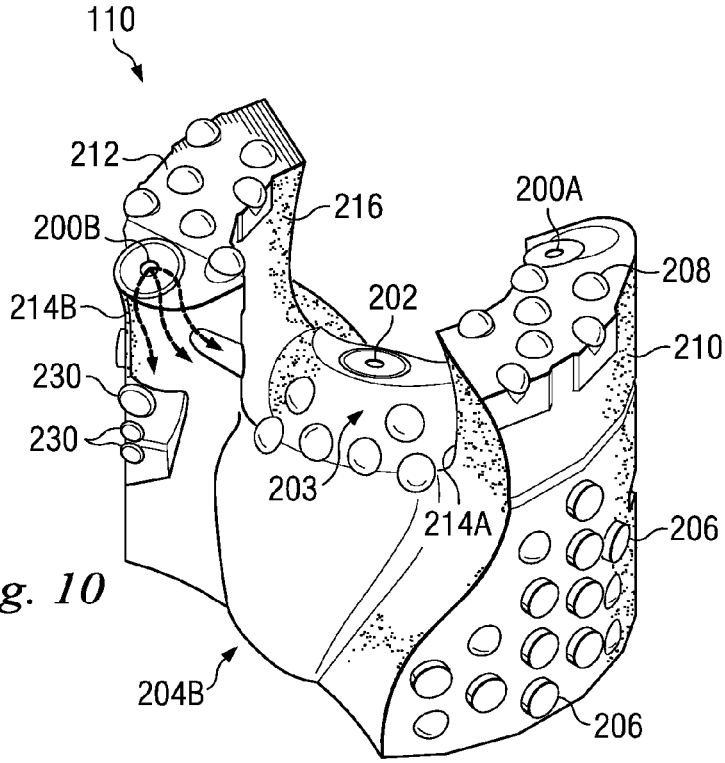
FIG. 10 is a perspective view of the drill bit of FIG. 5 illustrating a breaker and junk slot of a drill bit.
Figure 11:
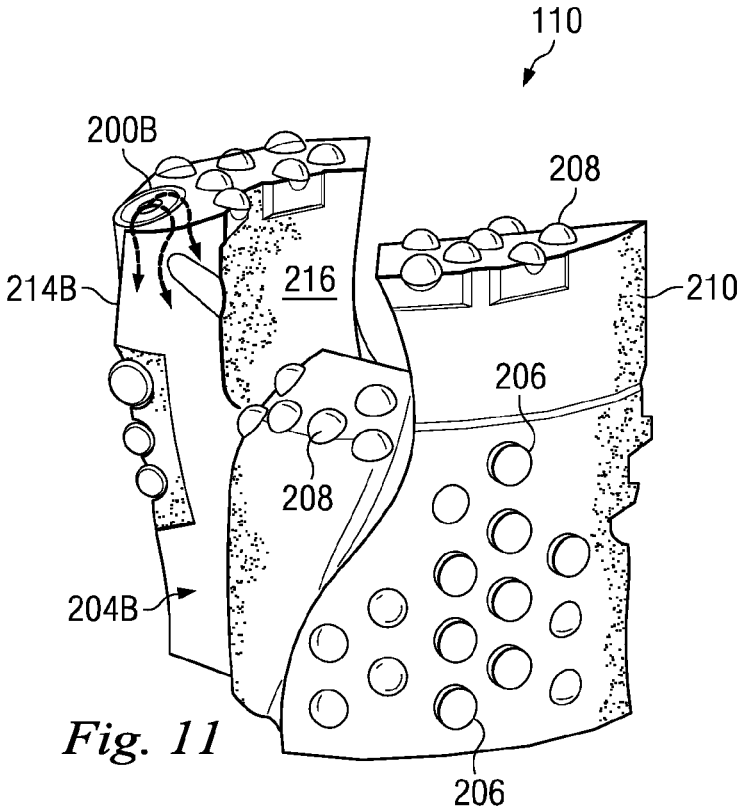
FIG. 11 is a side elevational view of the drill bit of FIG. 5 illustrating a flow of solid material impactors.

Referring now to FIGS. 10 and 11, the minor junk slot 204B, breaker surface, and the second side nozzle 200B are shown in greater detail. The breaker surface is conically shaped, tapering to the center nozzle 202. The second side nozzle 200B is oriented at an angle to allow the outer portion of the excavated exterior cavity 146 to be contacted with solid material impactors. The solid material impactors then rebound up through the minor junk slot 204B, shown by arrows 205, along with any cuttings and drilling fluid 240 associated therewith.

Figure 12:
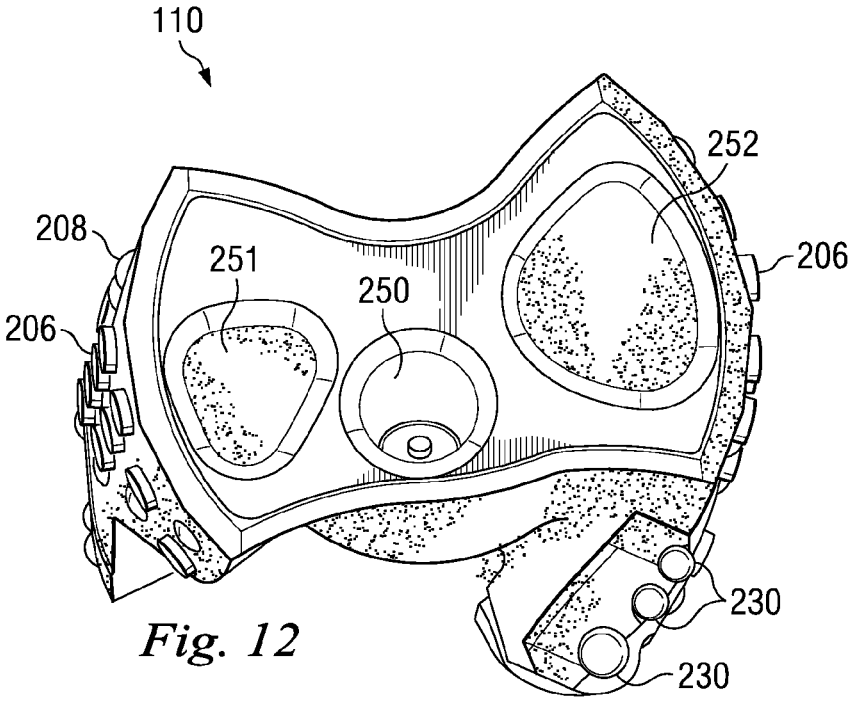
FIG. 12 is a top elevational view of the drill bit of FIG. 5 illustrating side and center cavities.
Figure 13:
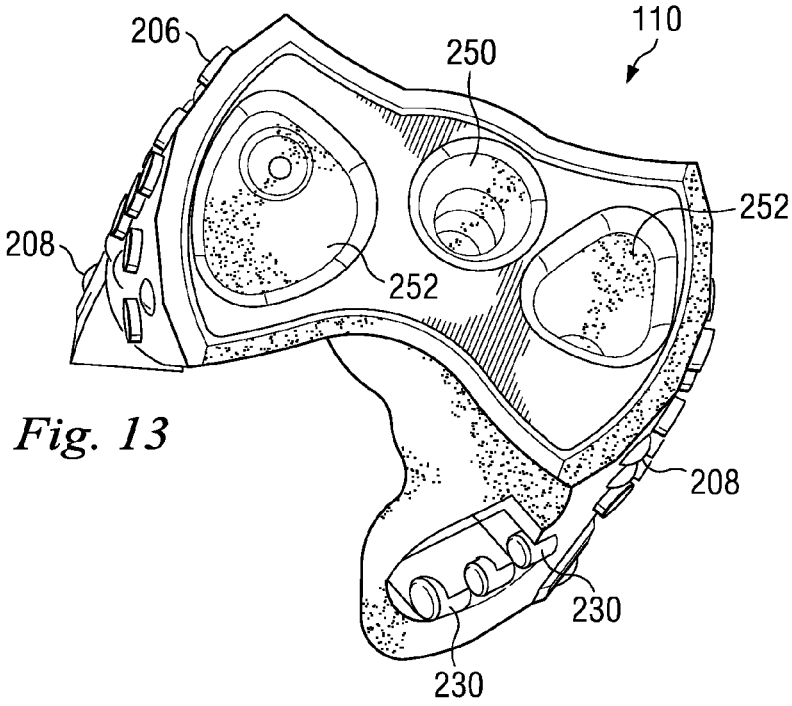
FIG. 13 is a canted top elevational view of the drill bit of FIG. 5.

Referring now to FIGS. 12 and 13, top elevational views of the drill bit 110 are shown. Each nozzle 200A, 200B, 202 receives drilling fluid 240 and solid material impactors from a common plenum feeding separate cavities 250, 251, and 252. Since the common plenum has a diameter, or cross section, greater than the diameter of each cavity 250, 251, and 252, the mixture, or suspension of drilling fluid and impactors is accelerated as it passes from the plenum to each cavity. The center cavity 250 feeds a suspension of drilling fluid 240 and solid material impactors to the center nozzle 202 for contact with the rock formation. The side cavities 251, 252 are formed in the interior of the side arms 214A, 214B of the drill bit 110, respectively. The side cavities 251, 252 provide drilling fluid 240 and solid material impactors to the side nozzles 200A, 200B for contact with the rock formation. By utilizing separate cavities 250, 251, 252 for each nozzle 202, 200A, 200B, the percentages of solid material impactors in the drilling fluid 240 and the hydraulic pressure delivered through the nozzles 200A, 200B, 202 can be specifically tailored for each nozzle 200A, 200B, 202. Solid material impactor distribution can also be adjusted by changing the nozzle diameters of the side and center nozzles 200A, 200B, and 202 by changing the diameters of the nozzles. However, in alternate embodiments, other arrangements of the cavities 250, 251, 252, or the utilization of a single cavity, are possible.

Figure 14:
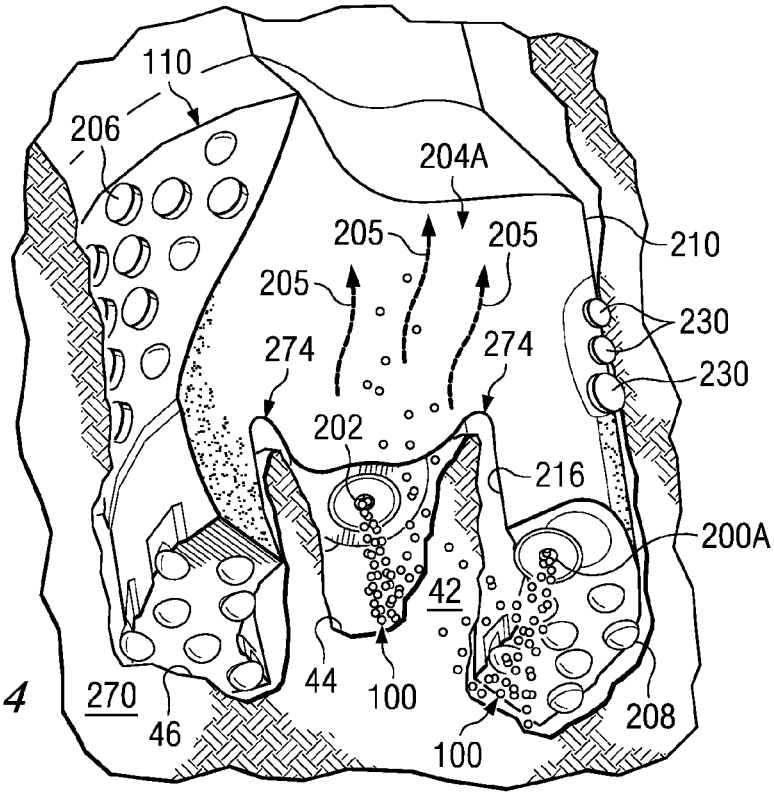
FIG. 14 is a cutaway view of the drill bit of FIG. 5 engaged in a well bore.

Referring now to FIG. 14, the drill bit 110 in engagement with the rock formation 270 is shown. As previously discussed, the solid material impactors 272 flow from the nozzles 200A, 200B, 202 and make contact with the rock formation 270 to create the rock ring 142 between the side arms 214A, 214B of the drill bit 110 and the center nozzle 202 of the drill bit 110. The solid material impactors 272 from the center nozzle 202 create the excavated interior cavity 244 while the side nozzles 200A, 200B create the excavated exterior cavity 146 to form the outer boundary of the rock ring 142. The gauge cutters 230 refine the more crude well bore 120 cut by the solid material impactors 272 into a well bore 120 with a more smooth inner wall 126 of the correct diameter.

Still referring to FIG. 14 the solid material impactors 272 flow from the first side nozzle 200A between the outer surface of the rock ring 142 and the interior wall 216 in order to move up through the major junk slot 204A to the surface. The second side nozzle 200B (not shown) emits solid material impactors 272 that rebound toward the outer surface of the rock ring 142 and to the minor junk slot 204B (not shown). The solid material impactors 272 from the side nozzles 200A, 200B may contact the outer surface of the rock ring 142 causing abrasion to further weaken the stability of the rock ring 142. Recesses 274 around the breaker surface of the drill bit 110 may provide a void to allow the broken portions of the rock ring 142 to flow from the bottom surface 122 of the well bore 120 to the major or minor junk slot 204A, 204B.

Figure 15:
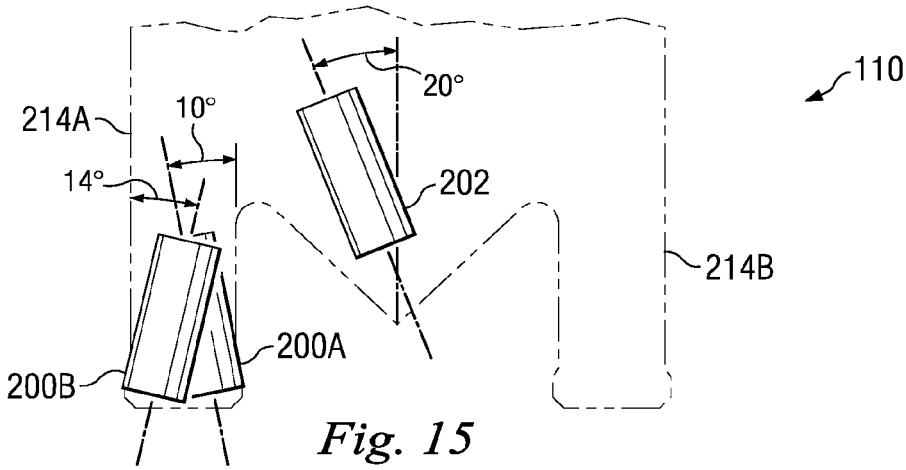
FIG. 15 is a schematic diagram of the orientation of the nozzles of a second embodiment of a drill bit.

Referring now to FIG. 15, an example orientation of the nozzles 200A, 200B, 202 are illustrated. The center nozzle 202 is disposed left of the center line of the drill bit 110 and angled on the order of around 20° left of vertical. Alternatively, both of the side nozzles 200A, 200B may be disposed on the same side arm 214 of the drill bit 110 as shown in FIG. 15. In this embodiment, the first side nozzle 200A, oriented to cut the inner portion of the excavated exterior cavity 146, is angled on the order of around 10° left of vertical. The second side nozzle 200B is oriented at an angle on the order of around 14° right of vertical. This particular orientation of the nozzles allows for a large interior excavated cavity 244 to be created by the center nozzle 202. The side nozzles 200A, 200B create a large enough excavated exterior cavity 146 in order to allow the side arms 214A, 214B to fit in the excavated exterior cavity 146 without incurring a substantial amount of resistance from uncut portions of the rock formation 270. By varying the orientation of the center nozzle 202, the excavated interior cavity 244 may be substantially larger or smaller than the excavated interior cavity 244 illustrated in FIG. 14. The side nozzles 200A, 200B may be varied in orientation in order to create a larger excavated exterior cavity 146, thereby decreasing the size of the rock ring 142 and increasing the amount of mechanical cutting required to drill through the bottom surface 122 of the well bore 120. Alternatively, the side nozzles 200A, 200B may be oriented to decrease the amount of the inner wall 126 contacted by the solid material impactors 272. By orienting the side nozzles 200A, 200B at, for example, a vertical orientation, only a center portion of the excavated exterior cavity 146 would be cut by the solid material impactors and the mechanical cutters would then be required to cut a large portion of the inner wall 126 of the well bore 120.

Figure 16:
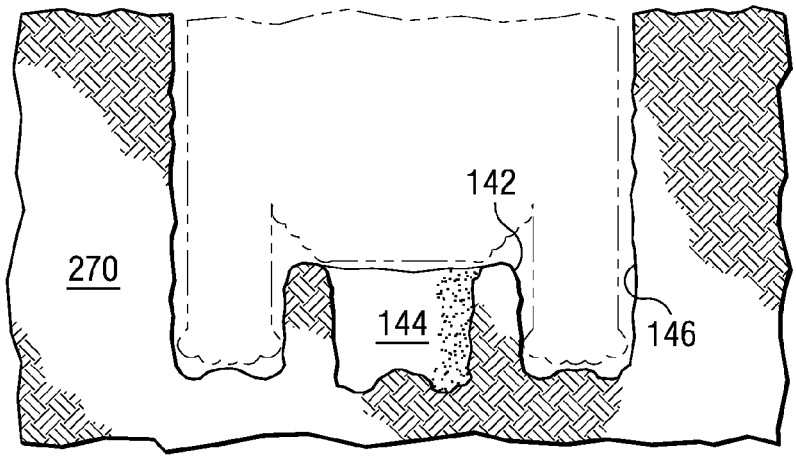
FIG. 16 is a side cross-sectional view of the rock formation created by the drill bit of FIG. 5 represented by the schematic of the drill bit of FIG. 5 inserted therein.
Figure 17:
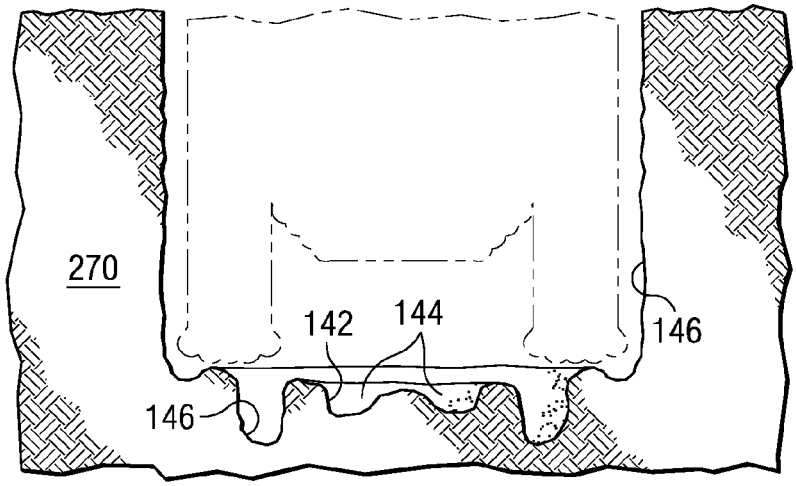
FIG. 17 is a side cross-sectional view of the rock formation created by the drill bit of FIG. 5 represented by the schematic of the drill bit of FIG. 5 inserted therein.

Referring now to FIGS. 16 and 17, side cross-sectional views of the bottom surface 122 of the well bore 120 drilled by the drill bit 110 are shown. With the center nozzle angled on the order of around 20° left of vertical and the side nozzles 200A, 200B angled on the order of around 10° left of vertical and around 14° right of vertical, respectively, the rock ring 142 is formed. By increasing the angle of the side nozzle 200A, 200B orientation, an alternate rock ring 142 shape and bottom surface 122 is cut as shown in FIG. 17. The excavated interior cavity 244 and rock ring 142 are much more shallow as compared with the rock ring 142 in FIG. 16. It is understood that various different bottom hole patterns can be generated by different nozzle configurations.

Although the drill bit 110 is described comprising orientations of nozzles and mechanical cutters, any orientation of either nozzles, mechanical cutters, or both may be utilized. The drill bit 110 need not comprise a center portion 203. The drill bit 110 also need not even create the rock ring 142. For example, the drill bit may only comprise a single nozzle and a single junk slot. Furthermore, although the description of the drill bit 110 describes types and orientations of mechanical cutters, the mechanical cutters may be formed of a variety of substances, and formed in a variety of shapes.

Figure 18:
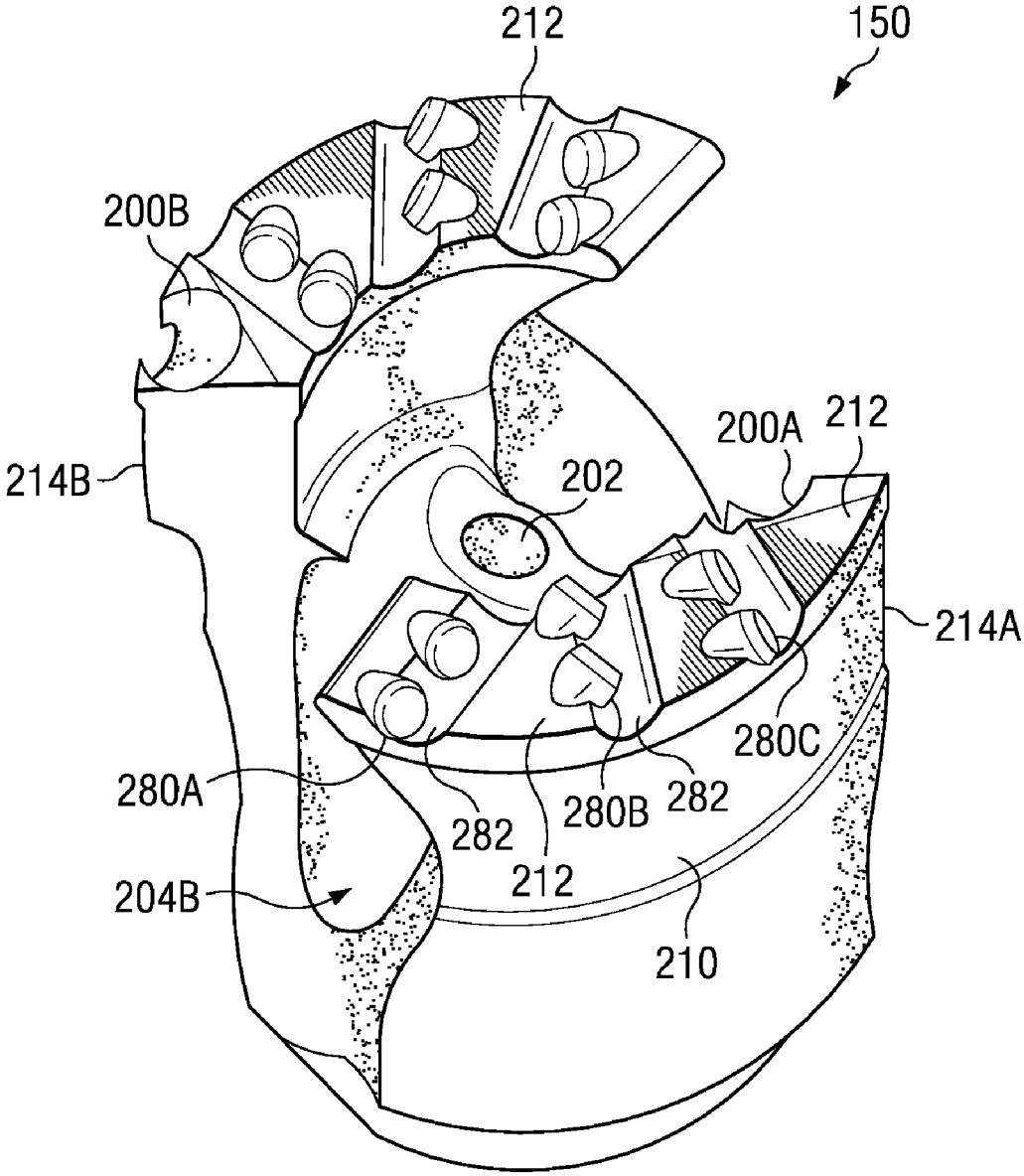
FIG. 18 is a perspective view of an alternate embodiment of a drill bit.
Figure 19:
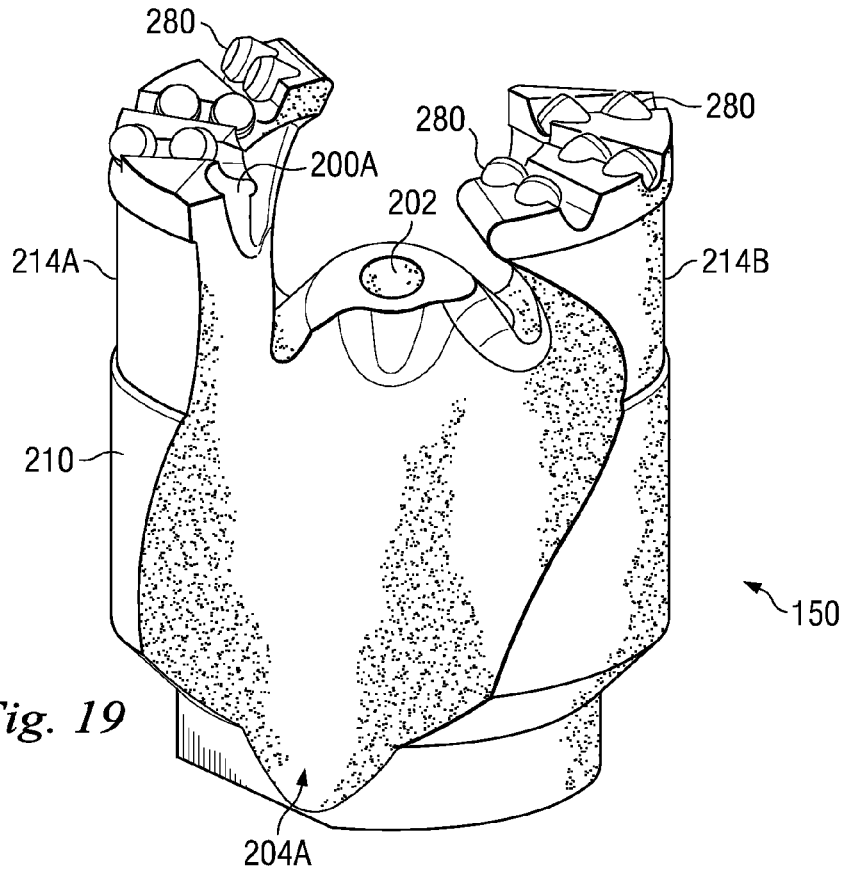
FIG. 19 is a perspective view of the drill bit of FIG. 18.

Referring now to FIGS. 18-19, a drill bit 150 in accordance with a second embodiment is illustrated. As previously noted, the mechanical cutters, such as the gauge cutters 230, mechanical cutters 208, and gauge bearing surfaces 206 may not be necessary in conjunction with the nozzles 200A, 200B, 202 in order to drill the required well bore 120. The side wall of the drill bit 150 may or may not be interspersed with mechanical cutters. The side nozzles 200A, 200B and the center nozzle 202 are oriented in the same manner as in the drill bit 150, however, the face 212 of the side arms 214A, 214B comprises angled (PDCs) 280 as the mechanical cutters.

Figure 20:
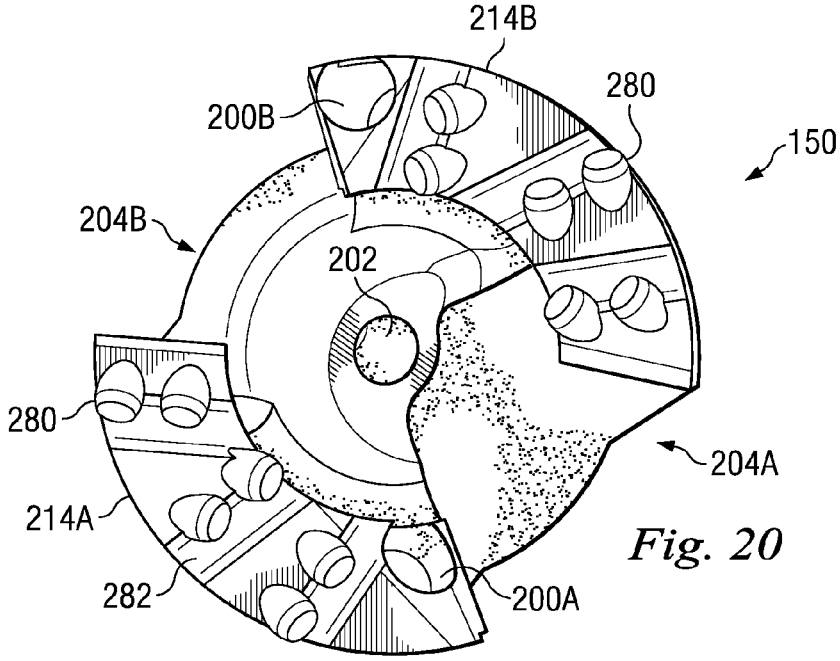
FIG. 20 illustrates an end elevational view of the drill bit of FIG. 18.

Still referring to FIGS. 18-20 each row of PDCs 280 is angled to cut a specific area of the bottom surface 122 of the well bore 120. A first row of PDCs 280A is oriented to cut the bottom surface 122 and also cut the inner wall 126 of the well bore 120 to the proper diameter. A groove 282 is disposed between the cutting faces of the PDCs 280 and the face 212 of the drill bit 150. The grooves 282 receive cuttings, drilling fluid 240, and solid material impactors and direct them toward the center nozzle 202 to flow through the major and minor junk slots, or passages, 204A, 204B toward the surface. The grooves 282 may also direct some cuttings, drilling fluid 240, and solid material impactors toward the inner wall 126 to be received by the annulus 124 and also flow to the surface. Each subsequent row of PDCs 280B, 280C may be oriented in the same or different position than the first row of PDCs 280A. For example, the subsequent rows of PDCs 280B, 280C may be oriented to cut the exterior face of the rock ring 142 as opposed to the inner wall 126 of the well bore 120. The grooves 282 on one side arm 214A may also be oriented to direct the cuttings and drilling fluid 240 toward the center nozzle 202 and to the annulus 124 via the major junk slot 204A. The second side arm 214B may have grooves 282 oriented to direct the cuttings and drilling fluid 240 to the inner wall 126 of the well bore 120 and to the annulus 124 via the minor junk slot 204B.

The PDCs 280 located on the face 212 of each side arm 214A, 214B are sufficient to cut the inner wall 126 to the correct size. However, mechanical cutters may be placed throughout the side wall of the drill bit 150 to further enhance the stabilization and cutting ability of the drill bit 150.

Figure 21:
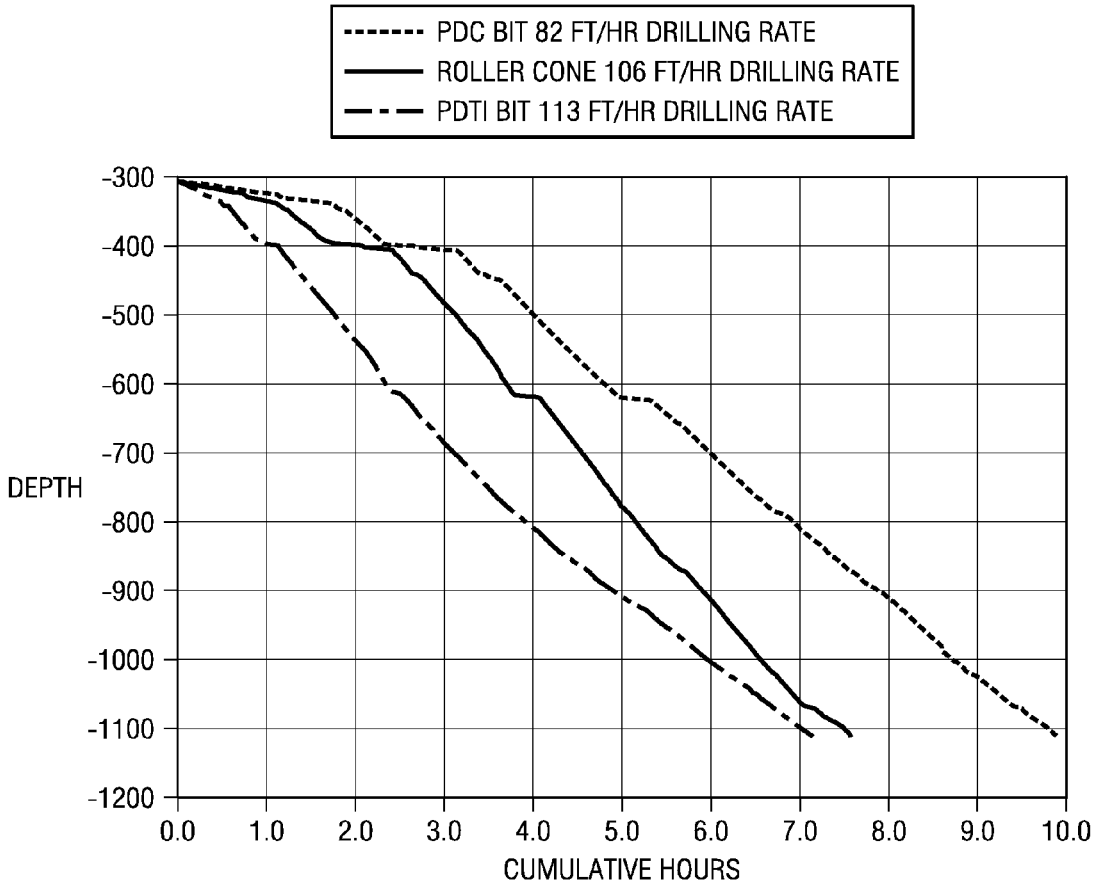
FIG. 21 is a graph depicting the performance of the excavation system according to one or more embodiments of the present disclosure as compared to two other systems.

FIG. 21 depicts a graph showing a comparison of the experimental results of the experimental impact excavation utilizing one or more of the above embodiments (labeled "PDTI in the drawing) as compared to experimental excavations using two strictly mechanical drilling bits—a conventional PDC bit and a "Roller Cone" bit—while drilling through the same stratigraphic intervals. The experimental drilling took place through a formation at the GTI (Gas Technology Institute of Chicago, Ill.) test site at Catoosa, Okla.

The PDC (Polycrystalline Diamond Compact) bit is a relatively fast conventional drilling bit in soft-to-medium formations but has a tendency to break or wear when encountering harder formations. The Roller Cone is a conventional bit involving two or more revolving cones having cutting elements embedded on each of the cones.

The overall graph of FIG. 21 details the experimental performance of the three bits though 800 feet of the formation consisting of shales, sandstones, limestones, and other materials. For example, the upper portion of the curve (approximately 306 to 336 feet) depicts the drilling results in a hard limestone formation that has compressive strengths of up to 40,000 psi.

Note that the PDTI experimental bit performance in this area was significantly better than that of the other two bits—the PDTI bit took only 0.42 hours to drill the 30 feet where the PDC bit took 1 hour and the roller cone took about 1.5 hours. The total time to experimentally drill the approximately 800 foot interval took a little over 7 hours with the PDTI bit, whereas the Roller cone bit took 7.5 hours and the PDC bit took almost 10 hours.

The experimental graph demonstrates that the PDTI system has the ability to not only drill the very hard formations at higher rates, but can drill faster that the conventional bits through a wide variety of rock types.

The experimental table below shows actual experimental drilling data points that make up the experimental PDTI bit drilling curve of FIG. 21. The experimental data points shown are random experimental points taken on various days and times. For example, the first series of experimental data points represents about one minute of drilling data taken at 2:38 pm on Jul. 22, 2005, while the bit was running at 111 RPM, with 5.9 thousand pounds of bit weight ("WOB"), and with a total drill string and bit torque of 1,972 Ft Lbs. The bit was drilling at a total depth of 323.83 feet and its penetration rate for that minute was 136.8 Feet per Hour. The impactors were delivered at approximately 14 GPM (gallons per minute) and the impactors had a mean diameter of approximately 0.100" and were suspended in approximately 450 GPM of drilling mud.

| DATE | TIME | RPM | TORQUE Ft. Lbs. | WOB Lbs. | DEPTH Ft. | PENETRATION FT/MIN | PENETRATION FT/HR |
|---|---|---|---|---|---|---|---|
| Jul. 22, 2005 | 2:38 PM | 111 | 1,972 | 5.9 | 323.83 | 2.28 | 136.8 |
| Jul. 22, 2005 | 4:24 PM | 103 | 2,218 | 9.1 | 352.43 | 2.85 | 171.0 |
| Jul. 25, 2005 | 9:36 AM | 101 | 2,385 | 9.5 | 406.54 | 3.71 | 222.6 |
| Jul. 25, 2005 | 10:17 AM | 99 | 2.658 | 10.9 | 441.88 | 3.37 | 202.2 |

-continued

| DATE | TIME | RPM | TORQUE Ft. Lbs. | WOB Lbs. | DEPTH Ft. | PENETRATION FT/MIN | PENETRATION FT/HR |
|---|---|---|---|---|---|---|---|
| Jul. 25, 2005 | 11:29 AM | 96 | 2.646 | 10.1 | 478.23 | 2.94 | 176.4 |
| Jul. 25, 2005 | 4:41 PM | 97 | 2,768 | 12.2 | 524.44 | 2.31 | 138.6 |
| Jul. 25, 2005 | 4:54 PM | 96 | 2,870 | 10.6 | 556.82 | 3.48 | 208.8 |

During the drilling operation described above, the suspension flow has to be terminated under certain conditions, such as when a new pipe is added to the upper end of the drill string 130 as a result of drilling out the bottom of the wellbore 120, and/or when the pump 2 (FIG. 1) shuts down, etc., in order to prevent the impactors 100 from settling near the bottom of the wellbore and possibly causing damage such as, for example, settling in the passage 132 of the drill string 130 and causing damage to the drill bit 110.

Figure 22:
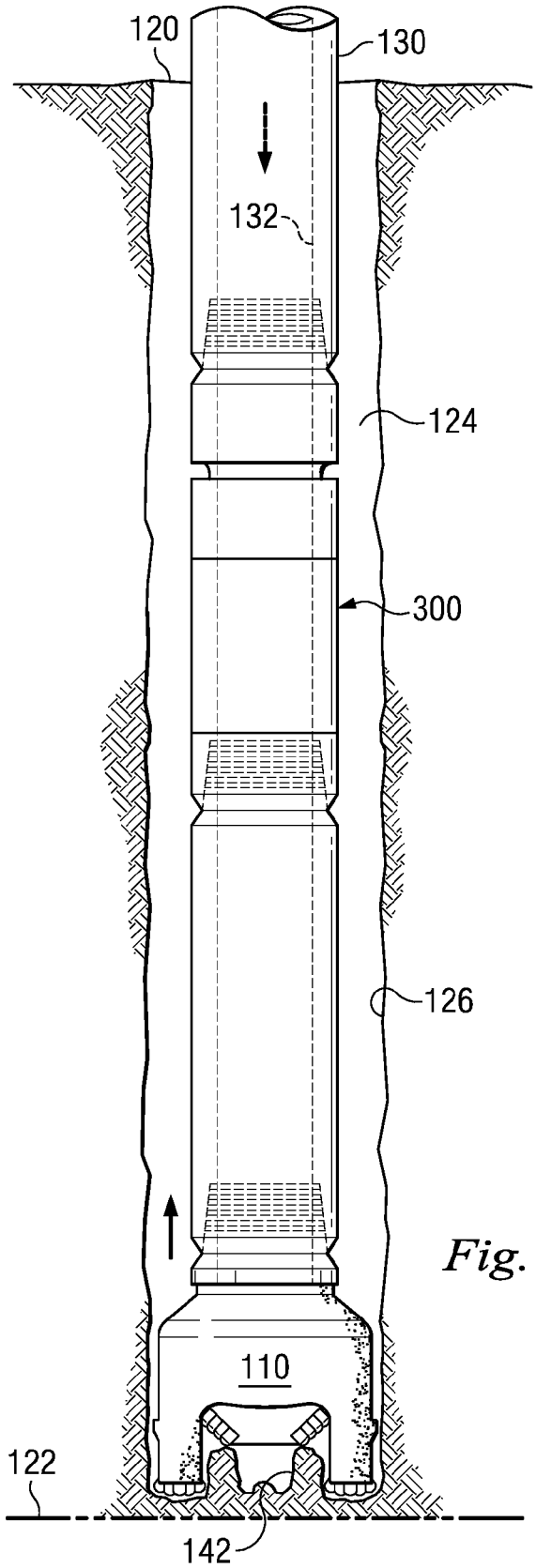
FIG. 22 is an elevational view of the drilling system of FIG. 5, with the addition of a system for controlling the flow of a suspension of impactors and fluid.

In an exemplary embodiment, as illustrated in FIG. 22, to prevent the impactors 100 from flowing downward through the passage 132 and settling therein, and thereby possibly causing damage to the drill bit 110, the arrangement of FIG. 5 has been modified to include a sub 300 that is connected between the drill string 130 and the drill bit 110 for controlling the flow of the suspension of the impactors 100 and the fluid from the drill string 130 to the drill bit 110.

Figure 23A:
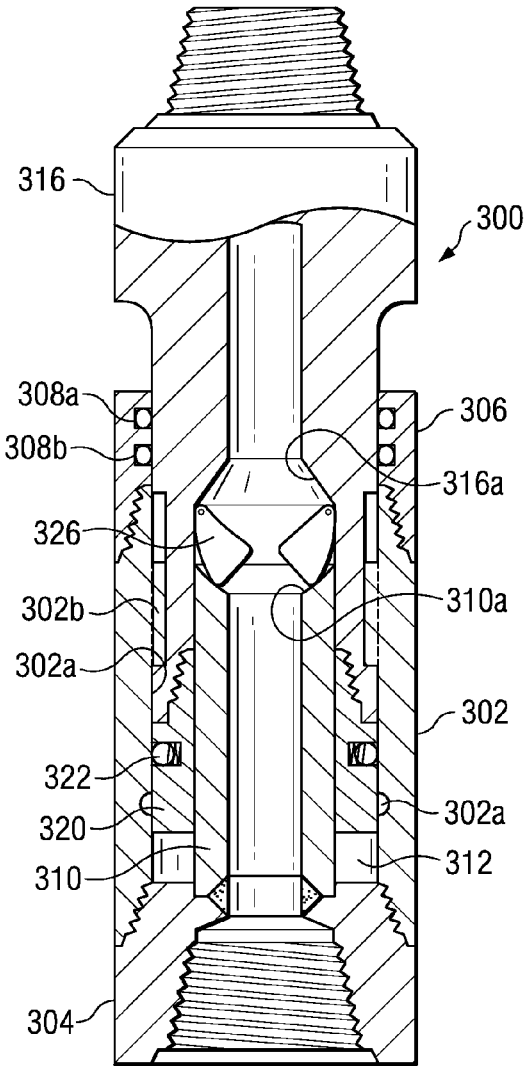
FIGS. 23A and 23B are sectional views of a sub for controlling the particle flow.
Figure 23B:
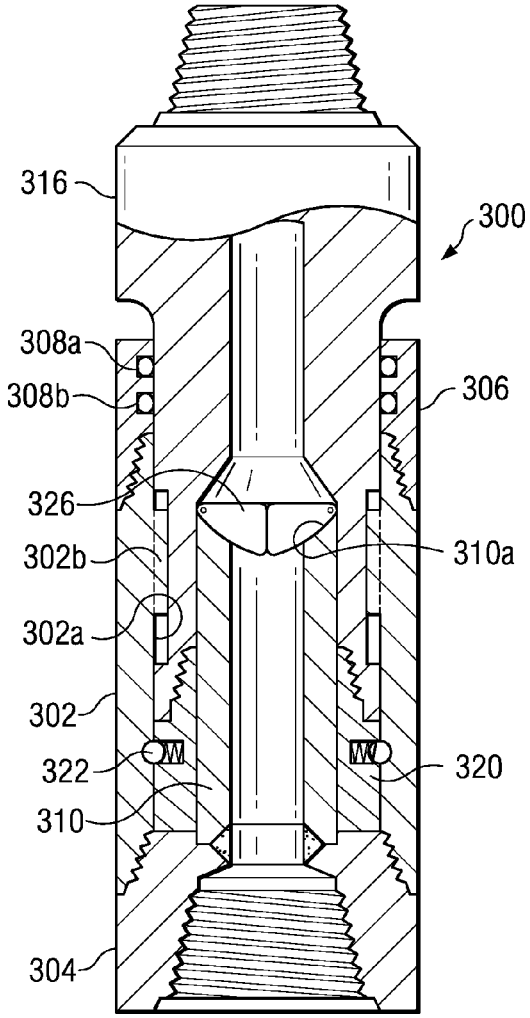

As better shown in FIGS. 23A and 23B, the sub 300 consists of an outer tubular member, or mandrel, 302 having a circumferential groove 302*a* formed in its inner surface, and a spline 302*b* provided on the latter inner surface, for reasons to be described. An adapter 304 is threadedly connected to the lower end of the mandrel 302 as viewed in the drawing, and it is understood that the adapter 304 is also connected to the drill bit 110 (FIG. 22), either directly or indirectly via conduits and/or other components. To this end, internal threads are provided on the adapter, as shown. A sleeve 306 is threadedly connected to the upper end of the mandrel 302, and two seal rings 308*a* and 308*b* extend in corresponding grooves formed in the inner surface of the sleeve.

The lower end of an inner tubular member, or mandrel, 310 is welded, or otherwise attached, to the upper end of the adapter 304, and the outer surface of the inner mandrel is disposed in a spaced relation to the corresponding inner surface of the outer mandrel 302 to define an annular space 312. The upper end portion 310*a* of the inner mandrel 310 is beveled, or tapered, for reasons to be described.

The upper end portion of a tubular member 316 is connected to the lower end of the drill string 130 in any conventional manner, such as by providing external threads on the member 316, as shown, that engage corresponding internal threads on the lower end portion of the drill string. The seal rings 308*a* and 308*b* engage the corresponding portions of the outer wall of the member 316, and the member 316 has a reduced inner diameter portion that defines a beveled, or tapered surface 316*a*. It is understood that an axial groove is formed in the outer surface of the member 316 that receives the spline 302*b* of the outer mandrel 302 to prevent relative rotational movement between the mandrel 302 and the member 316.

A sleeve 320 is threadedly connected to the lower end of the member 316, and the sleeve and the lower portion of the tubular member 316 extend in the annular space 312. A spring-loaded detent member 322 is provided in a groove formed in the outer surface of the sleeve 320, and is urged radially outwardly towards the mandrel 302, for reasons to be described.

A series of valve members 326, two of which are shown in the drawings, are pivotally mounted to an inner surface of the member 316. As non-limiting examples, four valve members 326 could be angularly spaced at ninety degree intervals, or six valve members could be angularly spaced at sixty degree intervals. The valve members 326 are located just above the tapered surface 310*a* of the inner mandrel 310 and just below the tapered surface 316*a* of the member 316.

The valve members 326 are movable between an open, retracted position, shown in FIG. 23A in which they permit the suspension to flow through the sub 300 to the drill bit 110, and a closed, extended position, shown in FIG. 23B, in which they block the flow of the suspension through the sub.

Assuming that the valve members 326 are in their open position shown in FIG. 23A, and it is desired to move them to the closed position of FIG. 23B, the drill string 130 is lowered in the wellbore until the drill bit 110 (FIG. 22) is prevented from further downward movement for one or more of several reasons such as for example, encountering the bottom of the wellbore, or material resting on the bottom. Thus, a force, substantially equal to the weight of the drill string 130, is placed on the sub 300 which causes the assembly formed by the tubular member 316, the sleeve 320 and the valve members 326, to move downwardly in the annular space 312 relative to the assembly formed by the outer mandrel 302, the adapter 304, and the inner mandrel 310.

This relative axial movement between the two assemblies described above causes the beveled surface 310*a* to engage the valve members 326 and pivot them upwardly, as viewed in the drawing. This axial and pivotal movement continues until the lower end of the member 320 reaches the bottom of the annular space 312 and the valve members are in their completely closed position of FIG. 23B to collectively block the flow of the suspension through the sub 300.

In the event that it is desired to move the valve members 326 from their closed position of FIG. 23B to their open position of FIG. 23A, fluid, at a relatively high pressure, is passed, via the drill string 130 (FIG. 5), into the bore of the sub 300. Since the valve members 326 are closed, the pressure of the fluid builds up to the extent that it leaks between the non-sealed outer surface of the inner mandrel 310 and the inner surfaces of the member 316 and the sleeve 320 and passes into the lower portion of the annular space 312 under the lower end of the sleeve 320. This creates a force acting against the latter end, thus forcing the assembly formed by the sleeve 320, the member 316, and the valve members 326 upwardly relative to the assembly formed by the outer mandrel 302, the adapter 304, and the inner mandrel 310. Thus, the valve members 326 pivot downwardly as shown by the arrow in FIG. 23A to their open position.

Figure 24A:
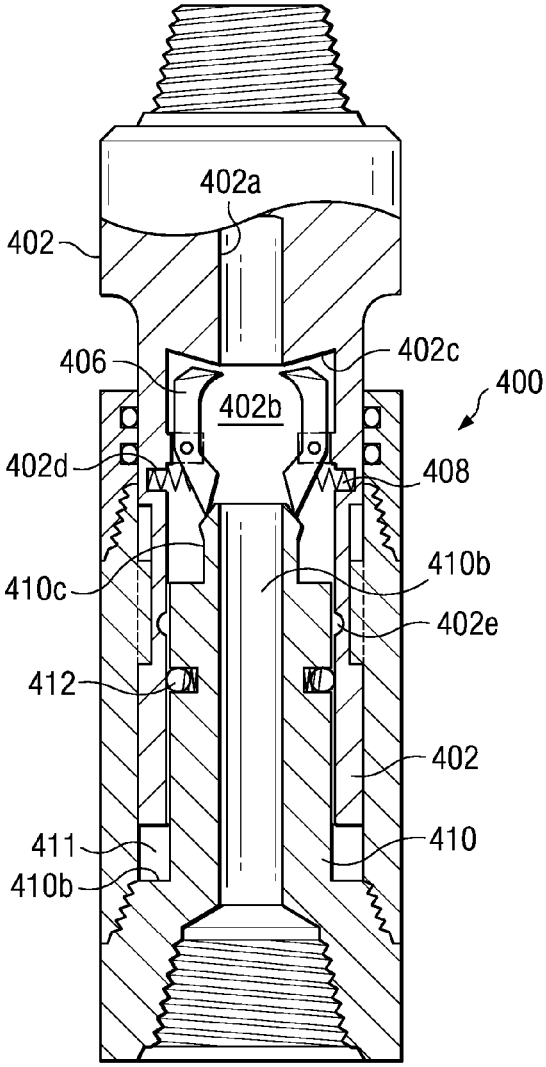
FIGS. 24A and 24B are views similar to those of FIGS. 23A and 23B, but depicting an alternate embodiment of the sub.
Figure 24B:
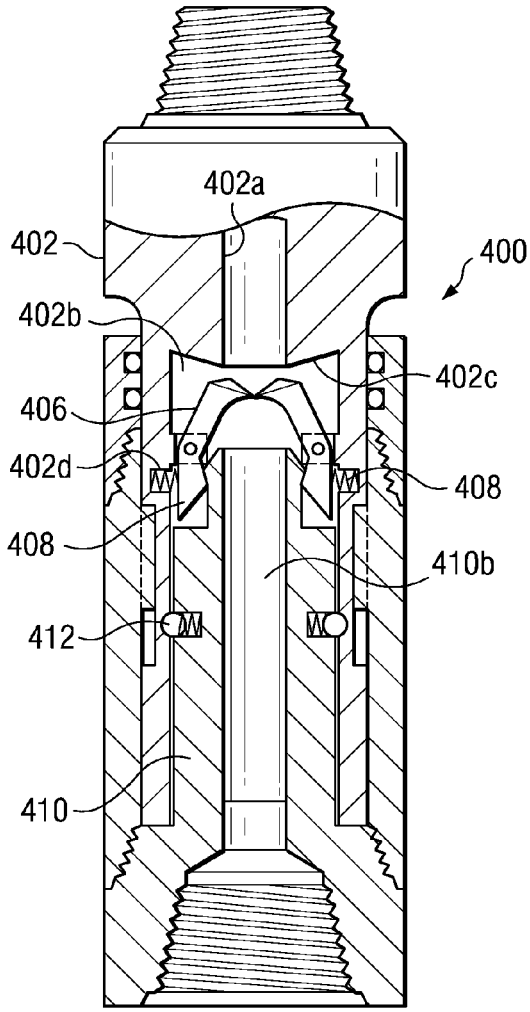

In FIGS. 24A and 24B, the reference numeral 400 refers to an alternate embodiment of a sub that is connected between the drill string 130 (FIG. 22) and the drill bit 110 for controlling the flow of the suspension of impactors 100 from the former to the latter.

The sub 400 consists of an outer tubular member, or mandrel, 402 the upper end of which is connected to the lower end of the drill string 130 in any conventional manner, such as by providing external threads on the member, as shown. A bore 402*a* extends through the upper portion of the mandrel 402, as viewed in the drawings, and a chamber, or enlarged bore, 402*b* extends from the bore 402*a* to the lower end of the mandrel. An internal shoulder 402*c* is formed on the mandrel at the junction between the bores 402*a* and 402*b*.

A series of valve members or arms 406, two of which are shown in the drawings, are pivotally mounted to a radially-extending internal flange formed on the inner wall of the mandrel. As non-limiting examples, four valve arms 406 could be angularly spaced at ninety degree intervals; or six valve arms could be angularly spaced at sixty degree intervals. The valve arms 406 are movable between an open, retracted position, shown in FIG. 24A in which they permit the suspension to flow through the sub 400 to the drill bit 110, and a closed, extended position, shown in FIG. 24B, in which they block the flow of the suspension through the sub.

A series of springs 408, two of which are shown, seat in a groove 402*d* formed in the inner surface of the mandrel 402. The springs 408 are angularly spaced around the groove 402*d*, and each spring engages the lower portion of a corresponding valve arm 408 to urge the lower portions radially inwardly as viewed in FIG. 24A, and therefore the upper portions of the arms radially outwardly.

An inner tubular member, or mandrel, 410 is provided adjacent the mandrel 402 and is connected to the upper end of the drill bit 110 (FIG. 22), either directly or indirectly via conduits and/or other components. To this end, internal threads are provided on the mandrel 410, as shown. The mandrel 410 has a bore 410*a* that registers with the bore, or chamber, 402*b* of the mandrel 40*a* and the lower end portion of the mandrel 410 has an expanded diameter that defines an exterior shoulder 410*b* that extends below the lower end of the mandrel 402 to define an annular space 411 shown in FIG. 24A, for reasons to be described.

An annular rim 410*c*, having a beveled upper end, is formed on the upper end portion of the mandrel 410, and a spring-loaded detent member 412 is provided in a groove formed in the outer surface of the mandrel 410, and is urged radially outwardly towards the mandrel 402.

The valve arms 406 are movable between the open, retracted position of FIG. 24A in which they permit the suspension to flow through the sub 400 to the drill bit 110, and a closed, extended position, shown in FIG. 24B, in which they block the latter flow.

Assuming that the valve arms 406 are in their open position shown in FIG. 24A, and it is desired to move them to the closed position of FIG. 24B, the drill string 130 is lowered in the wellbore until the drill bit 110 (FIG. 22) is prevented from further downward movement for one or more of several reasons such as for example, encountering the bottom of the wellbore, or material resting on the bottom. Thus, a force, substantially equal to the weight of the drill string 130, is placed on the sub 400 which causes the mandrel 402, and therefore the valve arms 406 to move downwardly relative to the mandrel 410. This movement causes the rim 410*b* to force the lower end portions of the valve arms 406 radially outwardly, which, in turn, pivots the upper portions of the arms radially inwardly. This axial and pivotal movement continues until the lower end of the mandrel 402 engages the shoulder 410*a*. In this position the detent 412 is urged into the groove 402*d* and the valve arms 406 are in their closed position to collectively block the flow of the suspension through the sub 400.

In the event that it is desired to move the valve arms 406 from their closed position of FIG. 24B to their open position of FIG. 24A, fluid, at a relatively high pressure is passed, via the drill string 130, through the bore 402*a* of the mandrel 402 and into the bore 402*b*. Since the valve arms 406 are closed, the pressure of the fluid builds up to the extent that it leaks between the non-sealed outer surface of the mandrel 410 and the corresponding inner surface of the mandrel 402 and passes into the annular space 411. This creates a force acting against the upper end of the mandrel 402 thus forcing it upwardly relative to the mandrel 410 which causes the valve arms 406 to move above the rim 410*c*. The springs 408 then can urge the lower ends of the valve arms 406 radially inwardly so that the upper portions of the arms are pivoted radially outwardly to the open position of FIG. 24A.

Figure 25:
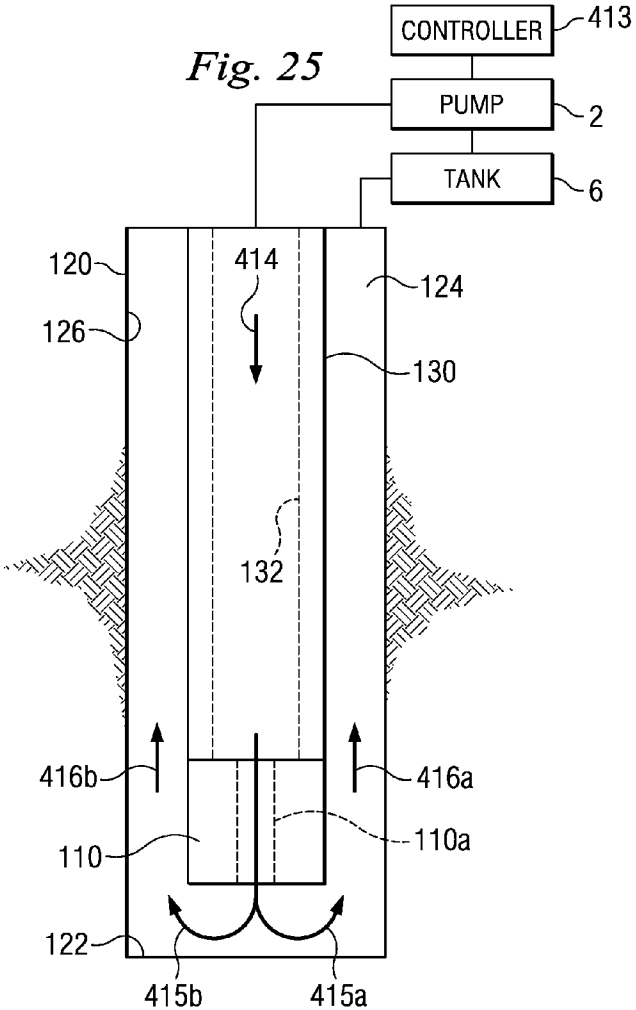
FIG. 25 is a schematic view of an excavation system according to an embodiment, a portion of which is similar to the view depicted in FIG. 5.

In an exemplary embodiment, during one or more of the above-described drilling operations and as illustrated in FIG. 25, the drill bit 110 acts upon the bottom surface 122 of the wellbore 120. As described above, drilling fluid is withdrawn from a reservoir such as, for example, the tank 6, by one or more of the above-described pumps such as, for example, the pump 2, and the impactors 100 are introduced into the drilling fluid in one or more of the above-described manners, or any combination thereof, thereby forming a suspension of impactors 100 and drilling fluid. A controller 413 is operably coupled to the pump 2 to control the operation of the pump 2. The central passage 132 of the drill string 130 supplies the suspension of impactors 100 and drilling fluid to the drill bit 110, as shown by an arrow 414. The drill bit 110 uses the drilling fluid and the impactors 100 when acting upon the bottom surface 122 of the wellbore 120, the drilling fluid and the impactors flowing through one or more passages 110*a* defined by the drill bit 110 and/or by components positioned within the drill bit 110 such as, for example, one or more nozzles, as indicated by arrows 415*a* and 415*b*. The drilling fluid then exits the wellbore 120 through the wellbore annulus 124 between the drill string 130 and the inner wall 126 of the wellbore 120. Cuttings, particles of the bottom surface 122 removed by the drill bit 110, and/or other material, and/or at least a portion of the impactors 100, flow upward with the drilling fluid through the wellbore annulus 124, as indicated by arrows 416*a* and 416*b*. Upon exiting the annulus 124, the drilling fluid, along with the cuttings, particles of the bottom surface 122, and/or other material, and/or at least a portion of the impactors 100, may undergo additional processes such as, for example, one or more of the above-described recovery and/or reclamation processes, or any combination thereof, and at least the drilling fluid may be directed to the tank 6, whereby the drilling fluid may be further processed for recirculation into the wellbore 120.

During one or more of the above-described drilling operations, the operation of one or more of the above-described pumps, including the pump 2, to cause the flow of the suspension of impactors 100 and drilling fluid through the drill string 130 and to the drill bit 110, must sometimes cease due to one or more conditions. For example, the operation of the pump 2 must stop when a new pipe must be added to the upper end of the drill string 130, and/or when the pump 2 itself breaks down and/or is in need of repairs and/or maintenance.

Figure 26:
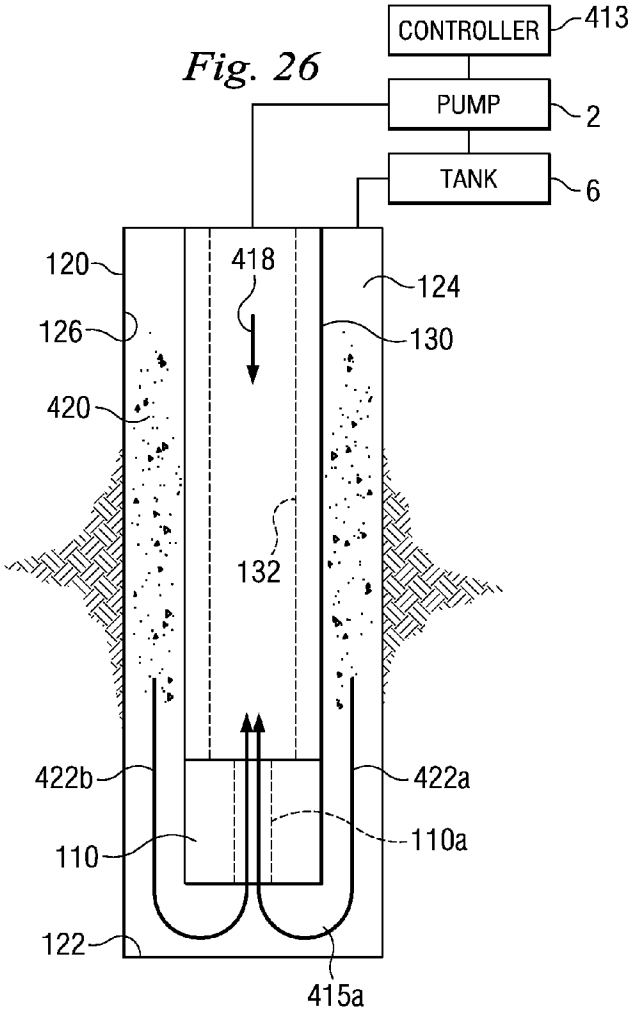
FIG. 26 is a view similar to that of FIG. 25 but depicting another operational condition.

In an exemplary embodiment, as a result of the cessation of operation of the pump 2 and as illustrated in FIG. 26, the suspension of impactors 100 and drilling fluid is no longer being pumped at a relatively high pressure, through the drill string 130 and the drill bit 110, out of the drill bit 110, and through the annulus 124.

Instead, as a result of the cessation of operation of the pump 2, the suspension collects or settles, flowing downward through the drill string 130, thereby causing the impactors 100 to flow downward through the drill string 130 so that the impactors 100 collect or settle within the lower portion of the passage 132 and above the drill bit 110, as indicated by an arrow 418.

Moreover, as a result of the cessation of operation of the pump 2, a volume 420 of drilling fluid, cuttings, particles of the bottom surface 122 removed by the drill bit 110, and/or other material, and/or at least a portion of the impactors 100, remains in the annulus 124. As a result, the pressure in the annulus 124 is greater than the pressure within the passage 132 of the drill string 130. As a result of this pressure differential, at least a portion of the volume 420 flows back down through the annulus 124 and the drill bit 110 as indicated by arrows 422*a* and 422*b*, in order to equalize the pressures in the annulus 124 and the passage 132. This type of flow may be referred to as U-tubing, reverse flow, backflow and/or reverse-circulating flow. As a result of this reverse flow or reverse-circulating flow, the impactors 100 present in the portion of the volume 420 that have flowed back through the drill bit 110 collect or settle within the lower portion of the passage 132 and above the drill bit 110.

The impactors 100 that have settled in the lower portion of the passage 132 of the drill string 130, and above the drill bit 110, as a result of settling downward as indicated by the arrow 418 and/or reverse circulating back into the passage 132 as indicated by the arrows 422*a* and 422*b*, may cause damage to the drill bit 110.

Figure 27:
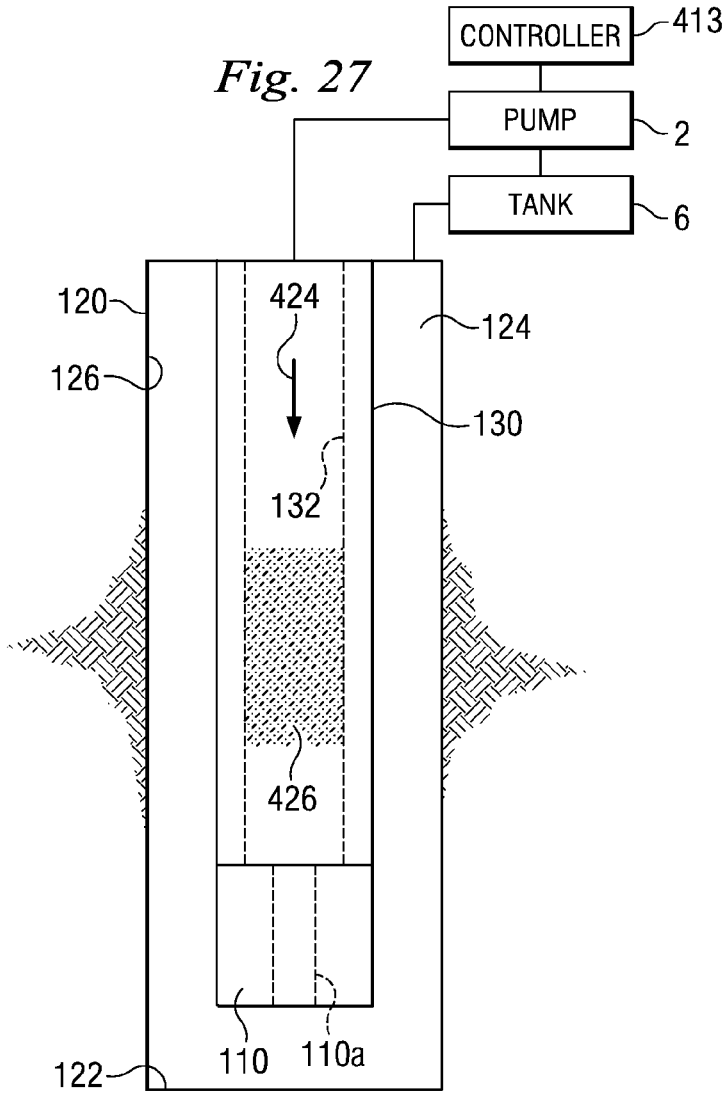
FIG. 27 is a view similar to that of FIGS. 25 and 26 but depicting yet another operational condition.

In an exemplary embodiment, as illustrated in FIG. 27, before, during and/or after the cessation of operation of the pump 2, a pill or slug, which may be composed of heavier-weight mud, is pumped down into the passage 132 of the drill string 130, as indicated by an arrow 424, in order to form a column of slug 426 within the passage 132 and above the drill bit 110.

The column of slug 426 within the passage 132 functions as a control device, generally eliminating the pressure differential between the pressure in annulus 124 and the pressure in the passage 132. As a result of the absence of a pressure differential, the volume 420 of drilling fluid, cuttings, particles of the bottom surface 122 removed by the drill bit 110, and/or other material, and/or at least a portion of the impactors 100, does not undergo substantial reverse-circulating flow. That is, very little, if any, of the volume 420 flows back through drill bit 110 and upward into the passage 132, as viewed in FIG. 27. As a result, the great majority, if not all, of the impactors 100 present in the volume 420 do not flow back up into the passage 132, thereby reducing the possibility of damage to the drill bit 110. In an exemplary embodiment, the drilling fluid, the impactors 100 and any other material in the passage 132, and the drilling fluid, the impactors 100 and any other material in the annulus 124, may all remain substantially static.

In addition to eliminating any significant reverse flow, the column of slug 426 also generally prevents or blocks the impactors 100, which are present in the portion of the passage 132 above the column of slug 426, from flowing downward through the drill string 130 so that the impactors 100 collect or settle within the lower portion of the passage 132 and above the drill bit 110. As a result, the possibility of damage to the drill bit 110 is further reduced.

In an exemplary embodiment, the column of slug 426 may generally prevent or block the impactors 100, the drilling fluid and any other material that is present in the portion of the passage 132 above the column of slug 426, from flowing downward through the drill string 130 and to the drill bit 110. In an exemplary embodiment, the column of slug 426 may be configured so that the column of slug 426 is at least somewhat permeable to permit at least some fluid to flow therethrough, while the impactors 100 that are present in the portion of the passage 132 above the column of slug 426 are generally prevented or blocked from flowing downward through the drill string 130 and to the drill bit 110. In an exemplary embodiment, the volume, the density and/or other material and/or physical properties of the slug of which the column of slug 426 is composed, may be varied in order to permit at least some fluid to flow through the column of slug 426.

In several exemplary embodiments, before, during and/or after pumping slug down into the passage 132 to form the column of slug 426, drilling fluid may be pumped through the passage 132, through the drill bit 110 and into the annulus 124 in order to circulate at least some of the impactors 100 present in the passage 132 out of the passage 132. In an exemplary embodiment, at least some of the impactors 100 present in the passage 132 may be circulated out of the passage 132 before slug is pumped down into the passage 132 to form the column of slug 426, thereby preventing a great majority of the impactors 100 that have been circulated out from undergoing reverse-circulating flow and flowing back into the passage 132 from the annulus 124.

During October and November 2005, experimental drilling testing was conducted through a formation at the GTI test site at Catoosa, Okla. using an experimental excavation system that included components that were similar to the above-identified components in the system of FIG. 25, and/or structural equivalents and/or equivalent structures of the above-identified components in the system of FIG. 25. In the following discussion of the experimental drilling testing, the components of the experimental excavation system used during the experimental drilling testing are given the same reference numerals as the respective similar components in the system of FIG. 25.

On Oct. 21, 2005, during the experimental drilling testing, it was necessary to add a section of drill pipe to the drill string 130. To prevent backflow or reverse-circulating flow, 40 barrels (BBLS) of pill or slug were experimentally pumped down the passage 132 of the drill string 130 at 180 gallons per minute (GPM) to form the column of slug 426 within the passage 132. The connection of the additional section of drill pipe was successfully made to the drill string 130. U-tubing, backflow or reverse-circulating flow did not occur before, during or after making the connection with the additional section of pipe. As a result, a significant amount of the impactors 100 did not flow from the annulus 124, through the drill bit 110, and into the passage 132, thereby reducing the possibility of damage to the drill bit 110. As another result, the making of the successful connection between the additional section of drill pipe and the drill string 130 was facilitated due to the absence of U-tubing or reverse flow.

On Oct. 25, 2005, during the experimental drilling testing and after experimentally drilling to about 1500 feet, it was necessary to add a section of drill pipe to the drill string 130. To prevent U-tubing or reverse-circulating flow, slug was experimentally pumped into the passage 132 to form the column of slug 426. As a result, the additional section of drill pipe was successfully connected to the drill string 130 and U-tubing did not occur.

On Oct. 26, 2005, between 1:30 p.m. and 2:00 p.m., during the experimental drilling testing, it was necessary to add a section of drill pipe to the drill string 130. To prevent U-tubing or reverse-circulating flow, 12.5 BBLS of slug, which was composed of 10.5 pounds-per-gallon (PPG) mud, was experimentally pumped into the passage 132 to form the column of slug 426. The connection between the additional section of drill pipe and the drill string 130 was made successfully.

On Oct. 26, 2005, between 2:00 p.m. and 3:00 p.m., during the experimental drilling testing, it was necessary to add a section of drill pipe to the drill string 130. To prevent U-tubing or reverse-circulating flow, 13 BBLS of slug, which was composed of 10.5 PPG mud, was experimentally pumped into the passage 132 to form the column of slug 426. The connection between the additional section of drill pipe and the drill string 130 was made successfully.

On Oct. 27, 2005, between 7:00 a.m. and 9:00 a.m., during the experimental drilling testing, it was necessary to add a section of drill pipe to the drill string 130. To prevent U-tubing, backflow or reverse-circulating flow, 12.5 BBLS of slug, which was composed of 10.8 PPG of mud, was experimentally pumped down the passage 132 to form the column of slug 426. The connection between the additional section of drill pipe and the drill string 130 was made successfully.

On Oct. 27, 2005, between 3:30 p.m. and 4:00 p.m., during the experimental drilling testing and after experimentally drilling to 1,613 feet, it was necessary to add a section of drill pipe to the drill string 130. To prevent U-tubing, backflow or reverse-circulating flow, 16.7 BBLS of slug, which was composed of 11.2 PPG mud, was experimentally pumped down the passage 132 of the drill string 130 to form the column of slug 426. The connection of the additional section of drill pipe was successfully made to the drill string 130. U-tubing, backflow or reverse-circulating flow did not occur before, during or after making the connection with the additional section of pipe. As a result, a significant amount of the impactors 100 did not flow from the annulus 124, through the drill bit 110, and into the passage 132, thereby reducing the possibility of damage to the drill bit 110. As another result, the making of the successful connection between the additional section of drill pipe and the drill string 130 was facilitated due to the absence of U-tubing or reverse flow.

On Oct. 28, 2005, between 3:30 p.m. and 4:00 p.m., during the experimental drilling testing and after experimentally drilling to about 1,739 feet, it was necessary to add a section of drill pipe to the drill string 130. To prevent U-tubing, backflow or reverse-circulating flow, 12.5 BBLS of slug, which was composed of 11.2 PPG of mud, was experimentally pumped down the passage 132 to form the column of slug 426. The connection between the additional section of drill pipe and the drill string 130 was made successfully.

On Oct. 31, 2005, during the experimental drilling testing and after experimentally drilling to about 1,863 feet, it was necessary to add a section of drill pipe to the drill string 130. To prevent U-tubing, backflow or reverse-circulating flow, 12.5 BBLS of slug, which was composed of 11.2 PPG of mud, was experimentally pumped down the passage 132 to form the column of slug 426. The connection between the additional section of drill pipe and the drill string 130 was made successfully.

On Nov. 1, 2005, during the experimental drilling testing and after experimentally drilling to about 1,952 feet, it was necessary to add a section of drill pipe to the drill string 130. To prevent U-tubing, backflow or reverse-circulating flow, 12.5 BBLS of slug, which was composed of 11.2 PPG of mud, was experimentally pumped down the passage 132 to form the column of slug 426. The connection between the additional section of drill pipe and the drill string 130 was made successfully.

Figure 28:
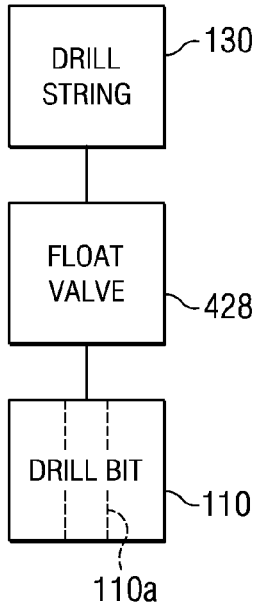
FIG. 28 is a diagram of a portion of the excavation system of FIG. 25 according to an embodiment.

In an exemplary embodiment, as illustrated in FIG. 28, a control device such as a float valve 428 is fluidicly coupled to the passage 132 of the drill string 130 and is positioned above the drill bit 110. In an exemplary embodiment, a portion of the drill string 130 may extend from the float valve 428 and to the drill bit 110.

In operation, the float valve 428 generally prevents or blocks the above-described reverse-circulating flow of the volume 420 from proceeding past the float valve 428 and in an upward direction, as viewed in FIG. 28. As a result, a significant quantity of the impactors 100 does not flow into the passage 132 from the annulus 124, and the possibility of damage to the drill bit 110 is reduced.

Figure 29:
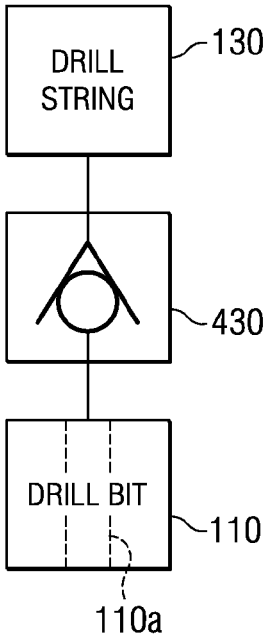
FIG. 29 is a diagram of a portion of the excavation system of FIG. 25 according to another embodiment.

In an exemplary embodiment, as illustrated in FIG. 29, a control device such as a check valve 430 is fluidicly coupled to the passage 132 of the drill string 130 and is positioned above the drill bit 110. In an exemplary embodiment, a portion of the drill string 130 may extend from the check valve 430 and to the drill bit 110.

In operation, the check valve 430 generally prevents the above-described reverse-circulating flow of the volume 420 from proceeding past the check valve 430 and in an upward direction, as viewed in FIG. 29. As a result, a significant quantity of the impactors 100 does not flow into the passage 132 from the annulus 124, and the possibility of damage to the drill bit 110 is reduced.

Figure 30:
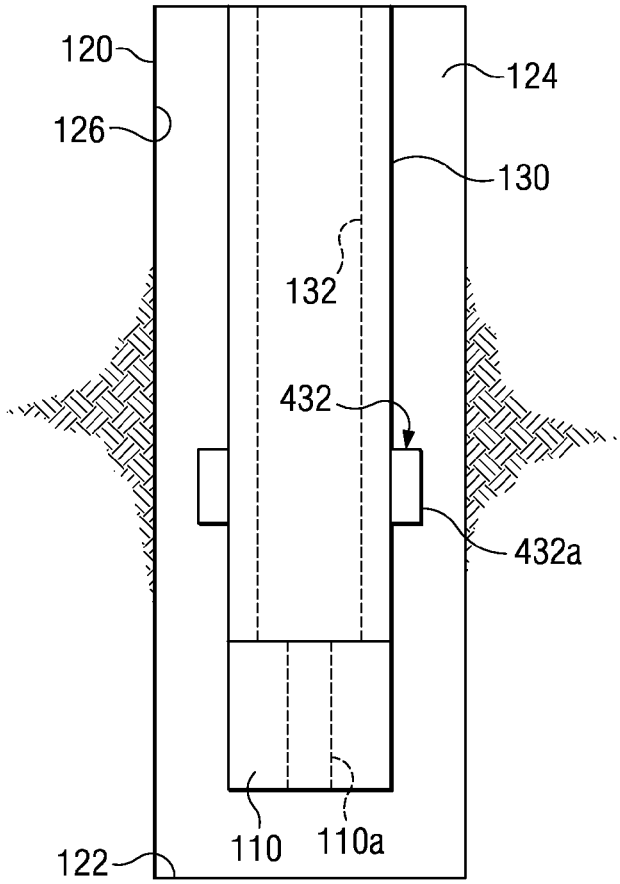
FIG. 30 is a view similar to that of FIG. 25 but depicting a control device in an operational mode.

In an exemplary embodiment, as illustrated in FIG. 30, a control device 432 is coupled to the drill string 130 and includes a moveable portion 432*a*. In operation, the control device 432 initially may be in an open configuration in which the suspension of impactors 100 and drilling fluid is permitted to flow in any direction within the annulus 124.

Figure 31:
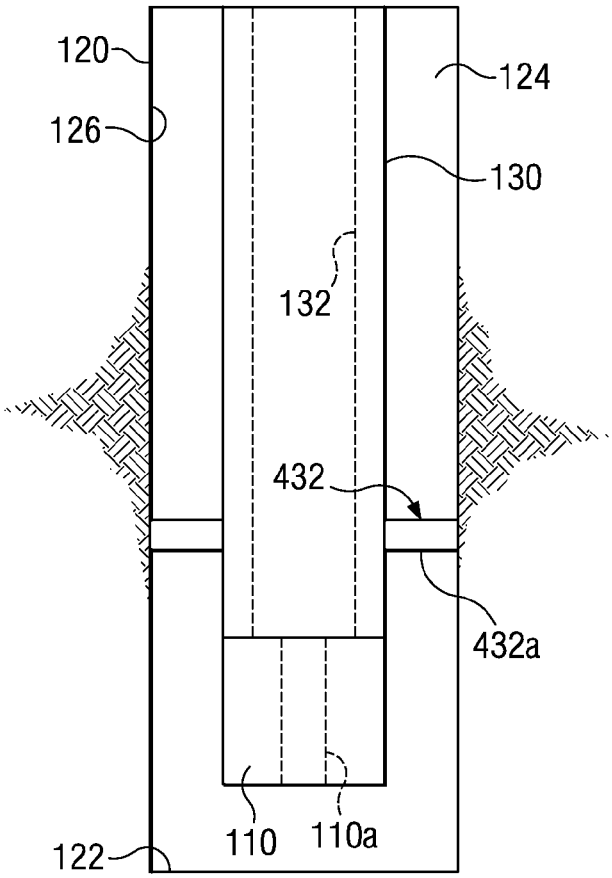
FIG. 31 is a view similar to that of FIG. 30 but depicting another operational mode of the control device.

In an exemplary embodiment, as illustrated in FIG. 31, before, during and/or after the above-described cessation of operation of the pump 2, the moveable portion 432*a* of the control device 432 is actuated to place the control device 432 in a closed configuration. More particularly, the moveable portion 432*a* is actuated so that at least a portion of the moveable portion 432*a* extends substantially across the annulus 124, from about the outside surface of the drill string 130 to about the inside surface 126 of the wellbore 120. In several exemplary embodiments, to place the control device 432 in the closed configuration, the moveable portion 432*a* may be pressure-actuated, gravity-actuated, mechanically-actuated and/or any combination thereof.

When the control device 432 is in the closed configuration, and after the operation of the pump 2 has ceased, the impactors 100 in the portion of the volume 420 above the moveable portion 432*a*, are generally prevented from reverse flowing back into the passage 132 of the drill string 130. As a result, a significant quantity of the impactors 100 does not flow into the passage 132 from the annulus 124, and the possibility of damage to the drill bit 110 is reduced. In an exemplary embodiment, the impactors 100 in the portion of the volume 420 above the moveable portion 432*a* may engage and settle on top of the moveable portion 432*a*. In an exemplary embodiment, the drilling fluid, the impactors 100 and any other material in the portion of the volume 420 above the moveable portion 432*a* may be prevented from reverse flowing back into the passage 132 of the drill string 130. In an exemplary embodiment, the moveable portion 432*a* may be configured so that at least a portion of the moveable portion 432*a* is permeable to permit at least some fluid to flow therethrough. In several exemplary embodiments, the moveable portion 432*a* may comprise one or more screens, one or more slotted portions and/or one or more mesh portions, and/or any combination thereof.

In an exemplary embodiment, the control device 432 may comprise a modified version of the sub 300 of FIGS. 23A and 23B, with the moveable portion 432*a* comprising one or more of the valve members 326. More particularly, the sub 300 may be modified so that the valve members 326 at least partially extend within the annulus 124 when the control device 432 is in the closed configuration. The operation of this modified version of the sub 300 may be somewhat similar to the operation of the sub 300, which is described above in connection with FIGS. 23A and 23B. When the control device 432 is in the closed configuration, the impactors 100 in the portion of the volume 420 above the moveable portion 432*a* may engage the valve members 326, and thus may be prevented from reverse-flowing back into the passage 132 of the drill string 130.

In an exemplary embodiment, the control device 432 may comprise a modified version of the sub 400 of FIGS. 24A and 24B, with the moveable portion 432*a* comprising one or more of the valve arms 406. More particularly, the sub 400 may be modified so that the valve arms 406 at least partially extend within the annulus 124 when the control device 432 is in the closed configuration. The operation of this modified version of the sub 400 may be somewhat similar to the operation of the sub 400, which is described above in connection with FIGS. 24A and 24B. When the control device 432 is in the closed configuration, the impactors 100 in the portion of the volume 420 above the moveable portion 432*a* may engage the valve arms 406, and thus may be prevented from reverse-flowing back into the passage 132 of the drill string 130.

Figure 32:
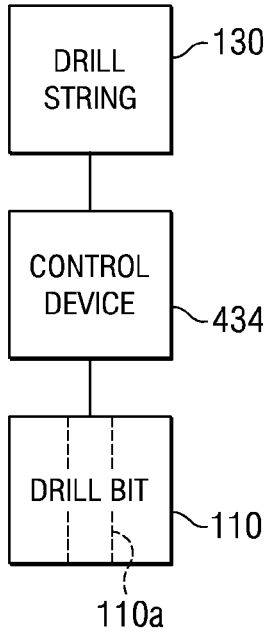
FIG. 32 is a diagram of a portion of the excavation system of FIG. 25 according to yet another embodiment.

In an exemplary embodiment, as illustrated in FIG. 32, a control device 434 is coupled to the drill string 130 and is positioned above the drill bit 110. In an exemplary embodiment, a portion of the drill string 130 may extend from the control device 434 and to the drill bit 110.

In operation, the control device 434 generally prevents or blocks the suspension of impactors 100 and drilling fluid from flowing downward through the drill string 130 and to the drill bit 110. In an exemplary embodiment, at least a portion of the control device 434 may be permeable to permit the flow of drilling fluid therethrough, while generally preventing the flow of impactors 100 therethrough. In an exemplary embodiment, at least a portion of the control device 434 may comprise one or more screens, one or more slotted portions, one or more mesh portions and/or any combination thereof.

In an exemplary embodiment, the control device 434 may comprise the sub 300, which is described above in connection with FIGS. 23A and 23B. As a result, the operation of the control device 434 may be substantially similar to the above-described operation of the sub 300. In an exemplary embodiment, at least portions of the valve members 326 may be permeable to permit fluid to continue to flow downward through the passage 132 and to the drill bit 110, while generally preventing the flow of impactors 100. In several exemplary embodiments, the valve members 326 of the sub 300 of the control device 434 may be arranged so that, when the valve members 326 are in the closed position, the valve members 326 collectively block the flow of the impactors 100 through the sub 300, while permitting fluid to continue to flow downward through the passage 132 and to the drill bit 110. In an exemplary embodiment, when the valve members 326 are in the closed position of FIG. 23B, the spacing between the valve members 326 may be sized to permit fluid to continue to flow downward through the passage 132 and to the drill bit 110, while blocking the flow of the impactors 100 through the sub 300. In several exemplary embodiments, notwithstanding the ability of the sub 300 to permit fluid to flow through the sub 300 while blocking the flow of the impactors 100, the valve members 326 may still be moved from their closed position to their open position in the manner described above by, for example, increasing the pressure of the fluid within the tubular member 316 of the sub 300.

In an exemplary embodiment, the control device 434 may comprise the sub 400, which is described above in connection with FIGS. 24A and 24B. As a result, the operation of the control device 434 may be substantially similar to the above-described operation of the sub 400. In an exemplary embodiment, at least portions of the valve arms 406 may be permeable to permit fluid to continue to flow downward through the passage 132 and to the drill bit 110, while generally preventing the flow of impactors 100. In several exemplary embodiments, the valve arms 406 of the sub 400 of the control device 434 may be arranged so that, when the valve arms 406 are in the closed position, the valve arms 406 collectively block the flow of the impactors 100 through the sub 400, while permitting fluid to continue to flow downward through the passage 132 and to the drill bit 110. In an exemplary embodiment, when the valve arms 406 are in the closed position of FIG. 24B, the spacing between the upper portions of the valve arms 406 may be sized to permit fluid to continue to flow downward through the passage 132 and to the drill bit 110, while blocking the flow of the impactors 100 through the sub 400. In several exemplary embodiments, notwithstanding the ability of the sub 400 to permit fluid to flow through the sub 400 while blocking the flow of the impactors 100, the valve arms 406 may still be moved from their closed position to their open position in the manner described above by, for example, increasing the pressure of the fluid in the bore 402*b*.

Figure 33:
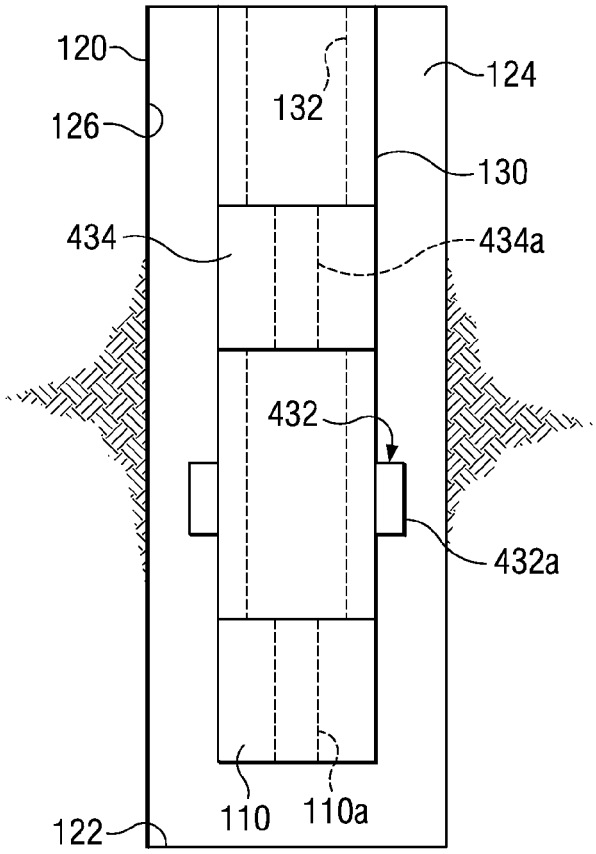
FIG. 33 is a view similar to that of FIG. 30 but depicting two control devices.

In an exemplary embodiment, as illustrated in FIG. 33, both of the control devices 432 and 434 are coupled to the drill string 130, and operate in the respective manners described above. As a result, a significant quantity of the impactors 100 does not flow into the passage 132 from the annulus 124, and a significant quantity of impactors 100 does not flow through the drill string 130 and to the drill bit 110. As a result, the possibility of damage to the drill bit 110 is reduced. In an exemplary embodiment, the control device 434 may define one or more passages 434*a*, which may be opened to permit flow therethrough and which may be closed to generally prevent flow therethrough.

Figure 34:
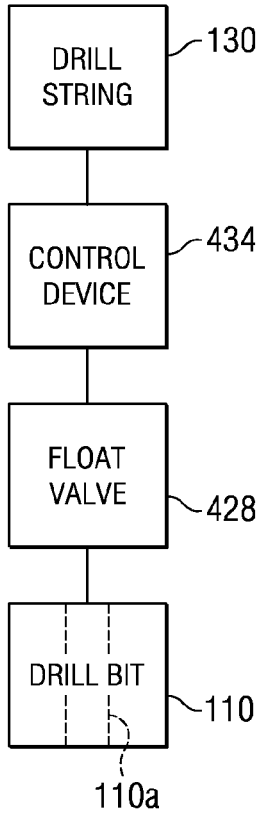
FIG. 34 is a diagram of a portion of the excavation system of FIG. 25 according to yet another embodiment.

In an exemplary embodiment, as illustrated in FIG. 34, the control device 434 is coupled to the drill string 130, and the float valve 428 is fluidicly coupled to the passage 132 of the drill string 130 and is positioned between the control device 434 and the drill bit 110. In operation, the control device 434 and the float valve 428 operate in the respective manners described above. As a result, a significant quantity of the impactors 100 does not flow into the passage 132 from the annulus 124, and a significant quantity of impactors 100 does not flow through the drill string 130 and to the drill bit 110. As a result, the possibility of damage to the drill bit 110 is reduced. In an exemplary embodiment, in addition to, or instead of the float valve 428, the check valve 430 may be fluidicly coupled to the passage 132 of the drill string 130.

Figure 35:
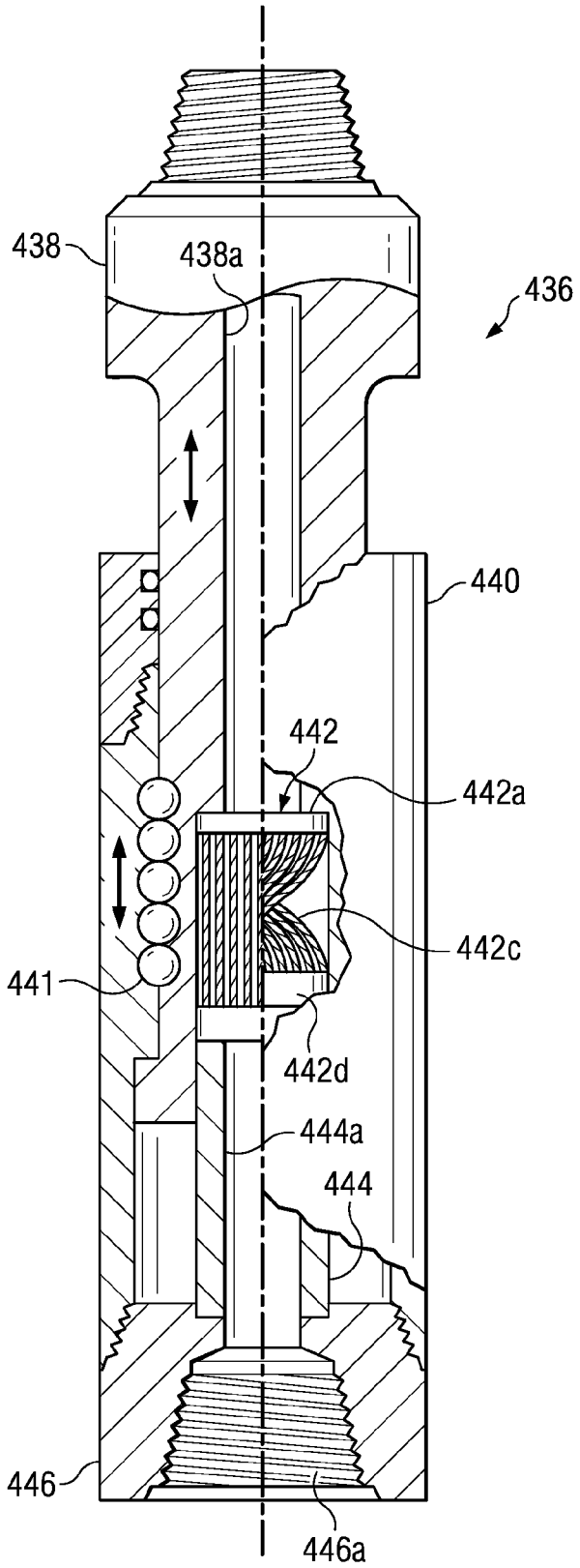
FIG. 35 is a partial elevational/partial sectional view of a control device according to an embodiment.
Figure 36:
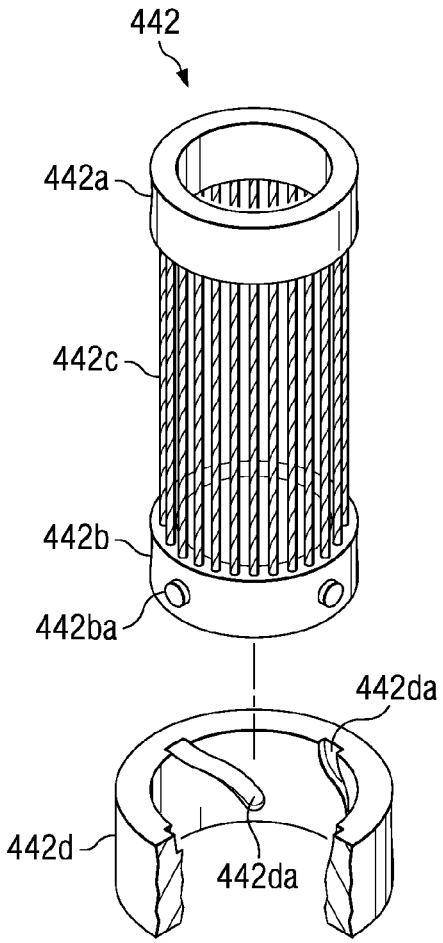
FIG. 36 is an enlarged, partially-exploded view of a portion of the control device of FIG. 35.

In an exemplary embodiment, as illustrated in FIGS. 35 and 36, a control device is generally referred to by the reference numeral 436 and includes a mandrel 438, which extends into a sleeve 440 and is adapted to move relative to the sleeve 440 under conditions to be described. A ball spline 441 is coupled to the mandrel 438 and the sleeve 440. A passage 438*a* is defined by the mandrel 438. A cable assembly 442 is coupled to the mandrel 438 and a tubular support 444, and includes collars 442*a* and 442*b*, between which a plurality of cables 442*c* extend. In an exemplary embodiment, the cables 442*c* may be composed of stainless steel aircraft cables. The collar 442*b* is coupled to a collar 442*d*, which includes a plurality of twisting channels 442*da* formed in the inside surface of the collar 442*d*. Pins 442*ba* extend from the outside surface of the collar 442*b* and are received by respective channels of the plurality of channels 442*da*. In an exemplary embodiment, the plurality of twisting channels 442*da* may instead be formed in the outside surface of the collar 442*b*, and the pins 442*ba* may instead extend from the inside surface of the collar 442*d*. A sub 446 is coupled to the sleeve 440 and the tubular support 444. A passage 444*a* is defined by the tubular support 444, and a passage 446*a* is defined by the sub 446.

In an exemplary embodiment, the mandrel 438*a* is coupled to the drill string 130 so that the passage 132 is fluidicly coupled to the passages 438*a*, 444*a* and 446*a*. The sub 446 is coupled to the drill bit 110. In an exemplary embodiment, the sub 446 may be coupled to another portion of the drill string 130, which may then extend to the drill bit 110.

In operation, the control device 436 is initially in an open configuration in which the cables 442*c* are in an extended position, as shown in FIG. 36 and in the left-hand portion of the depiction of the cables 442*c* in FIG. 35. The cables 442*c* are so placed by displacing the mandrel 438 downward, as viewed in FIG. 35 until the mandrel is proximate the sub 446. As a result, the collars 442*b* and 442*d* move away from the collar 442*a*, and the cables 442*c* are placed in the extended position.

When the control device 436 is in the open configuration, the suspension of impactors 100 and drilling fluid is permitted to flow through the passage 438*a*, the cables 442*c*, the passage 444*a* and the passage 446*a*.

To place the control device 436 in a closed configuration in which the cables 442*c* are in a pinched position, as shown in the right-hand portion of the depiction of the cables 442*c* in FIG. 35, the mandrel 438 is actuated so that the mandrel 438 is displaced upwards, as viewed in FIG. 35. During the upward displacement of the mandrel 438, the collar 442*a* remains stationary and the collar 442*d* is displaced upwards. As a result, the pins 442*ba* slidingly engage the respective channels 442*da*, causing both of the collars 442*b* and 442*d* to both rotate and move upwards. As a result, the cables 442*c* rotate and contract until the cables 442*c* are placed in the pinched position. In several exemplary embodiments, the mandrel 438 of the control device 436 may be displaced by actuating the mandrel 438 in any conventional manner using, for example, pressure or hydraulic actuation, gravity actuation, mechanical actuation and/or any combination thereof.

As a result of placing the control device 436 in the closed configuration, the cables 442*c* are pinched off, and the impactors 100 in the suspension of impactors 100 and drilling fluid are generally prevented from flowing downward through the passages 444*a* and 446*a*, and to the drill bit 110, while the drilling fluid in the suspension is permitted to flow downward to the drill bit 110.

In an exemplary embodiment, the control device 436 may be configured so that, to place the control device 436 in the closed configuration, the mandrel 438 is actuated to move downward, and the collar 442*a* moves relative to the collar 442*d*, so that the pins 442*ba* slidingly engage the respective channels 442*da*, causing the collars 442*b* and 442*d* to rotate while collar 442*a* moves towards the collar 442*d*. As a result, the cables 442*c* rotate and contract, and are pinched off. In this exemplary embodiment, the mandrel 438 is actuated to move upward to place the control device 436 in the open configuration.

In several exemplary embodiments, a wide variety of configurations may be used to effect relative axial movement between the collar 442*a* and the collar 442*d* in order to cause the cables 442*c* to rotate and pinch off, and/or to extend.

Figure 37:
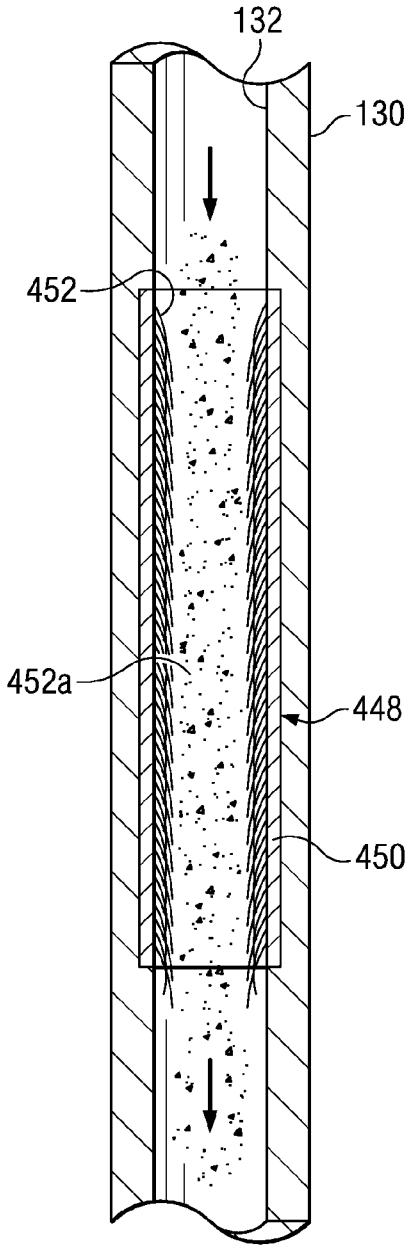
FIG. 37 is a sectional view of a control device according to another embodiment.

In an exemplary embodiment, as illustrated in FIG. 37, a control device is generally referred to by the reference numeral 448 and includes a liner 450 that is coupled to the inside surface of the drill string 130. In an exemplary embodiment, the liner 450 extends in an internal annular recess formed in the drill string 130. A plurality of whiskers 452 extends at least partially radially inward from the inside surface of the liner 450. As shown in FIG. 47, the whiskers 452 are in a folded or bent configuration in which the whiskers 452 extend in an angular direction so that a passage 452*a* is defined through the whiskers. The passage 452*a* is fluidicly coupled to the passage 132. In several exemplary embodiments, the whiskers 452 may extend in a partially upward axial direction, or in a partially downward axial direction. In an exemplary embodiment, the whiskers 452 may comprise bristles or stiff synthetic hairs, and/or may be similar to Astroturf, and/or may comprise wires extending within elastomer-like brushes. When the control device 436 is in an open configuration, the whiskers 452 are in the above-described bent configuration.

In operation, when the control device 436 is in the open configuration, the suspension of impactors 100 and drilling fluid is permitted to flow through the passages 132 and 452*a*, and to the drill bit 110.

Figure 38:
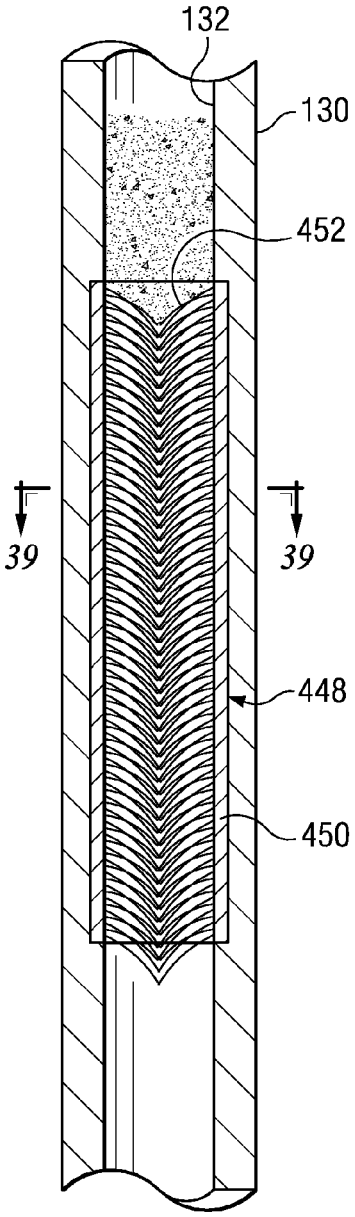
FIG. 38 is a view similar to that of FIG. 37 but depicting another operational mode of the control device.
Figure 39:
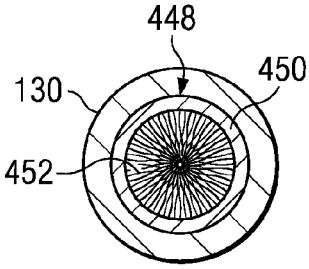
FIG. 39 is a sectional view of the control device of FIG. 38 taken along line 39-39.

In an exemplary embodiment, to place the control device 436 in a closed configuration as illustrated in FIGS. 38 and 39, the whiskers 452 are actuated so that the respective angles of extension of the whiskers 452 are decreased and each of the whiskers 452 generally extends towards the longitudinal center axis of the liner 450, or at a relatively small angle therefrom, thereby closing the passage 452*a*. In several exemplary embodiments, the whiskers 452 may overlap and/or engage each other in the closed configuration of the control device 436. In several exemplary embodiments, the whiskers 452 may be actuated in any conventional manner using, for example, pressure or hydraulic actuation, gravity actuation, mechanical actuation and/or any combination thereof.

As a result of placing the control device 448 in the closed configuration, the passage 452*a* is closed off, and the impactors 100 in the suspension of impactors 100 and drilling fluid are generally prevented from flowing downward through the passage 452*a* and to the drill bit 110, while the drilling fluid in the suspension is permitted to flow downward through and between the whiskers 452 and to the drill bit 110. In an exemplary embodiment, the whiskers 452 may be sized, and/or the quantity of whiskers 452 increased, so that the permeability of the whiskers 452 is decreased and neither the impactors 100 nor the drilling fluid in the suspension of impactors 100 and drilling fluid is generally permitted to flow to the drill bit 110.

Figure 40:
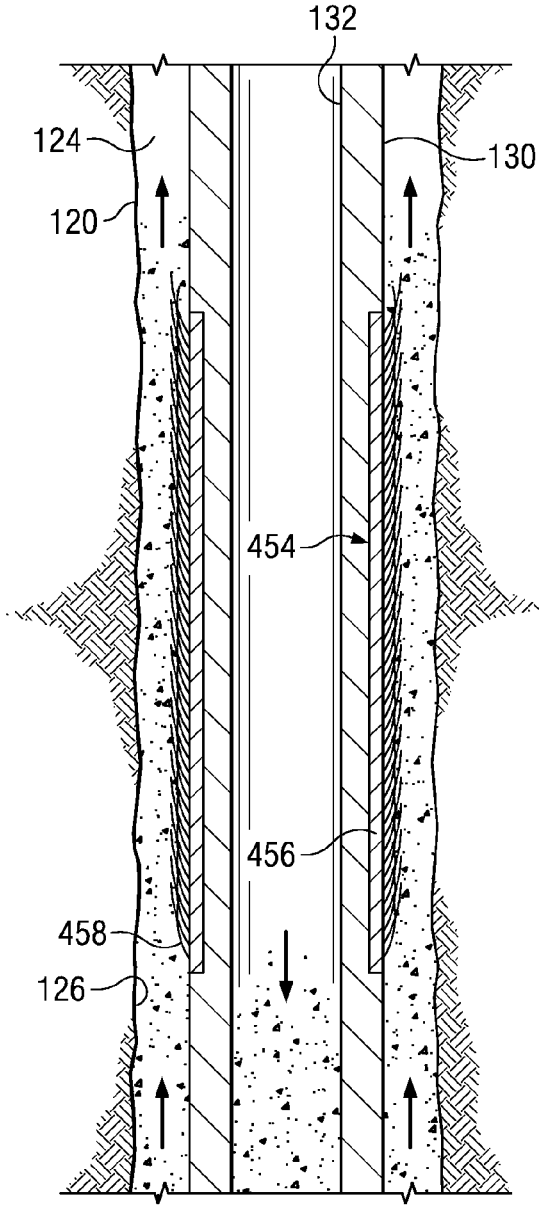
FIG. 40 is a sectional view of a control device according to yet another embodiment.

In an exemplary embodiment, as illustrated in FIG. 40, a control device is generally referred to by the reference numeral 454 and includes a sleeve 456 coupled to the drill string 130 so that the drill string 130 extends through the sleeve 456. In an exemplary embodiment, the sleeve 456 extends in an external annular recess formed in the outside surface of the drill string 130.

A plurality of whiskers 458 extends at least partially radially outward from the outside surface of the sleeve 456 and into the annulus 124. As shown in FIG. 40, the whiskers 458 are in a folded or bent configuration in which the whiskers 458 extend in an angular direction so that material is permitted to flow in the portion of the annulus 124 between the control device 454 and the wall 126 of the wellbore 120. In several exemplary embodiments, the whiskers 458 may extend in a partially upward axial direction, or in a partially downward axial direction. In an exemplary embodiment, the whiskers 458 may comprise bristles or stiff synthetic hairs, and/or may be similar to Astroturf, and/or may comprise wires extending within elastomer-like brushes. When the control device 454 is in an open configuration, the whiskers 458 are in the above-described bent configuration.

In operation, when the control device 454 is in the open configuration, the suspension of impactors 100 and drilling fluid is permitted to flow through the annulus 124 in either an upward or downward direction, as viewed in FIG. 40. As described above, the suspension of impactors 100 and drilling fluid may flow through the annulus 124 in an upward direction after being discharged from the drill bit 110.

Figure 41:
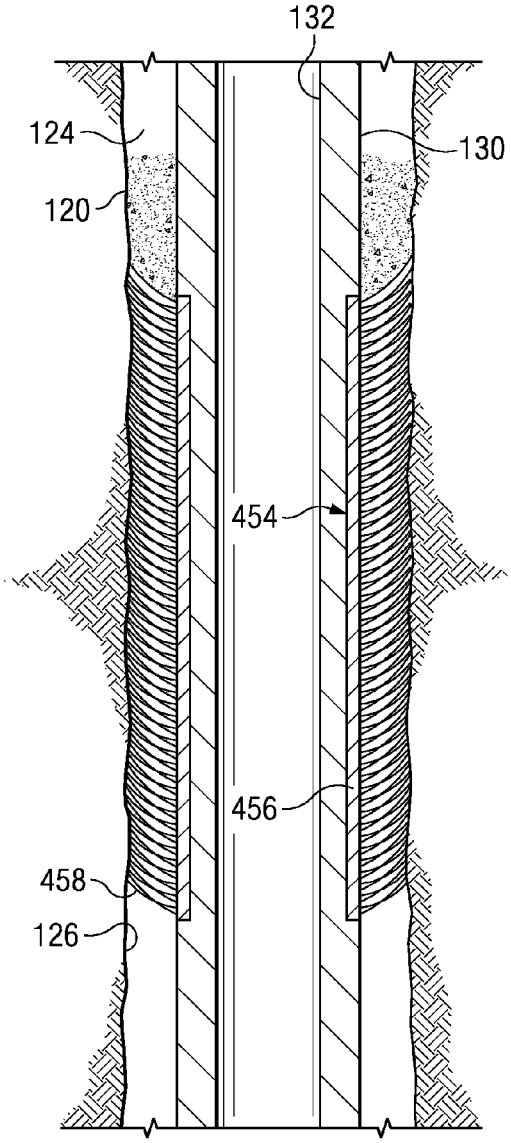
FIG. 41 is a view similar to that of FIG. 40 but depicting another operational mode of the control device.

In an exemplary embodiment, to place the control device 454 in a closed configuration as illustrated in FIG. 41, the whiskers 458 are actuated so that the respective angles of extension of the whiskers 458 are decreased and each of the whiskers 458 generally extends towards the wall 126 of the wellbore 120, or at a relatively small angle therefrom, thereby extending across the annulus 124. In several exemplary embodiments, the whiskers 458 may be actuated in any conventional manner using, for example, pressure or hydraulic actuation, gravity actuation, mechanical actuation and/or any combination thereof.

When the control device 454 is in the closed configuration, and after the operation of the pump 2 has ceased, the impactors 100 in the portion of the annulus 124 above the whiskers 458 are generally prevented from reverse flowing back into the passage 132 of the drill string 130. In an exemplary embodiment, the whiskers 458 may be sized, and/or the quantity of whiskers 458 increased, so that the permeability of the whiskers 458 is decreased and neither the impactors 100 nor the drilling fluid in the suspension of impactors 100 and drilling fluid is generally permitted to undergo reverse flow back into the passage 132.

In an exemplary embodiment, each of the control devices 448 and 454 may be coupled to the drill string 130, in the respective manners described above, so that a significant amount of the impactors 100 are prevented from settling above and/or on the drill bit 110 due to either downward flow through the passage 132 or backflow or reverse flow from the annulus 124, through the drill bit 110 and into the passage 132.

Figure 42:
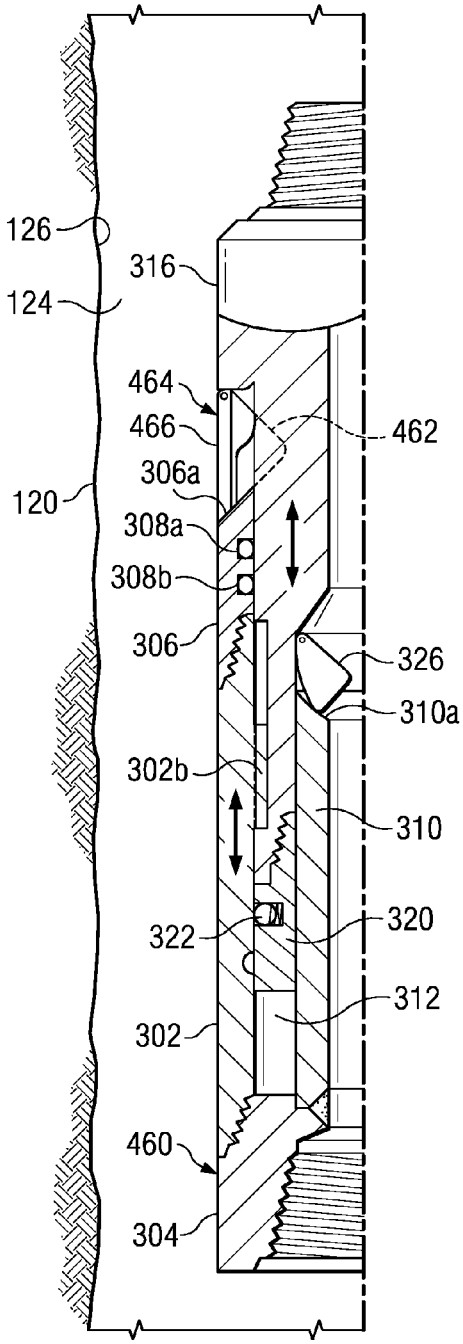
FIG. 42 is a sectional view of a control device according to yet another embodiment.

In an exemplary embodiment, as illustrated in FIG. 42, a control device is generally referred to by the reference numeral 460 and includes several parts of the sub 300, which are given the same reference numerals and include the mandrel 302, the spline 302*b*, the adapter 304, the sleeve 306, the seal rings 308*a* and 308*b*, the mandrel 310, the tubular member 316, the sleeve 320 and the valve members 326. The tubular member 316 is coupled to the drill string 130 and the adapter 394 is coupled to the drill bit 110, either directly or indirectly via conduits and/or other components such as, for example, additional sections of the drill string 130. The remaining couplings between the above-identified components of the control device 460 will not be described in detail since these couplings are similar to the corresponding couplings in the sub 300.

In the exemplary embodiment of FIG. 42, an external annular recess 462 is formed in the sleeve 306 and the tubular member 316. A beveled surface 306*a* is defined by the external annular recess 462. A moveable portion 464 is coupled to the tubular member 316. The moveable portion 464 includes a plurality of valve members, fingers or wings 466 that are pivotly coupled to the tubular member 316, and that at least partially extend, or fold, into the external annular recess 462 when the control device 460 is in an open configuration, as shown in FIG. 42.

In operation, when the control device 460 is in the open configuration as illustrated in FIG. 42, the suspension of impactors 100 and drilling fluid is permitted to flow through the passage 132 of the drill string 130, through the control device 460 and to the drill bit 110. Also, the suspension of impactors 100 and drilling fluid is permitted to flow through the annulus 124 in either an upward or downward direction, as viewed in FIG. 42. As described above, the suspension of impactors 100 and drilling fluid may flow through the annulus 124 in an upward direction after being discharged from the drill bit 110.

Figure 43:
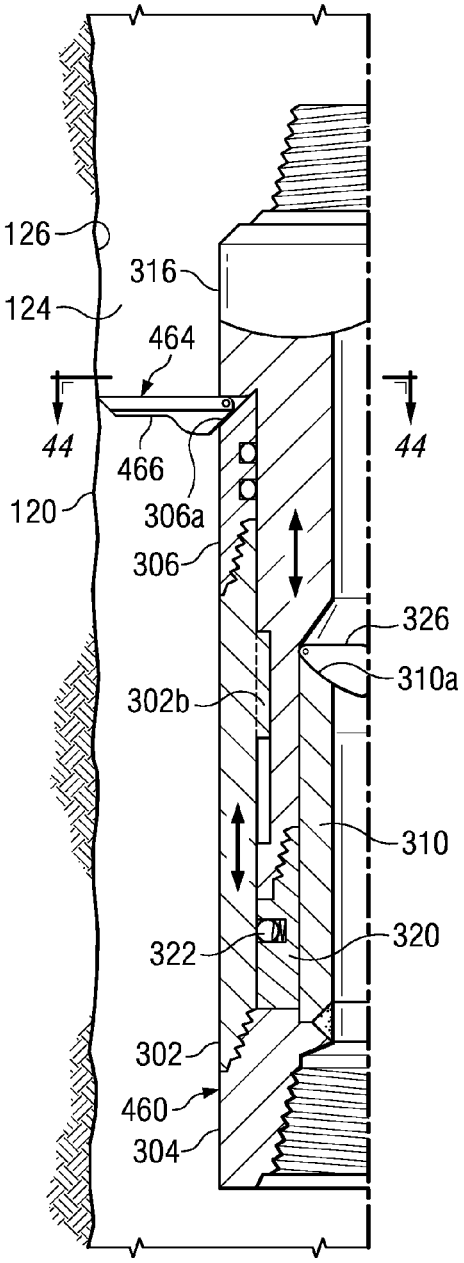
FIG. 43 is a view similar to that of FIG. 42 but depicting another operational mode of the control device.
Figure 44:
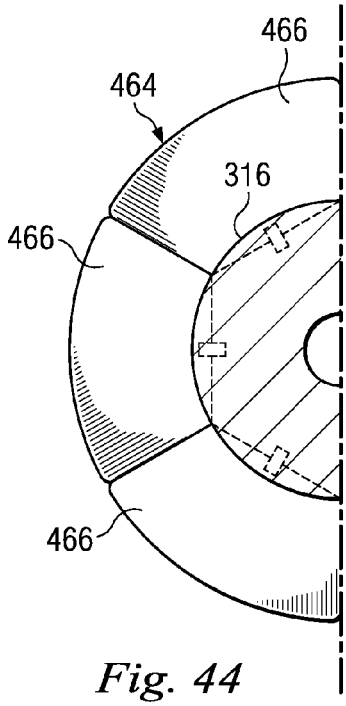
FIG. 44 is a sectional view of the control device of FIG. 43 taken along line 44-44.

To place the control device 460 in a closed configuration as illustrated in FIGS. 43 and 44, the drill string 130 is lowered in the wellbore 120 until the drill bit 110 is prevented from further downward movement for one or more of several reasons such as for example, encountering the bottom of the wellbore 120, or material resting on the bottom 122 of the wellbore 120. Thus, a force, substantially equal to the weight of the drill string 130, is placed on the sub 300 which causes the assembly formed by the tubular member 316, the sleeve 320 and the valve members 326, to move downwardly in the annular space 312 relative to the assembly formed by the outer mandrel 302, the adapter 304, the sleeve 306 and the inner mandrel 310.

This relative axial movement between the two assemblies described above causes the beveled surface 310*a* to engage the valve members 326 and pivot them upwardly, and causes the beveled surface 306*a* to engage the wings 466 and pivot them upwardly. These axial and pivotal movements continue until the lower end of the member 320 reaches the bottom of the annular space 312. At this point, the valve members 326 are in their closed position of FIGS. 43 and 44 to collectively block the flow of the suspension of impactors 100 and drilling fluid downward through the passage 132 and the control device 460, and to the drill string 110. Moreover, the wings 466 are in their closed position of FIGS. 43 and 44 to collectively block the reverse flow of the suspension of impactors 100 and drilling fluid downward through the annulus 124, and upward through the drill bit 110 and into the passage 132.

In the event that it is desired to move the valve members 326 and the wings 466 from their closed position of FIGS. 43 and 44 to their open position of FIG. 42, fluid, at a relatively high pressure, is passed, via the drill string 130, into the bore of the sub 300. Since the valve members 326 are closed, the pressure of the fluid builds up to the extent that it leaks between the non-sealed outer surface of the inner mandrel 310 and the inner surfaces of the member 316 and the sleeve 320 and passes into the lower portion of the annular space 312 under the lower end of the sleeve 320. This creates a force acting against the latter end, thus forcing the assembly formed by the sleeve 320, the member 316, and the valve members 326 upwardly relative to the assembly formed by the outer mandrel 302, the adapter 304, the sleeve 306 and the inner mandrel 310. Thus, the valve members 326 and the wings 466 pivot downwardly to their respective open positions, as shown in FIG. 42.

In several exemplary embodiments, at least portions of the valve members 326 may be permeable to permit at least drilling fluid to flow downward through the passage 132, through the control device 460 and to the drill bit 110. Moreover, at least portions of the wings 466 may be permeable to permit at least drilling fluid to undergo backflow or reverse flow, flowing downward through the annulus 124 and past the control device 466, and upward through the drill bit 110 and into the passage 132 of the drill string 130.

In several exemplary embodiments, the size and/or quantity of the valve members 326 and/or wings 466 may be increased or decreased. In an exemplary embodiment, the control device 460 may include a single valve member 326 and/or a single wing 466. In an exemplary embodiment, the valve members 326 may be solid and/or may overlap with each other, and/or the wings 466 may be solid and/or may overlap with each other. In several exemplary embodiments, the shapes of the valve members 326 and/or the wings 466 may be varied.

In an exemplary embodiment, in addition to, or instead of lowering the drill string 130 in the wellbore 120 until the drill bit 110 is prevented from further downward movement, the control device 460 may be placed in the closed configuration by actuating the assembly formed by the outer mandrel 302, the adapter 304, the sleeve 306 and the inner mandrel 310 so that the assembly moves upwardly, relative to the assembly formed by the tubular member 316, the sleeve 320 and the valve members 326. In several exemplary embodiments, the assembly formed by the outer mandrel 302, the adapter 304, the sleeve 306 and the inner mandrel 310 may be actuated in any conventional manner using, for example, pressure actuation, gravity actuation, mechanical actuation and/or any combination thereof.

In an exemplary embodiment, and in addition to, or instead of the wings 466, the moveable portion 464 may include an inflatable and/or mechanically-activated continuous boot, which is coupled to, for example, the tubular member 316 and extends across the annulus 124 when the control device 460 is in the closed configuration.

A system for excavating a subterranean formation has been described that includes a drill string for receiving a suspension of impactors and fluid; a body member for discharging the suspension in the formation to remove a portion of the formation; and means in the drill string for controlling the flow of suspension between the drill string and the body member. In an exemplary embodiment, the suspension normally flows from a bore formed in the drill string to a bore formed in the body member and wherein the means blocks the flow to the bore in the body member. In an exemplary embodiment, the means is a valve assembly that moves between an open position in which it permits the flow of the suspension from the drill string to the body member, and a closed position in which it prevents the flow. In an exemplary embodiment, the valve assembly comprises two tubular members adapted for relative movement with respect to each other, and at least one valve member for moving between the open and closed positions in response to the relative movement. In an exemplary embodiment, the system further comprises means for lowering the drill string so that one of the tubular members is prevented from further movement, and so that the other tubular member moves relative to the one tubular member. In an exemplary embodiment, the valve member is pivotally mounted to one of the tubular members and is engaged by the other tubular member during the relative movement to pivot the valve member to one of the positions. In an exemplary embodiment, one tubular member extends inside the other tubular member, and further comprising means for introducing pressurized fluid into the one tubular member to cause relative movement between the tubular members to move the valve member to the other position. In an exemplary embodiment, there are a plurality of valve members angularly spaced around the inner wall of the one tubular member. In an exemplary embodiment, the system further comprises a removal device disposed on the body member, and means for rotating the body member so that the device mechanically removes another portion of the formation.

A method for excavating a subterranean formation has been described that includes introducing a suspension of impactors and fluid into a drill string; discharging the suspension from a body member into the formation to remove a portion of the formation; and controlling the flow of suspension between the drill string and the body member. In an exemplary embodiment, the step of controlling comprises moving at least one valve between an open position in which it permits the flow of the suspension from the drill string to the body member, and a closed position in which it prevents the flow. In an exemplary embodiment, the step of controlling further comprises moving two tubular members relative to each other, the valve moving between the open and closed positions in response to the relative movement. In an exemplary embodiment, the step of moving the two tubular members comprises lowering the drill string so that one of the tubular members is prevented from further movement and so that the other tubular member moves relative to the one tubular member. In an exemplary embodiment, the method further comprises pivotally mounting the valve to one of the tubular members, and engaging the valve by the other tubular member during the relative movement to pivot the valve member to one of the positions. In an exemplary embodiment, one of the tubular members extends inside the other tubular member, and further comprising introducing pressurized fluid into the one tubular member to cause relative movement between the tubular members to move the valve to the other position. In an exemplary embodiment, the pressurized fluid flows between the members and acts on an end of one of the members to cause the relative movement. In an exemplary embodiment, the method further comprises angularly spacing a plurality of valves around the inner wall of the one tubular member. In an exemplary embodiment, the method further comprises mechanically removing another portion of the formation during the step of discharging.

A method for excavating a subterranean formation has been described that includes introducing a suspension of impactors and fluid into a drill string; discharging the suspension from a body member into the formation to remove a portion of the formation; and controlling the flow of suspension between the drill string and the body member, comprising moving at least one valve between an open position in which it permits the flow of the suspension from the drill string to the body member, and a closed position in which it prevents the flow; and moving two tubular members relative to each other so that the valve moves between the open and closed positions in response to the relative movement, comprising lowering the drill string so that one of the tubular members is prevented from further movement and so that the other tubular member moves relative to the one tubular member; wherein one of the tubular members extends inside the other tubular member; and wherein the method further comprises pivotally mounting the valve to one of the tubular members; engaging the valve by the other tubular member during the relative movement to pivot the valve member to one of the positions; introducing pressurized fluid into the one tubular member to cause relative movement between the tubular members to move the valve to the other position, wherein the pressurized fluid flows between the members and acts on an end of one of the members to cause the relative movement; angularly spacing a plurality of valves around the inner wall of the one tubular member; and mechanically removing another portion of the formation during the step of discharging.

A system for excavating a subterranean formation has been described that includes a drill string for receiving a suspension of impactors and fluid; a body member for discharging the suspension in the formation to remove a portion of the formation; and means in the drill string for controlling the flow of suspension between the drill string and the body member; wherein the suspension normally flows from a bore formed in the drill string to a bore formed in the body member and wherein the means blocks the flow to the bore in the body member; wherein the means in the drill string for controlling the flow of suspension between the drill string and the body member comprises a valve assembly that moves between an open position in which it permits the flow of the suspension from the drill string to the body member, and a closed position in which it prevents the flow; wherein the valve assembly comprises two tubular members adapted for relative movement with respect to each other, and at least one valve member for moving between the open and closed positions in response to the relative movement; wherein the system further comprises means for lowering the drill string so that one of the tubular members is prevented from further movement, and so that the other tubular member moves relative to the one tubular member; wherein the valve member is pivotally mounted to one of the tubular members and is engaged by the other tubular member during the relative movement to pivot the valve member to one of the positions; wherein one tubular member extends inside the other tubular member; and wherein the system further comprises means for introducing pressurized fluid into the one tubular member to cause relative movement between the tubular members to move the valve member to the other position; a plurality of valve members angularly spaced around the inner wall of the one tubular member; and a removal device disposed on the body member, and means for rotating the body member so that the device mechanically removes another portion of the formation.

A method has been described that includes receiving a suspension of impactors and fluid in a drill string defining a passage so that at least a portion of the suspension flows through the passage and to a body member; and generally preventing at least a portion of the impactors present in the passage from flowing to the body member. In an exemplary embodiment, the method comprises discharging the at least a portion of the suspension in a formation using the body member. In an exemplary embodiment, an annulus is partially defined by the drill string; and wherein at least another portion of the impactors is received in the annulus in response to discharging the at least a portion of the suspension in the formation using the body member. In an exemplary embodiment, the method comprises generally preventing at least a portion of the at least another portion of the impactors present in the annulus from flowing from the annulus and into the passage. In an exemplary embodiment, the method comprises permitting the at least a portion of the at least another portion of the impactors present in the annulus to flow from the annulus and into the passage after generally preventing the at least a portion of the at least another portion of the impactors present in the annulus from flowing from the annulus and into the passage. In an exemplary embodiment, the method comprises permitting at least a portion of the fluid present in the annulus to flow during generally preventing the at least a portion of the at least another portion of the impactors present in the annulus from flowing from the annulus and into the passage. In an exemplary embodiment, the method comprises generally preventing the at least a portion of the at least another portion of the impactors present in the annulus from flowing from the annulus and into the passage comprises coupling a control device to the drill string. In an exemplary embodiment, the control device comprises a float valve. In an exemplary embodiment, the control device comprises a check valve. In an exemplary embodiment, the control device comprises a moveable portion; and wherein generally preventing the at least a portion of the at least another portion of the impactors present in the annulus from flowing from the annulus and into the passage further comprises placing the control device in a closed configuration. In an exemplary embodiment, the control device comprises at least one whisker; and wherein generally preventing the at least a portion of the at least another portion of the impactors present in the annulus from flowing from the annulus and into the passage further comprises placing the control device in a closed configuration. In an exemplary embodiment, the method comprises permitting at least a portion of the fluid present in the passage to flow to the body member during generally preventing the at least a portion of the impactors present in the passage from flowing to the body member. In an exemplary embodiment, the method comprises permitting the at least a portion of the impactors present in the passage to flow to the body member after generally preventing the at least a portion of the impactors present in the passage from flowing to the body member. In an exemplary embodiment, the method comprises generally preventing the at least a portion of the impactors present in the passage from flowing to the body member comprises forming a column of slug in the passage. In an exemplary embodiment, the method comprises discharging the at least a portion of the suspension in a formation using the body member; wherein an annulus is partially defined by the drill string; wherein at least another portion of the impactors is received in the annulus in response to discharging the at least a portion of the suspension in the formation using the body member; and wherein the method further comprises generally preventing at least a portion of the at least another portion of the impactors present in the annulus from flowing from the annulus and into the passage, comprising generally eliminating a pressure differential between the annulus and the passage using the column of slug. In an exemplary embodiment, the method comprises generally preventing the at least a portion of the impactors present in the passage from flowing to the body member comprises coupling a control device to the drill string; and placing the control device in a closed configuration. In an exemplary embodiment, the control device comprises at least one cable. In an exemplary embodiment, the control device comprises at least one whisker. In an exemplary embodiment, the control device comprises at least one valve member; and wherein placing the control device in a closed configuration comprises placing the at least one valve in a closed position. In an exemplary embodiment, the control device comprises at least one other valve member; wherein the method further comprises discharging the at least a portion of the suspension in a formation using the body member; wherein an annulus is partially defined by the drill string; wherein at least another portion of the impactors is received in the annulus in response to discharging the at least a portion of the suspension in the formation using the body member; and wherein the method further comprises generally preventing at least a portion of the at least another portion of the impactors present in the annulus from flowing from the annulus and into the passage, comprising placing the at least one other valve member in a closed position. In an exemplary embodiment, the method comprises the method further comprises discharging the at least a portion of the suspension in a formation using the body member; wherein an annulus is partially defined by the drill string; wherein at least another portion of the impactors is received in the annulus in response to discharging the at least a portion of the suspension in the formation using the body member; and wherein the method further comprises generally preventing at least a portion of the at least another portion of the impactors present in the annulus from flowing from the annulus and into the passage. In an exemplary embodiment, the method comprises generally preventing the at least a portion of the at least another portion of the impactors present in the annulus from flowing from the annulus and into the passage comprises coupling another control device to the drill string; and placing the another control device in a closed configuration.

A system has been described that includes means for receiving a suspension of impactors and fluid in a drill string defining a passage so that at least a portion of the suspension flows through the passage and to a body member; and means for generally preventing at least a portion of the impactors present in the passage from flowing to the body member. In an exemplary embodiment, the system comprises means for discharging the at least a portion of the suspension in a formation using the body member. In an exemplary embodiment, an annulus is partially defined by the drill string; and wherein at least another portion of the impactors is received in the annulus in response to discharging the at least a portion of the suspension in the formation using the body member. In an exemplary embodiment, the system comprises means for generally preventing at least a portion of the at least another portion of the impactors present in the annulus from flowing from the annulus and into the passage. In an exemplary embodiment, the system comprises means for permitting the at least a portion of the at least another portion of the impactors present in the annulus to flow from the annulus and into the passage after generally preventing the at least a portion of the at least another portion of the impactors present in the annulus from flowing from the annulus and into the passage. In an exemplary embodiment, the system comprises means for permitting at least a portion of the fluid present in the annulus to flow during generally preventing the at least a portion of the at least another portion of the impactors present in the annulus from flowing from the annulus and into the passage. In an exemplary embodiment, means for generally preventing the at least a portion of the at least another portion of the impactors present in the annulus from flowing from the annulus and into the passage comprises means for coupling a control device to the drill string. In an exemplary embodiment, the control device comprises a float valve. In an exemplary embodiment, the control device comprises a check valve. In an exemplary embodiment, the control device comprises a moveable portion; and wherein means for generally preventing the at least a portion of the at least another portion of the impactors present in the annulus from flowing from the annulus and into the passage further comprises means for placing the control device in a closed configuration. In an exemplary embodiment, the control device comprises at least one whisker; and wherein means for generally preventing the at least a portion of the at least another portion of the impactors present in the annulus from flowing from the annulus and into the passage further comprises means for placing the control device in a closed configuration. In an exemplary embodiment, the system comprises means for permitting at least a portion of the fluid present in the passage to flow to the body member during generally preventing the at least a portion of the impactors present in the passage from flowing to the body member. In an exemplary embodiment, the system comprises means for permitting the at least a portion of the impactors present in the passage to flow to the body member after generally preventing the at least a portion of the impactors present in the passage from flowing to the body member. In an exemplary embodiment, means for generally preventing the at least a portion of the impactors present in the passage from flowing to the body member comprises means for forming a column of slug in the passage. In an exemplary embodiment, the system comprises means for discharging the at least a portion of the suspension in a formation using the body member; wherein an annulus is partially defined by the drill string; wherein at least another portion of the impactors is received in the annulus in response to discharging the at least a portion of the suspension in the formation using the body member; and wherein the system further comprises means for generally preventing at least a portion of the at least another portion of the impactors present in the annulus from flowing from the annulus and into the passage, comprising means for generally eliminating a pressure differential between the annulus and the passage using the column of slug. In an exemplary embodiment, means for generally preventing the at least a portion of the impactors present in the passage from flowing to the body member comprises means for coupling a control device to the drill string; and means for placing the control device in a closed configuration. In an exemplary embodiment, the control device comprises at least one cable. In an exemplary embodiment, the control device comprises at least one whisker. In an exemplary embodiment, the control device comprises at least one valve member; and wherein means for placing the control device in a closed configuration comprises means for placing the at least one valve in a closed position. In an exemplary embodiment, the control device comprises at least one other valve member; wherein the system further comprises means for discharging the at least a portion of the suspension in a formation using the body member; wherein an annulus is partially defined by the drill string; wherein at least another portion of the impactors is received in the annulus in response to discharging the at least a portion of the suspension in the formation using the body member; and wherein the system further comprises means for generally preventing at least a portion of the at least another portion of the impactors present in the annulus from flowing from the annulus and into the passage, comprising means for placing the at least one other valve member in a closed position. In an exemplary embodiment, the system further comprises means for discharging the at least a portion of the suspension in a formation using the body member; wherein an annulus is partially defined by the drill string; wherein at least another portion of the impactors is received in the annulus in response to discharging the at least a portion of the suspension in the formation using the body member; and wherein the system further comprises means for generally preventing at least a portion of the at least another portion of the impactors present in the annulus from flowing from the annulus and into the passage. In an exemplary embodiment, means for generally preventing the at least a portion of the at least another portion of the impactors present in the annulus from flowing from the annulus and into the passage comprises means for coupling another control device to the drill string; and means for placing the another control device in a closed configuration.

A method has been described that includes receiving a suspension of impactors and fluid in a drill string defining a passage so that at least a portion of the suspension flows through the passage and to a body member, the drill string partially defining an annulus; discharging the at least a portion of the suspension in a formation using the body member so that at least a portion of the impactors is received in the annulus; and generally preventing at least a portion of the at least a portion of the impactors present in the annulus from flowing from the annulus and into the passage. In an exemplary embodiment, the method comprises generally preventing at least another portion of the impactors present in the passage from flowing to the body member. In an exemplary embodiment, the method comprises permitting at least a portion of the fluid present in the passage to flow to the body member during generally preventing the at least another portion of the impactors present in the passage from flowing to the body member. In an exemplary embodiment, the method comprises permitting the at least another portion of the impactors present in the passage to flow to the body member after generally preventing the at least another portion of the impactors present in the passage from flowing to the body member. In an exemplary embodiment, the method comprises generally preventing the at least another portion of the impactors present in the passage from flowing to the body member comprises coupling a control device to the drill string; and placing the control device in a closed configuration. In an exemplary embodiment, the control device comprises at least one cable. In an exemplary embodiment, the control device comprises at least one whisker. In an exemplary embodiment, the control device comprises at least one valve member; and wherein placing the control device in a closed configuration comprises placing the at least one valve in a closed position. In an exemplary embodiment, the method comprises permitting the at least a portion of the at least a portion of the impactors present in the annulus to flow from the annulus and into the passage after generally preventing the at least a portion of the at least a portion of the impactors present in the annulus from flowing from the annulus and into the passage. In an exemplary embodiment, the method comprises permitting at least a portion of the fluid present in the annulus to flow during generally preventing the at least a portion of the at least a portion of the impactors present in the annulus from flowing from the annulus and into the passage. In an exemplary embodiment, the method comprises generally preventing the at least a portion of the at least a portion of the impactors present in the annulus from flowing from the annulus and into the passage comprises coupling a control device to the drill string. In an exemplary embodiment, the control device comprises a float valve. In an exemplary embodiment, the control device comprises a check valve. In an exemplary embodiment, the control device comprises a moveable portion; and wherein generally preventing the at least a portion of the at least a portion of the impactors present in the annulus from flowing from the annulus and into the passage further comprises placing the control device in a closed configuration. In an exemplary embodiment, the control device comprises at least one whisker; and wherein generally preventing the at least a portion of the at least a portion of the impactors present in the annulus from flowing from the annulus and into the passage further comprises placing the control device in a closed configuration. In an exemplary embodiment, the control device comprises at least one valve member; and wherein generally preventing the at least a portion of the at least a portion of the impactors present in the annulus from flowing from the annulus and into the passage further comprises placing the at least one valve member in a closed position. In an exemplary embodiment, the control device comprises at least one other valve member; and wherein the method further comprises generally preventing at least another portion of the impactors present in the passage from flowing to the body member, comprising placing the at least one other valve member in a closed position. In an exemplary embodiment, the method comprises generally preventing at least another portion of the impactors present in the passage from flowing to the body member. In an exemplary embodiment, the method comprises generally preventing the at least another portion of the impactors present in the passage from flowing to the body member comprises coupling another control device to the drill string; and placing the another control device in a closed configuration. In an exemplary embodiment, the method comprises generally preventing the at least a portion of the at least a portion of the impactors present in the annulus from flowing from the annulus and into the passage comprises forming a column of slug in the passage. In an exemplary embodiment, the method comprises generally preventing the at least a portion of the at least a portion of the impactors present in the annulus from flowing from the annulus and into the passage further comprises generally eliminating a pressure differential between the annulus and the passage using the column of slug. In an exemplary embodiment, the method comprises generally preventing at least another portion of the impactors present in the passage from flowing to the body member using the column of slug.

A system has been described that includes means for receiving a suspension of impactors and fluid in a drill string defining a passage so that at least a portion of the suspension flows through the passage and to a body member, the drill string partially defining an annulus; means for discharging the at least a portion of the suspension in a formation using the body member so that at least a portion of the impactors is received in the annulus; and means for generally preventing at least a portion of the at least a portion of the impactors present in the annulus from flowing from the annulus and into the passage. In an exemplary embodiment, the system comprises means for generally preventing at least another portion of the impactors present in the passage from flowing to the body member. In an exemplary embodiment, the system comprises means for permitting at least a portion of the fluid present in the passage to flow to the body member during generally preventing the at least another portion of the impactors present in the passage from flowing to the body member. In an exemplary embodiment, the system comprises means for permitting the at least another portion of the impactors present in the passage to flow to the body member after generally preventing the at least another portion of the impactors present in the passage from flowing to the body member. In an exemplary embodiment, means for generally preventing the at least another portion of the impactors present in the passage from flowing to the body member comprises means for coupling a control device to the drill string; and means for placing the control device in a closed configuration. In an exemplary embodiment, the control device comprises at least one cable. In an exemplary embodiment, the control device comprises at least one whisker. In an exemplary embodiment, the control device comprises at least one valve member; and wherein means for placing the control device in a closed configuration comprises means for placing the at least one valve in a closed position. In an exemplary embodiment, means for permitting the at least a portion of the at least a portion of the impactors present in the annulus to flow from the annulus and into the passage after generally preventing the at least a portion of the at least a portion of the impactors present in the annulus from flowing from the annulus and into the passage. In an exemplary embodiment, the system comprises means for permitting at least a portion of the fluid present in the annulus to flow during generally preventing the at least a portion of the at least a portion of the impactors present in the annulus from flowing from the annulus and into the passage. In an exemplary embodiment, means for generally preventing the at least a portion of the at least a portion of the impactors present in the annulus from flowing from the annulus and into the passage comprises means for coupling a control device to the drill string. In an exemplary embodiment, the control device comprises a float valve. In an exemplary embodiment, the control device comprises a check valve. In an exemplary embodiment, the control device comprises a moveable portion; and wherein means for generally preventing the at least a portion of the at least a portion of the impactors present in the annulus from flowing from the annulus and into the passage further comprises means for placing the control device in a closed configuration. In an exemplary embodiment, the control device comprises at least one whisker; and wherein means for generally preventing the at least a portion of the at least a portion of the impactors present in the annulus from flowing from the annulus and into the passage further comprises means for placing the control device in a closed configuration. In an exemplary embodiment, the control device comprises at least one valve member; and wherein means for generally preventing the at least a portion of the at least a portion of the impactors present in the annulus from flowing from the annulus and into the passage further comprises means for placing the at least one valve member in a closed position. In an exemplary embodiment, the control device comprises at least one other valve member; and wherein the system further comprises means for generally preventing at least another portion of the impactors present in the passage from flowing to the body member, comprising means for placing the at least one other valve member in a closed position. In an exemplary embodiment, the system comprises means for generally preventing at least another portion of the impactors present in the passage from flowing to the body member. In an exemplary embodiment, means for generally preventing the at least another portion of the impactors present in the passage from flowing to the body member comprises means for coupling another control device to the drill string; and means for placing the another control device in a closed configuration. In an exemplary embodiment, means for generally preventing the at least a portion of the at least a portion of the impactors present in the annulus from flowing from the annulus and into the passage comprises means for forming a column of slug in the passage. In an exemplary embodiment, means for generally preventing the at least a portion of the at least a portion of the impactors present in the annulus from flowing from the annulus and into the passage further comprises means for generally eliminating a pressure differential between the annulus and the passage using the column of slug. In an exemplary embodiment, the system comprises means for generally preventing at least another portion of the impactors present in the passage from flowing to the body member using the column of slug.

A method has been described that includes receiving a suspension of impactors and fluid in a drill string defining a passage so that at least a portion of the suspension flows through the passage and to a body member, the drill string partially defining an annulus; discharging the at least a portion of the suspension in a formation using the body member so that at least a portion of the impactors is received in the annulus; and generally preventing at least a portion of the at least a portion of the impactors present in the annulus from flowing from the annulus and into the passage, comprising forming a column of slug in the passage; and generally eliminating a pressure differential between the annulus and the passage using the column of slug; and generally preventing at least another portion of the impactors present in the passage from flowing to the body member using the column of slug.

A system has been described that includes means for receiving a suspension of impactors and fluid in a drill string defining a passage so that at least a portion of the suspension flows through the passage and to a body member, the drill string partially defining an annulus; means for discharging the at least a portion of the suspension in a formation using the body member so that at least a portion of the impactors is received in the annulus; and means for generally preventing at least a portion of the at least a portion of the impactors present in the annulus from flowing from the annulus and into the passage, comprising means for forming a column of slug in the passage; and means for generally eliminating a pressure differential between the annulus and the passage using the column of slug; and means for generally preventing at least another portion of the impactors present in the passage from flowing to the body member using the column of slug.

A method has been described that includes receiving a suspension of impactors and fluid in a drill string defining a passage so that at least a portion of the suspension flows through the passage and to a body member, the drill string partially defining an annulus; discharging the at least a portion of the suspension in a formation using the body member so that at least a portion of the impactors is received in the annulus; and generally preventing at least a portion of the at least a portion of the impactors present in the annulus from flowing from the annulus and into the passage, comprising coupling a control device to the drill string, the control device comprising at least one valve member; and placing the at least one valve member in a closed position; wherein the control device comprises at least one other valve member; and wherein the method further comprises generally preventing at least another portion of the impactors present in the passage from flowing to the body member, comprising placing the at least one other valve member in a closed position.

A system has been described that includes means for receiving a suspension of impactors and fluid in a drill string defining a passage so that at least a portion of the suspension flows through the passage and to a body member, the drill string partially defining an annulus; means for discharging the at least a portion of the suspension in a formation using the body member so that at least a portion of the impactors is received in the annulus; and means for generally preventing at least a portion of the at least a portion of the impactors present in the annulus from flowing from the annulus and into the passage, comprising means for coupling a control device to the drill string, the control device comprising at least one valve member; and means for placing the at least one valve member in a closed position; wherein the control device comprises at least one other valve member; and wherein the system further comprises means for generally preventing at least another portion of the impactors present in the passage from flowing to the body member, comprising means for placing the at least one other valve member in a closed position.

A method has been described that includes receiving a suspension of impactors and fluid in a drill string defining a passage so that at least a portion of the suspension flows through the passage and to a body member, the drill string partially defining an annulus; discharging the at least a portion of the suspension in a formation using the body member so that at least a portion of the impactors is received in the annulus; and generally preventing at least a portion of the at least a portion of the impactors present in the annulus from flowing from the annulus and into the passage; generally preventing at least another portion of the impactors present in the passage from flowing to the body member; permitting at least a portion of the fluid present in the passage to flow to the body member during generally preventing the at least another portion of the impactors present in the passage from flowing to the body member; permitting the at least another portion of the impactors present in the passage to flow to the body member after generally preventing the at least another portion of the impactors present in the passage from flowing to the body member; wherein generally preventing the at least another portion of the impactors present in the passage from flowing to the body member comprises coupling a control device to the drill string; and placing the control device in a closed configuration; wherein the method further comprises permitting the at least a portion of the at least a portion of the impactors present in the annulus to flow from the annulus and into the passage after generally preventing the at least a portion of the at least a portion of the impactors present in the annulus from flowing from the annulus and into the passage; and permitting at least a portion of the fluid present in the annulus to flow during generally preventing the at least a portion of the at least a portion of the impactors present in the annulus from flowing from the annulus and into the passage; and wherein generally preventing the at least a portion of the at least a portion of the impactors present in the annulus from flowing from the annulus and into the passage comprises coupling a control device to the drill string.

A system has been described that includes means for receiving a suspension of impactors and fluid in a drill string defining a passage so that at least a portion of the suspension flows through the passage and to a body member, the drill string partially defining an annulus; means for discharging the at least a portion of the suspension in a formation using the body member so that at least a portion of the impactors is received in the annulus; and means for generally preventing at least a portion of the at least a portion of the impactors present in the annulus from flowing from the annulus and into the passage; means for generally preventing at least another portion of the impactors present in the passage from flowing to the body member; means for permitting at least a portion of the fluid present in the passage to flow to the body member during generally preventing the at least another portion of the impactors present in the passage from flowing to the body member; means for permitting the at least another portion of the impactors present in the passage to flow to the body member after generally preventing the at least another portion of the impactors present in the passage from flowing to the body member; wherein means for generally preventing the at least another portion of the impactors present in the passage from flowing to the body member comprises means for coupling a control device to the drill string; and means for placing the control device in a closed configuration; wherein the system further comprises means for permitting the at least a portion of the at least a portion of the impactors present in the annulus to flow from the annulus and into the passage after generally preventing the at least a portion of the at least a portion of the impactors present in the annulus from flowing from the annulus and into the passage; and means for permitting at least a portion of the fluid present in the annulus to flow during generally preventing the at least a portion of the at least a portion of the impactors present in the annulus from flowing from the annulus and into the passage; and wherein means for generally preventing the at least a portion of the at least a portion of the impactors present in the annulus from flowing from the annulus and into the passage comprises means for coupling a control device to the drill string.

An apparatus has been described that includes a drill string defining a passage within which a suspension of impactors and fluid is adapted to flow; a body member for discharging at least a portion of the suspension in a formation; and a control device coupled to the drill string for controlling the flow of at least a portion of the impactors through the body member. In an exemplary embodiment, the control device comprises a float valve; wherein the float valve generally prevents the at least a portion of the impactors from flowing through the body member and into the passage. In an exemplary embodiment, the control device comprises a check valve; wherein the check valve generally prevents the at least a portion of the impactors from flowing through the body member and into the passage. In an exemplary embodiment, the control device comprises a moveable portion; a closed configuration in which the at least a portion of the impactors is generally prevented from flowing through the body member and into the passage; and an open configuration in which the at least a portion of the impactors is permitted to flow through the body member and into the passage. In an exemplary embodiment, the drill string partially defines an annulus; and wherein, when the control device is in the closed configuration, the moveable portion extends in the annulus to generally prevent the at least a portion of the impactors from flowing from the annulus, through the body member and into the passage. In an exemplary embodiment, the control device comprises a closed configuration in which the at least a portion of the impactors is generally prevented from flowing through the passage and to the body member for discharge therethrough; and an open configuration in which the at least a portion of the impactors is permitted to flow through the passage and to the body member for discharge therethrough. In an exemplary embodiment, the apparatus comprises another control device coupled to the drill string and comprising a closed configuration in which at least another portion of the impactors is generally prevented from flowing through the body member and into the passage; and an open configuration in which the at least another portion of the impactors is permitted to flow through the body member and into the passage. In an exemplary embodiment, the apparatus comprises a float valve fluidicly coupled between the control device and the body member; wherein the float valve generally prevents at least another portion of the impactors from flowing through the body member and into the passage. In an exemplary embodiment, the apparatus comprises a check valve fluidicly coupled between the control device and the body member; wherein the check valve generally prevents at least another portion of the impactors from flowing through the body member and into the passage. In an exemplary embodiment, the control device comprises at least one cable. In an exemplary embodiment, the control device comprises at least one whisker. In an exemplary embodiment, the control device comprises at least one valve member. In an exemplary embodiment, at least a portion of the valve member is permeable to permit fluid to flow therethrough. In an exemplary embodiment, the drill string partially defines an annulus; and wherein the control device comprises one or more whiskers that are adapted to extend within the annulus to generally prevent the at least a portion of the impactors from flowing from the annulus, through the body member and into the passage. In an exemplary embodiment, the control device comprises a column of slug extending within the passage. In an exemplary embodiment, the column of slug generally prevents the at least a portion of the impactors from flowing through the passage and to the body member. In an exemplary embodiment, the drill string partially defines an annulus; and wherein the column of slug generally eliminates a pressure differential between the annulus and the passage to generally prevent the at least a portion of the impactors from flowing from the annulus, through the body member and into the passage. In an exemplary embodiment, the control device comprises at least one valve member comprising a closed position in which the at least a portion of the impactors is generally prevented from flowing through the passage and to the body member for discharge therethrough; and at least one other valve member comprising a closed position in which at least another portion of the impactors is generally prevented from flowing through the body member and into the passage.

A drilling system has been described that includes at least one pump; a controller operably coupled to the at least one pump for controlling the operation of the at least one pump; a drill string defining a passage in which a suspension of impactors and fluid is adapted to flow, the passage being fluidicly coupled to the at least one pump; and a control device coupled to the drill string for controlling the flow of at least a portion of the impactors.

A drilling system has been described that includes at least one pump; a controller operably coupled to the at least one pump for controlling the operation of the at least one pump; a drill string defining a passage in which a suspension of impactors and fluid is adapted to flow, the passage being fluidicly coupled to the at least one pump; a wellbore extending in a formation, the drill string at least partially extending within the wellbore to define an annulus between the drill string and the inside wall of the wellbore; a body member for discharging at least a portion of the suspension in the formation; and a control device coupled to the drill string for controlling the flow of at least a portion of the impactors, comprising a closed configuration in which the at least a portion of the impactors is generally prevented from flowing in at least one flow direction; and an open configuration in which the at least a portion of the impactors is permitted to flow in the at least one flow direction; wherein the at least one flow direction is selected from the group consisting of a first direction from the passage and through the body member, and a second direction from the annulus, through the body member and into the passage.

An apparatus has been described that includes a drill string defining a passage within which a suspension of impactors and fluid is adapted to flow; a body member for discharging at least a portion of the suspension in a formation; and a control device coupled to the drill string for controlling the flow of at least a portion of the impactors through the body member, comprising a closed configuration in which the at least a portion of the impactors is generally prevented from flowing through the passage and to the body member for discharge therethrough; and an open configuration in which the at least a portion of the impactors is permitted to flow through the passage and to the body member for discharge therethrough; and another control device coupled to the drill string and comprising a closed configuration in which at least another portion of the impactors is generally prevented from flowing through the body member and into the passage; and an open configuration in which the at least another portion of the impactors is permitted to flow through the body member and into the passage.

It is understood that variations may be made in the above without departing from the scope of the disclosure. Also, any foregoing spatial references, such as "upper", "lower", "axial", "radial", "upward," "downward," "vertical," "angular," etc. are for the purpose of illustration only and do not limit the specific orientation or location of the structure described above.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments as described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A method comprising:

receiving a suspension of impactors and fluid in a drill string defining a passage so that at least a portion of the suspension flows through the passage and to a body member, the drill string partially defining an annulus;

discharging the at least a portion of the suspension in a formation using the body member so that at least a portion of the imp actors is received in the annulus; and generally preventing at least a portion of the at least a portion of the impactors present in the annulus from flowing from the annulus and into the passage, comprising:

coupling a control device to the drill string, the control device comprising at least one valve member; and placing the at least one valve member in a closed position;

wherein the control device comprises at least one other valve member; and wherein the method further comprises generally preventing at least another portion of the impactors present in the passage from flowing to the body member, comprising:

placing the at least one other valve member in a closed position.

2. A system comprising:

means for receiving a suspension of impactors and fluid in a drill string defining a passage so that at least a portion of the suspension flows through the passage and to a body member, the drill string partially defining an annulus;

means for discharging the at least a portion of the suspension in a formation using the body member so that at least a portion of the impactors is received in the annulus; and means for generally preventing at least a portion of the at least a portion of the impactors present in the annulus from flowing from the annulus and into the passage, comprising:

means for coupling a control device to the drill string, the control device comprising at least one valve member; and means for placing the at least one valve member in a closed position;

wherein the control device comprises at least one other valve member; and wherein the system further comprises means for generally preventing at least another portion of the impactors present in the passage from flowing to the body member, comprising:

means for placing the at least one other valve member in a closed position.

3. A system comprising:

means for receiving a suspension of impactors and fluid in a drill string defining a passage so that at least a portion of the suspension flows through the passage and to a body member, the drill string partially defining an annulus;

means for discharging the at least a portion of the suspension in a formation using the body member so that at least a portion of the impactors is received in the annulus; and means for generally preventing at least a portion of the at least a portion of the impactors present in the annulus from flowing from the annulus and into the passage;

means for generally preventing at least another portion of the impactors present in the passage from flowing to the body member;

means for permitting at least a portion of the fluid present in the passage to flow to the body member during generally preventing the at least another portion of the impactors present in the passage from flowing to the body member; and means for permitting the at least another portion of the impactors present in the passage to flow to the body member after generally preventing the at least another portion of the impactors present in the passage from flowing to the body member;

wherein means for generally preventing the at least another portion of the impactors present in the passage from flowing to the body member comprises:

means for coupling a control device to the drill string; and means for placing the control device in a closed configuration;

wherein the system further comprises: means for permitting the at least a portion of the at least a portion of the impactors present in the annulus to flow from the annulus and into the passage after generally preventing the at least a portion of the at least a portion of the impactors present in the annulus from flowing from the annulus and into the passage; and means for permitting at least a portion of the fluid present in the annulus to flow during generally preventing the at least a portion of the at least a portion of the impactors present in the annulus from flowing from the annulus and into the passage; and wherein means for generally preventing the at least a portion of the at least a portion of the impactors present in the annulus from flowing from the annulus and into the passage comprises means for coupling a control device to the drill string.

4. An apparatus comprising:

a drill string defining a passage within which a suspension of impactors and fluid is adapted to flow;

a body member for discharging at least a portion of the suspension in a formation; and a control device coupled to the drill string for controlling the flow of at least a portion of the impactors through the body member, comprising:

a closed configuration in which the at least a portion of the impactors is generally prevented from flowing through the passage and to the body member for discharge therethrough; and an open configuration in which the at least a portion of the impactors is permitted to flow through the passage and to the body member for discharge therethrough; and another control device coupled to the drill string and comprising:

a closed configuration in which at least another portion of the impactors is generally prevented from flowing through the body member and into the passage; and an open configuration in which the at least another portion of the impactors is permitted to flow through the body member and into the passage.

5. A system for excavating a wellbore through a subterranean formation, the system comprising: a drill string disposed in the wellbore forming an annulus in the space between the drill string and the wellbore inner wall, the drill string having an axial passage along its length, a suspension of impactors and fluid flowable in the passage; a body member on an end of the drill string disposed in the wellbore; a nozzle on the body member having an inlet in fluid communication with the axial passage and an outlet directed at the formation, so that when the flowing suspension reaches the nozzle inlet, a suspension discharge exits the nozzle outlet to remove a portion of the formation; and a flow controller having a valve coupled with the drill string, the valve selectively moveable between an open position and a closed position, so that when the valve is in the closed position flow through the valve is blocked; the valve comprising:

a multiplicity of elastic whiskers projecting from a drill string surface, and the fluid is pressurized by a pump, so that when a flowing suspension of impactors and pressurized fluid flows past the drill string surface the whiskers are bent in the direction of the flow, and so that when the pump ceases pressurizing the fluid the whiskers become aligned generally perpendicular to the drill string axis and wherein the impactors are impeded from flowing past the valve by the density of whiskers;

wherein the valve is disposed within the annulus when the pump ceases pressurizing fluid, impactor flow through the annulus is impeded.

* * * * *